US007405401B2

(12) United States Patent
Hoyes

(10) Patent No.: US 7,405,401 B2
(45) Date of Patent: Jul. 29, 2008

(54) ION EXTRACTION DEVICES, MASS SPECTROMETER DEVICES, AND METHODS OF SELECTIVELY EXTRACTING IONS AND PERFORMING MASS SPECTROMETRY

(75) Inventor: John Brian Hoyes, Stockport (GB)

(73) Assignee: Micromass UK Limited (GB)

( * ) Notice: Subject to any disclaimer, the term of this patent is extended or adjusted under 35 U.S.C. 154(b) by 199 days.

(21) Appl. No.: 11/483,961

(22) Filed: Jul. 10, 2006

(65) Prior Publication Data

US 2007/0034810 A1 Feb. 15, 2007

Related U.S. Application Data

(63) Continuation-in-part of application No. PCT/GB2005/000050, filed on Jan. 10, 2005.

(60) Provisional application No. 60/701,466, filed on Jul. 21, 2005.

(30) Foreign Application Priority Data

| | | |
|---|---|---|
| Jan. 9, 2004 | (GB) | 0400420 |
| Apr. 17, 2004 | (GB) | 0408628 |
| Jul. 21, 2005 | (GB) | 0514964 |

(51) Int. Cl.
*H01J 3/14* (2006.01)
*H01J 49/42* (2006.01)

(52) U.S. Cl. ..... 250/292; 250/281; 250/282; 250/423 R; 250/424; 250/288; 250/287; 250/396 R

(58) Field of Classification Search ..... 250/292, 250/281, 423 R, 396 R, 288, 287
See application file for complete search history.

(56) References Cited

U.S. PATENT DOCUMENTS

| | | | | |
|---|---|---|---|---|
| 6,585,891 | B1 * | 7/2003 | Ohkawa | 210/222 |
| 7,071,467 | B2 * | 7/2006 | Bateman et al. | 250/292 |
| 7,288,942 | B2 * | 10/2007 | Zhang et al. | 324/464 |

* cited by examiner

*Primary Examiner*—Nikita Wells
(74) *Attorney, Agent, or Firm*—Jamie H. Rose; Anthony J. Janiuk

(57) ABSTRACT

There is disclosed a method of selectively extracting ions comprising the steps of:

providing a supply of ions in a body of gas;

generating a ponderomotive ion trapping potential generally along an axis;

generating further potentials to provide an effective potential which prevents ions from being extracted from an extraction region;

trapping ions in said effective potential; and selectively extracting ions of a predetermined m/z ratio or ion mobility from the extraction region;

in which the characteristics of the effective potential which prevent ions from being extracted from the extraction region are caused, at least in part, by the generation of the ponderomotive ion trapping potential.

104 Claims, 35 Drawing Sheets

RF plates confine ions in one dimension only, dotted lines show periodicity in effective potential.

Typical DC potential well

M = 2000 in device centre 0.3V ripple

M = 2000 at rf plates 0.3V ripple

M = 200 in device centre 3 V ripple

M = 200 at rf plates 3V ripple

V0=200V, Mass 2000, Z=0 plane

V0=200V, Mass 50, Z=0 plane

V0=50V, Mass 2000, Z=0 plane

V=50V, Mass 2000, Z=0 plane

V0=50V, Mass 50, X=0 plane

V=50V, Mass 50, X=0 plane

V0=50V, Mass 200, X=0 plane, Vent = Vext = 1V showing complete 3D trapping

Connecting adjacent plates together increases spacing of periodicity and creates ripple in effective potential Potential minima positions are mass dependant so exit plate has rectangular hole to allow ions to exit the device successfully DC Potential energy diagram for a HERF cell coupled to a Quadrupole The HERF can be configured to mass selectively eject from high to low while accumulating ions during the scan part of the cycle

ION EXTRACTION DEVICES, MASS SPECTROMETER DEVICES, AND METHODS OF SELECTIVELY EXTRACTING IONS AND PERFORMING MASS SPECTROMETRY

FIELD OF THE INVENTION

This invention relates to ion extraction devices, analytical devices incorporating same, methods of extracting ions and methods of analysing ions or physical phenomena associated with ions, with particular, but by no means exclusive, reference to mass spectrometry and to selective extraction of ions of different mass (m) to charge (z) ratios (henceforth termed "m/z" ratios) and/or of different ion mobilities.

BACKGROUND OF THE INVENTION

Mass scanning mass spectrometers, such as quadrupole mass spectrometers, are ubiquitous analytical devices. A major drawback of any scanning mass spectrometer is a loss of sensitivity due to poor duty cycle. For example, if a quadrupole mass spectrometer scans a mass range of x Da with a mass resolution or peak width of y Da, then a duty cycle of y/x is obtained. For a conventional quadrupole mass spectrometer, realistic values of x and y are 1000 and 1 respectively, resulting in a duty cycle of only 1/1000 or 0.1%. Physically, this is because when scanning in this way the spectrometer is only detecting 0.1% of the total mass range at any instance in time; all of the other ions are unstable and so are rejected.

The charge on an ion, q, can be rewritten as ze where e is the electronic charge and z is the so called charge state of an ion. It has been previously recognised that ions of differing charge state may occupy differing radial positions within a multipole ion guide [Rapid Communication in Mass Spectrometry 14, 1907-1913 (2000)]. In this study it was shown how ions of similar m and differing z or similar z and differing m occupy differing radial positions in a multipole ion guide when in the presence of a buffer gas. This stratification is caused by both the space charge repulsion between differing species and the charge and mass dependence of the effective potential. The behaviour of such devices depends on the ion density present within the guide and as such it is difficult to exploit this behaviour as a predictable deterministic analytical separation. This is because at any one time the number and type of ion species within the guide and therefore its space charge can vary dramatically. It would be desirable to produce a device that separates ions in a predictable manner enabling it to be efficiently coupled to further spectrometer stages downstream from the device.

The use of radio frequency (RF) ion guides at elevated pressures to efficiently transmit ions from one portion of a spectrometer to another is now widespread. These devices work on the principle of so called "effective potential wells" (Gerlich et al, (1992) Inhomogeneous Electrical Radio Frequency Fields: A versatile tool for the study of processes with slow ions. Adv. In Chem Phys LXXXII, 1.ISBN 0-471-53258-4, John Wiley and Sons). Ions may be trapped in these wells for extended periods of time either by the use of cylindrical geometry devices such as conventional Paul traps, or using linear geometry devices such as multipole guides or ring sets with end plates providing trapping D.C. potential. These RF devices are able to trap in three dimensions in a way which is impossible to achieve using purely electrostatic ion optical elements. This is because Laplace's equation, which describes the behaviour of electrostatic fields, contains no true potential minima but only saddle points which on their own are insufficient to give true three dimensional trapping.

An oscillatory A.C. field applied to quadrupoles, hexapoles, and octopoles (collectively known as multipoles) or to ring sets gives rise to the so called ponderomotive force which acts in the direction of weaker field i.e. towards the central optic axis of the multipole or ring set. In the absence of gas, ions will oscillate in the potential well with an amplitude dependent upon their radial energy. In the relatively simple case of quadrupoles the restoring force towards the optic axis is proportional to the distance from it and so an ion with finite energy may be seen to exhibit simple harmonic motion on a macroscopic level within the well. The addition of gas molecules to such a device acts to dampen this radial motion so that ions are in effect cooled and concentrated to the centre of the device. As ions are cooled in these linear multipoles or ring sets they loose any forward impetus they had to traverse the length of the device. The ions are rapidly thermalised and will remain in the guide until the space charge effect from other ions behind pushes them along. This sluggish motion of ions in the guides has led to problems when interfacing with fast scanning devices such as analytical quadrupoles. U.S. Pat. No. 4,283,626 describes the use of a "leaky dielectric" inserted inside the multipole to allow for the provision of a drift field to speed the ions through a collision cell. This leaky dielectric is transparent to the RF field (thus maintaining a potential well) but has enough resistivity to allow a potential gradient to be applied axially along its length. U.S. Pat. No. 4,283,626 recognises that such a drift field in the presence of gas may be used to separate ions for analytical purposes. U.S. Pat. No. 5,847,386 describes a number of different methods to induce a smooth axial field along the length of the linear guides to speed the transmission of ions through them. Such methods include segmenting of the rods themselves, or using external ring electrodes, or tapering the rods themselves or using different pitch circle diameters for oppositely phased rod sets at either end of the guide. US patent publication 2002/0070338 describes the use of segmented rods to provide an axial D.C. field and to give separation of the ion species according to their ion mobility. Again, RF confinement is combined with a drift field in the presence of gas. This combination is versatile since ions may be manipulated in a wide variety of ways using D.C travelling waves in the axial direction to create moving potential wells while maintaining radial confinement with the ponderomotive force from the RF supply. Related techniques are described in U.S. Pat. No. 5,206,506 and U.S. Pat. No. 6,483,109. The contents of U.S. Pat. No. 4,283,626; U.S. Pat. No. 5,847,386; US 2002/0070338; U.S. Pat. No. 5,206,506 and U.S. Pat. No. 6,483,109, together with U.S. Pat. Nos. 6,794,640 and 6,800,846, are hereby incorporated by reference. With the exception of Gerlich, all of the above techniques describe devices using RF ponderomotive confinement in both dimensions, i.e. they confine ions radially simultaneously but provide little or no radial spatial separation of ions. Gerlich describes a stacked rf plate ion guide with DC top and bottom plates which is employed as a storage ion source, but no theoretical treatment of this device is presented.

SUMMARY OF THE INVENTION

The present invention provides mass scanning mass spectrometer devices of enhanced sensitivity and ion extraction devices which, at least in some embodiments, satisfy the above described needs and overcome the above described problems and disadvantages associated with the prior art. The present invention provides new ion separation, storage, and fragmentation devices capable of separating ions according to their mass, charge and/or ion mobility.

According to a first aspect of the invention there is provided a method of selectively extracting ions comprising the steps of:

providing a supply of ions in a body of gas;

generating a ponderomotive ion trapping potential generally along an axis;

generating further potentials to provide an effective potential which prevents ions from being extracted from an extraction region;

trapping ions in said effective potential; and selectively extracting ions of a predetermined m/z ratio or ion mobility from the extraction region;

in which the characteristics of the effective potential which prevent ions from being extracted from the extraction region are caused, at least in part, by the generation of the ponderomotive ion trapping potential.

The method may comprise the steps of:

providing a supply of ions in a body of gas;

generating a ponderomotive ion trapping potential generally along an axis;

generating further potentials to provide an effective potential which (a) causes spatial separation of ions having different m/z ratios and/or ion mobilities, and/or (b) contains at least one potential barrier the magnitude of which is dependent on the m/z ratio of an ion in the supply of ions, in which (a) and/or (b) are caused by the generation of the ponderomotive ion trapping potential;

trapping ions in said effective potential; and selectively extracting ions of a predetermined m/z ratio or ion mobility.

According to a preferred aspect of the invention there is provided a method of selectively extracting ions comprising the steps of:

i) providing a supply of ions in a body of gas in an ion extraction volume, the ion extraction volume defining an ion extraction pathway;

ii) generating a pondermotive ion trapping potential generally along a single axis;

iii) generating an electrostatic ion trapping potential well generally along a single axis which is orthogonal to the single axis along which the pondermotive ion trapping potential is generated;

steps i), ii,) and iii) being performed so as to provide an effective potential which causes spatial separation of ions having differing mass to charge ratios and/or ions having different ion mobilities; thereby producing a plurality of spatially separate populations of ions having different mass to charge ratios and/or a plurality of spatially separate populations of ions of different ion mobilities; and selectively extracting a population of ions.

The present invention recognises that the effective potential well created by the juxtaposition of an RF potential and an electrostatic potential is dependent on the charge on an ion in the potential in a way that permits spatial separation of ions of different m/z ratio, eg, ions of similar mass but differing charge. The present invention exploits this phenomenon to provide selective extraction of ions. Additionally, the present invention recognises that the effective potential is dependent on ion mobility, and exploits this phenomenon to provide ion mobility dependent selective extraction of ions. The present invention is not dependent on the space charge effect to achieve spatial separation: in fact, space charge effects can be reduced through appropriate design of the ion trapping environment. The present invention provides a way of separating ions in a predictive manner, and enables efficient coupling to further stages such as mass spectrometer stages. Methods of ion separation, storage (trapping) and fragmentation are provided.

The ions may be entrained in a flow of gas. The ponderomotive ion trapping potential and the electrostatic ion trapping potential may be generated generally along single axes which are orthogonal to the direction of the flow of gas.

The electrostatic ion trapping potential well may be generated by applying potentials to at least one pair of electrodes, the at least one pair of electrodes being spaced apart across the body of gas.

The pondermotive ion trapping potential may be generated by an RF electrode set, such as a multipole or ring set. DC electrostatic potentials may be applied to the RF electrode set to assist in the generation of the electrostatic ion trapping potential well.

A population of ions may be extracted from a predetermined spatial location. Selective extraction of a population of ions may be achieved by causing a selected population of ions to move to the predetermined spatial location, and thereafter extracting said population of ions from said predetermined spatial location. A selected population of ions may be caused to move to the predetermined spatial location by varying the effective potential. The effective potential may be varied by varying the pondermotive ion trapping potential and/or the electrostatic ion trapping potential well.

Alternatively, the effective potential may be varied by varying the pressure of the body of gas.

A population of ions may be extracted from a predetermined spatial location by way of providing an ion barrier across the body of gas, the ion barrier having an aperture located therein, and extracting ions through the aperture. In this instance, selected populations of ions can be extracted by "tuning" the effective potential so that the spatial position occupied by a population of ions is adjusted to coincide with the predetermined spatial location from which ions can be extracted through the aperture.

A drift potential may be applied along the body of gas.

According to another preferred aspect of the invention there is provided a method of selectively extracting ions comprising the steps of:

i) providing a supply of ions in a body of gas in an ion extraction volume; the ion extraction volume defining an ion extraction pathway;

ii) providing an RF electrode set;

iii) applying an oscillatory RF potential to the RF electrode set to a) generate a ponderomotive ion trapping potential generally along at least one axis which is transverse to the ion extraction pathway; and b) generate an effective potential along the ion extraction pathway, the effective potential containing at least one potential barrier the magnitude of which is dependent on the m/z ratio of an ion in the supply of ions and substantially independent of the position of the ion along said transverse axis, the effective potential along the ion extraction pathway being generated, at least in part, by the oscillatory RF potential applied to the RF electrode set, the at least one potential barrier being caused by a periodicity in the oscillatory RF potential applied to the RF electrode set; and iv) varying the effective potential so as to allow ions of a predetermined m/z ratio or ion mobility to be selectively extracted.

In this way a flexible, sensitive and accurate way of trapping and extracting ions is provided. High duty cycles approaching or actually achieving 100% duty cycle across the entire mass range are possible. An additional advantage is that bunching of ions into intense packets is achieved, lessening noise in ADC systems.

Preferably, the RF electrode set comprises subsets of RF electrodes disposed along the ion extraction pathway, in which instance the at least one potential barrier is caused by a periodicity in the oscillatory RF potential applied to subsets of RF electrodes disposed along the ion extraction pathway.

The effective potential may comprise a drift potential applied along the ion extraction pathway, in which instance ions may be selectively extracted by varying the magnitude of the drift potential. Alternatively, or additionally, ions may be selectively extracted by varying the magnitude of the oscillatory RF potential.

The ions may be entrained in a flow of gas, in which instance the ponderomotive ion trapping potential may be generated generally along at least one axis which is orthogonal to the direction of the flow of gas.

The method may further comprise the step of generating an electrostatic ion trapping potential well generally along an axis which is orthogonal to an axis along which the ponderomotive ion trapping potential is generated, and orthogonal to the ion extraction pathway. The electrostatic ion trapping potential well may be generated by applying potentials to at least one pair of electrodes, the at least one pair of electrodes being spaced apart across the body of gas. In these embodiments, DC electrostatic potentials may be applied to the RF electrode set to assist in the generation of the electrostatic ion trapping potential well.

In alternative embodiments, the ponderomotive ion trapping potential is generated generally along two axes which are mutually orthogonal and orthogonal to the ion extraction pathway. In this instance an expanded RF electrode set is employed, preferably having additional subsets of RF electrodes disposed along the ion extraction pathway. Advantageously, the RF electrodes in the additional subsets are thinner than the RF electrodes in the other subsets of RF electrodes.

The effective potential may be varied by varying the pressure of the body of gas.

According to a second aspect of the invention there is provided a method of analysing ions or phenomena associated with ions comprising the steps of:

providing analysis means for analysing ions or phenomena associated with ions;

introducing ions into the analysis means by selectively extracting said ions using a method according to the first aspect of the invention; and analysing the extracted ions or phenomena associated with the extracted ions.

In preferred embodiments the analysis means comprises mass spectrometry means. Other forms of analysis means, such as a spectroscopic technique, may be employed instead. Phenomena associated with ions, such as ion-molecule, ion-radical or ion-ion reactions, might be analysed using techniques to analyse reaction products, measure reaction rates and study reaction dynamics.

The mass spectrometry means may comprise a time of flight (TOF) mass spectrometer. Improvements in duty cycle and signal to noise ratio are possible when the present invention is coupled to a TOF mass spectrometer.

Alternatively, the mass spectrometry means may comprise a multipole mass spectrometer, such as a quadrupole mass spectrometer. Other types of mass spectrometry means, such as a Fourier Transform mass spectrometer (FTMS), magnetic sector and ion-trap devices may be used. The method according to the first aspect of the invention may be used to separate ions of different ion mobilities, and the mass spectrometry means may operate as a mass filter for said ions, ie, may select ions of desired m/z ratio. In this way, selection of a desired charge state can be accomplished.

First and second analysis means for analysing ions or phenomena associated with ions may be provided, and ions emanating from the first analysis means may be introduced into the second analysis means by selective ion extraction using a method according to the first aspect of the invention. In advantageous embodiments the first and second analysis means comprise mass spectrometry means. For example, the first analysis means may comprise a multipole mass spectrometer, and the second analysis means may comprise a TOF mass spectrometer. The method according to the first aspect of the invention may selectively extract populations of ions of selected ion mobilities.

In the method:

first and second analysis means for analysing ions or phenomena associated with ions may be provided, and ions may be introduced into the first analysis means by selective ion extraction using a first method according to the first aspect of the invention and ions may be introduced into the second analysis means by selective ion extraction using a second method according to the first aspect of the invention. The first and second methods may be used to selectively extract populations of ions having desired ion mobilities. In a preferred embodiment the first and second analysis means are mass spectrometry means. The second analysis means may be a TOF mass spectrometer. The first analysis means may be a multipole mass spectrometer.

The analysis means may operate by way of pulsed acquisition of ions and the timing of the selective extraction of ions may be synchronised with the pulsed acquisition of ions by the analysis means so as to improve the efficiency with which extracted ions are analysed.

The analysis means may comprise a detector and data acquisition means to acquire data relating to events detected by the detector. The data acquisition means may acquire data over a selected time period which is correlated with the period of time during which events which are associated with the selectively extracted ions are detected by the detector. In this way improved signal to noise ratios may be obtained, since the data acquisition means only acquires data when "true" signal is arriving at the detector, and does not acquire data in time periods where the detector is not detecting events associated with the selectively extracted ions.

The data acquisition means may comprise analogue to digital converter acquisition means.

The analysis means may comprise mass spectrometry means, preferably a TOF mass spectrometer, most preferably an oa-TOF mass spectrometer.

An ion trap may be utilised to control the supply of ions for use in the method of the first aspect of the invention.

According to a third aspect of the invention there is provided an ion extraction device comprising:

a gas cell in which a supply of ions in a body of gas can be located;

means for generating a ponderomotive ion trapping potential generally along an axis;

means for generating further potentials to provide an effective potential which prevents ions from being extracted from an extraction region; the device being configured so that the characteristics of the effective potential which prevent ions from being extracted from the extraction region are caused, at least in part, by the generation of the ponderomotive ion trapping potential; and ion extraction means for selectively extracting ions of a predetermined m/z ratio or ion mobility from the extraction region.

According to a preferred aspect of the invention there is provided an ion extraction device comprising:

a gas cell in which a supply of ions in a body of gas can be located, the gas cell having an ion extraction volume defining an ion extraction pathway;

means for generating a ponderomotive ion trapping potential, the potential being generated across the gas cell;

means for generating an electrostatic ion trapping potential well, the potential well being generated across the gas cell generally along a single axis which is orthogonal to the single axis along which the pondermotive potential is generated; and ion extraction means for spatially selective extraction of populations of ions located at a predetermined spatial location.

The ion extraction device may be an ion separation, ion storage or ion fragmentation device.

At least a portion of the gas cell may comprise a gas flow conduit through which ions entrained in a flow of gas can be transported, the conduit having a direction of gas flow. The device may further comprise gas flow means for providing said flow of gas. The means for generating a ponderomotive ion trapping potential may generate said potential across the direction of flow, and the means for generating an electrostatic ion trapping potential well may generate said potential well across the direction of flow.

The means for generating a ponderomotive ion trapping potential may comprise an RF electrode set. The RF electrode set may comprise at least one pair of RF electrode stacks, the stacks in each pair of RF electrode stacks being spaced apart across the gas cell. In some embodiments having a single pair of RF electrode stacks, RF electrodes in the RF electrode stacks extend along substantially the entire length of the gas cell. In other embodiments having a single pair of RF electrode stacks, the RF electrodes in each stack are stacked along the length of the gas cell.

Alternatively, the RF electrode set may comprise a series of pairs of RF electrode stacks spaced apart across the gas cell. The electrodes in each stack may be stacked in a direction orthogonal to a longitudinal axis of the gas cell.

The means for generating an electrostatic ion trapping potential well may comprise at least one pair of electrodes, the electrodes in the at least one pair of electrodes being spaced apart across the gas cell. The means for generating an electrostatic ion trapping potential well may comprise a series of pairs of electrodes disposed along the gas cell. Alternatively, the means for generating an electrostatic ion trapping potential well may comprise a single pair of electrodes spaced apart across the gas cell. The single pair of electrodes may be inclined with respect to the direction of flow. Potentials may be applied to the series of pairs of electrodes so as to apply a drift field along at least a portion of the gas cell.

In another embodiment, the means for generating a ponderomotive ion trapping potential comprises an RF electrode set, the means for generating an electrostatic ion trapping potential well comprises a series of pairs of electrodes disposed along the gas cell, and the device comprises a plurality of segmented RF electrode/electrode units, in which each unit comprises a coplanar arrangement of two opposed RF electrodes and two opposed electrodes.

DC electrostatic potentials may be applied to the means for generating a pondermotive ion trapping potential so as to assist in the generation of the electrostatic ion trapping potential well.

The ion extraction means may comprise an ion barrier disposed across the gas flow conduit having an aperture formed therein. The ion barrier prevents ions from crossing the barrier and hence leaving the ion extraction device. The ion barrier may be a physical barrier, such as an end cap, and/or may comprise means for applying an ion retarding electric field. The ion extraction device may further comprise means for applying an extraction field to extract ions through the aperture.

The ion extraction means may comprise an inwardly extending tube formed of a leaky dielectric material which is in communication with the aperture.

At least one of the means for generating a pondermotive ion trapping potential, the means for generating an electrostatic ion trapping potential well, and the pressure of the body of gas may be variable so as to cause a selected population of ions to move to a predetermined spatial location.

The ion extraction device may be used as a gas collision cell.

According to another preferred aspect of the invention there is provided an ion extraction device comprising:

a gas cell in which a supply of ions in a body of gas can be located, the gas cell having an ion extraction volume defining an ion extraction pathway;

ion guidance means comprising an RF electrode set;

means for applying an oscillatory RF potential to the RF electrode set so as to a) generate a ponderomotive ion trapping potential generally along at least one axis which is transverse to the ion extraction pathway, and b) generate, at least in part, an effective potential along the ion extraction pathway, the effective potential containing at least one potential barrier the magnitude of which is dependent on the m/z ratio of an ion in the supply of ions and substantially independent of the position of the ion along said transverse axis; in which the at least one potential barrier is caused by a periodicity in the oscillatory RF potential applied to the RF electrode set; and means for varying the effective potential so as to allow ions of a predetermined m/z ratio or ion mobility to be selectively extracted from the device.

Preferably, the RF electrode set comprises subsets of RF electrodes disposed along the ion extraction pathway, in which the at least one potential barrier is caused by a periodicity in the oscillatory RF potential applied to subsets of RF electrodes disposed along the ion extraction pathway.

The ion guiding means may further comprise means for applying a drift potential along the ion extraction pathway. The means for varying the effective potential may vary the magnitude of the drift potential applied by the means for applying a drift potential so as to selectively extract ions. Alternatively, or additionally, the means for varying the effective potential may vary the oscillatory RF potential so as to selectively extract ions.

At least one portion of the gas cell may comprise a gas flow conduit through which ions entrained in a flow of gas can be transported, the conduit having a direction of gas flow. The device may further comprise gas flow means for providing said flow of gas. The RF electrode set may generate the ponderomotive ion trapping potential across the direction of flow.

Preferably, the ion guiding means further comprises means for generating an electrostatic ion trapping potential well generally along an axis which is orthogonal to an axis along which the ponderomotive ion trapping potential is generated and orthogonal to the ion extraction pathway. The means for generating an electrostatic ion trapping potential well may comprise at least one pair of electrodes, the electrodes in the at least one pair of electrodes being spaced apart across the gas cell. The means for generating an electrostatic ion trapping potential well may comprise a series of pairs of electrodes disposed along the gas cell. Potentials may be applied to the series of pairs of electrodes so as to apply a drift field along the ion extraction pathway.

DC electrostatic potentials may be applied to the RF electrode set so as to assist in the generation of the electrostatic ion trapping potential well.

Advantageously, the ion extraction volume is a cuboid having a width, height and length. It is understood that a cuboid is of rectangular cross section, ie, the width is different from the height. The ponderomotive ion trapping potential should be generated generally along an axis corresponding to the width of the cuboid. Preferably, the ratio of the width to the height of the cuboid is at least 1:1.5, preferably greater than 1:1.7.

The device may comprise an entrance end plate at one end of the device having at least one ion inlet. The device may comprise an exit end plate at one end of the device having at least one ion exit. A drift potential may be applied along the ion extraction pathway by way of applying voltages to the end plates.

Devices of the invention may be cascaded together to produce arrays of devices in x, y or z directions, or in combinations of directions. Ions can be transferred between adjacent devices by using electrodes with slots, holes, meshes or other apertures. Preferably, these electrodes are common to the adjacent devices.

The RF electrode set may comprise at least one pair of RF electrode stacks; wherein the stacks in each pair of RF electrode stacks are spaced apart across the gas cell and the RF electrodes in each stack are stacked along the ion extraction pathway.

The means for applying an oscillatory RF potential may apply oscillatory RF potential of a common phase to a plurality of adjacent RF electrodes in a subset of RF electrodes, so that the periodicity in the oscillatory RF potential is established between groups of RF electrodes in the subsets. In this instance, it may be desirable to also apply an ion trapping oscillatory RF potential to RF electrodes in each pair of RF electrode stacks, wherein the phases of the ion trapping oscillatory RF potential applied to adjacent RF electrodes are opposed. This ion trapping oscillatory RF potential acts to confine high mass ions, which otherwise might have a tendency to strike the electrodes of the devices, by providing a strong potential barrier towards the sides of the device whilst not significantly affecting the effective potential along the main device axis. Preferably, the ion trapping oscillatory RF potential is applied 90° out of phase with the oscillatory RF potential applied to each subset of RF electrodes; this improves ion trapping, and reduces the peak voltages imposed on the RF electrodes.

Ion travelling wave devices, such as devices described in U.S. Pat. No. 5,206,506 and U.S. Pat. No. 6,903,331 (the contents of both of which are herein incorporated by reference), may be adapted to produce devices in accordance with the invention. The adaptation can comprise the provision of means for applying a travelling axial field having a periodicity that when averaged over time overcomes the barrier in the same way as a DC axial field when generated by a potential divider between adjacent electrodes.

Ion extraction devices of the invention may further comprise ion supply means for generating a supply of ions to the gas cell. Ions may be created using a suitable ionisation technique such as electrospray ionisation, MALDI (Matrix Assisted Laser Desorption Ionisation), electron impact, chemical ionisation, fast atom bombardment, field ionisation, field desorption and soft ionisation techniques employing vacuum ultraviolet or soft x-ray radiation produced by a convenient light source such as a laser. Generally, the ions are generated externally of the gas cell, but in principle might be generated inside the gas cell.

According to a fourth aspect of the invention there is provided an analytical device comprising:

at least one ion extraction device according to the third aspect of the invention; and at least one analysis means for analysing ions or phenomena associated with ions;

in which the analysis means is coupled to the ion extraction device so that ions extracted from the ion extraction device are introduced to the analysis means.

The analysis means may comprise mass spectrometry means. The mass spectrometry means may comprise a time of flight (TOF) mass spectrometer or a multipole mass spectrometer or other types of mass spectrometry means, such as described above.

The analytical device may comprise at least two analysis means. For example, an ion extraction device may be disposed between two analysis means. Advantageous embodiments employ an ion extraction device disposed between two mass spectrometry means.

The analytical device may comprise at least two ion extraction devices according to the third aspect of the invention.

The analytical device may comprise:

a first ion extraction device according to the third aspect of the invention;

a first analysis means for analysing ions or phenomena associated with ions, the first analysis means being coupled to the first ion extraction device so that ions extracted from the ion extraction device are introduced to the analysis means;

a second ion extraction device according to the third aspect of the invention into which ions emanating from the first analysis means are introduced;

a second analysis means for analysing ions or phenomena associated with ions, the second means being coupled to the second ion extraction device so that ions extracted from the second ion extraction device are introduced to the second analysis means.

Preferably, the first and second analysis means are mass spectrometry means, but the invention is not limited in this regard.

The first and second ion extraction devices may be adapted to selectively extract populations of ions of selected ion mobilities.

Devices in accordance with the fourth aspect of the invention are advantageous in complex analyses such as proteomics and/or applications which give rise to cluster ions which have the same mass to charge ratio but which have different masses and charges. Separation of such clusters can be achieved using the present invention.

According to a fifth aspect of the invention there is provided a tandem ion separation device comprising a first ion extraction device according to the third aspect of the invention coupled to an ion separation stage. The ion separation stage may be a second ion extraction device according to the third aspect of the invention. In this instance, the upstream ion extraction device may operate as an ion mobility separator, and the downstream ion extraction device may separate ions according to their m/z ratio. The upstream ion extractor device can then operate at relatively high pressures. Alternatively, the ion separation stage may comprise mass spectrometry means. The mass spectrometry means may comprise a multipole mass spectrometer. In this instance, the mass spectrometry means may operate as a mass filter, and the first ion extraction device may operate as an ion mobility separator. The ion separation stage may supply ions to the first ion extraction device.

According to a sixth aspect of the invention there is provided a mass spectrometer device including:

a mass selective or ion mobility selective ion trap;

a mass scanning mass spectrometer located downstream of the ion trap so that ions ejected from the ions ejected from the ion trap are directed into the mass scanning mass spectrometer; and control means for: i) sequentially and selectively ejecting ions from the ion trap according to the mass to charge ratio or the ion mobility of the ions; ii) scanning the mass of the ions transmitted by the mass scanning mass spectrometer; and iii) synchronising i) and ii) so that the mass of at least some of the ions directed into the mass scanning mass spectrometer corresponds to the mass of the ions transmitted by the mass scanning mass spectrometer thereby enhancing the sensitivity of the mass scanning mass spectrometer.

In this way, enhancements in duty cycle can be obtained. The duty cycle may be enhanced compared to a system utilising an identical mass scanning mass spectrometer without a mass selective or ion mobility selective ion trap.

For the avoidance of doubt, the term "mass scanning mass spectrometer" refers to mass spectrometers of the type that are configured to only allow ions of a selected mass to pass therethrough, for example to an ion detector, the characteristics of the mass spectrometer being varied during use so that the mass of the ions that are permitted to pass through the mass spectrometer is varied, thereby allowing the ions detected by the ion detector to be mass scanned. Mass spectrometers of this type are contrasted with, for example, time of flight mass spectrometers in which ions having a substantial range of masses are permitted to reach an ion detector, mass separation being achieved by considering the length of time taken for the ions to reach the detector.

Preferably, the mass scanning mass spectrometer is a multipole device. It is highly preferred that the multipole device is quadrupole mass spectrometer.

A preferred form of ion trap is an ion extraction device as disclosed herein, and can include:

a gas cell in which a supply of ions in a body of gas can be located;

means for generating a pondermotive ion trapping potential generally along an axis;

means for generating further potentials to provide an effective potential which prevents ions from being extracted from an extraction region; the device being configured so that characteristics of the effective potential which prevents ions from being extracted from the extraction region are caused, at least in part, by the generation of pondermotive ion trapping potential; and ion extraction means for selectively extracting ions of a predetermined m/z ratio or ion mobility from the extraction region.

The ion traps exemplified herein (also referred to herein as ion extraction devices) can operate as a mass selective device or as ion mobility selective device. It is preferred that, in the context of the sixth aspect of the present invention, these ion traps are used as mass selective ion traps, although the ion trap may be used as ion mobility selective device. It is an advantage of the ion traps exemplified herein (also referred to as ion extraction devices) that they can selectively emit ions on a timescale commensurate with the timescale on which quadrupole mass spectrometers perform a scan over their mass range, typically of the order of hundreds of milliseconds. In general, it is desirable that the scanning speeds of the ion trap and the mass scanning mass spectrometer are matched. In practice, this usually means that it is desirable to employ an ion trap having a scanning speed slow enough to match the scanning speed of the mass scanning mass spectrometer.

Another preferred embodiment of an ion trap is disclosed in the Applicant's International publication WO 2004/109741, the entire contents of which are herein incorporated by reference. In these embodiments the ion trap may be a device in which ions are entrained in a laminar flow of a carrier gas and are trapped in a barrier region in which an electrical field is applied across the laminar flow. Ion traps of the type disclosed in WO 2004/109741 (which are referred to therein as ion extraction devices) are preferred examples of ion mobility selective ion traps. It is an advantage of the ion traps disclosed in WO 2004/109741 that they can selectively emit ions on a timescale commensurate with the timescale on which quadrupole mass spectrometers perform a scan over their mass range, typically of the order of hundreds of milliseconds.

Other examples of ion traps include Paul traps, a 3-D quadrupole field ion trap, a magnetic ("Penning") ion trap or a linear quadrupole ion trap.

The present invention provides enhanced sensitivity by interfacing a mass selective or ion mobility selective ion trap to a mass scanning mass spectrometer. The ion trap enhances the sensitivity of the mass scanning mass spectrometer by storing ions and supplying ions to the mass scanning mass spectrometer in accordance with the mass being transmitted and detected by the mass selective mass spectrometer at any given time in its mass scanning cycle. Ideally, for maximum sensitivity, ions are only ejected from the ion trap so as to arrive at the mass scanning mass spectrometer when those ions are being scanned by the mass selective mass spectrometer, and not at other times. However, in such an embodiment, the resolution of the ion trap would be equal to or better than the resolution of the mass selective mass spectrometer, in which instance the mass selective mass spectrometer would be superfluous. Generally in the present invention, the resolution of the ion trap is inferior to the resolution of the mass selective mass spectrometer, i.e. the mass selective mass spectrometer has greater finesse. Preferably the mass resolution of the mass scanning mass spectrometer is greater than the mass resolution of the ions ejected from the ion trap by a multiplicative factor in the range 2 to 250, which may be in the range 5 to 15, preferably about 10. Mass resolution is defined as $M/\Delta M$, where M is the mass of an ion and $\Delta M$ is the minimum number of mass units that an ion can differ from mass M and still be resolved from ions of mass M. It should be noted that the mass resolution $M/\Delta M$ for a quadrupole mass spectrometer generally varies as a function of M. Also, it is possible for the mass resolution of the ion trap to vary as a function of M. Therefore, the multiplicative factor may vary as a function of M. The ranges of the multiplicative factor discussed above may be referenced to an ion of mass 100 amu. Advantageously, an ion accumulation trap is provided upstream of the mass selective or ion mobility selective ion trap.

According to a seventh aspect of the invention there is provided a dual mass spectrometer device including two mass spectrometer devices of the sixth aspect of the invention. In such embodiments it is preferred that the mass scanning mass spectrometer in both mass spectrometer devices of the sixth aspect of the invention are quadrupole mass spectrometers. It is also preferred that the ion traps in both mass spectrometer devices of the sixth aspect of the invention are ion traps of the type exemplified herein. The device may further include a collision cell. A so-called triple quadrupole device may be produced in this way.

According to an eighth aspect of the invention there is provided a method of performing mass spectrometry including:

sequentially and selectively ejecting ions from a mass selective or ion mobility selective ion trap according to the mass to charge ratio or the ion mobility of the ions;

directing the ejected ions to a mass scanning mass spectrometer; and scanning the mass of the ions transmitted by the mass scanning mass spectrometer;

in which the ejection of the ions from the ion trap and the scanning of the mass scanning mass spectrometer are synchronised so that the mass of at least some of the ions directed into the mass scanning mass spectrometer thereby enhancing the sensitivity of the mass scanning mass spectrometer.

Embodiments of devices and methods in accordance with the invention will now b e described with reference to the accompanying drawings, in which:

DESCRIPTION OF THE PREFERRED EMBODIMENTS

The general form of the effective potential (both from rf and electrostatic source) is derived using the adiabatic approximation [Gerlich, ibid] and is given by $$Veff(Ro) := \frac{q^2 \cdot Eo^2}{4 \cdot M \cdot \Omega^2} + q \cdot \Phi \qquad \text{[equation 1]}$$

where $R_0$ is the slowly varying position of an ion, q is its charge, $E_0$ is the magnitude of the oscillatory electric field of angular frequency Ω at position $R_0$ and M is its mass. The equation also includes the classical electrostatic potential qøs where øs is a voltage created by DC potentials applied to electrodes in any general system. It can be seen that the potential due to the oscillatory field is proportional to charge squared while the electrostatic potential is proportional to charge. The present invention exploits this relationship to separate ions of similar mass but differing charge.

Figure 1:
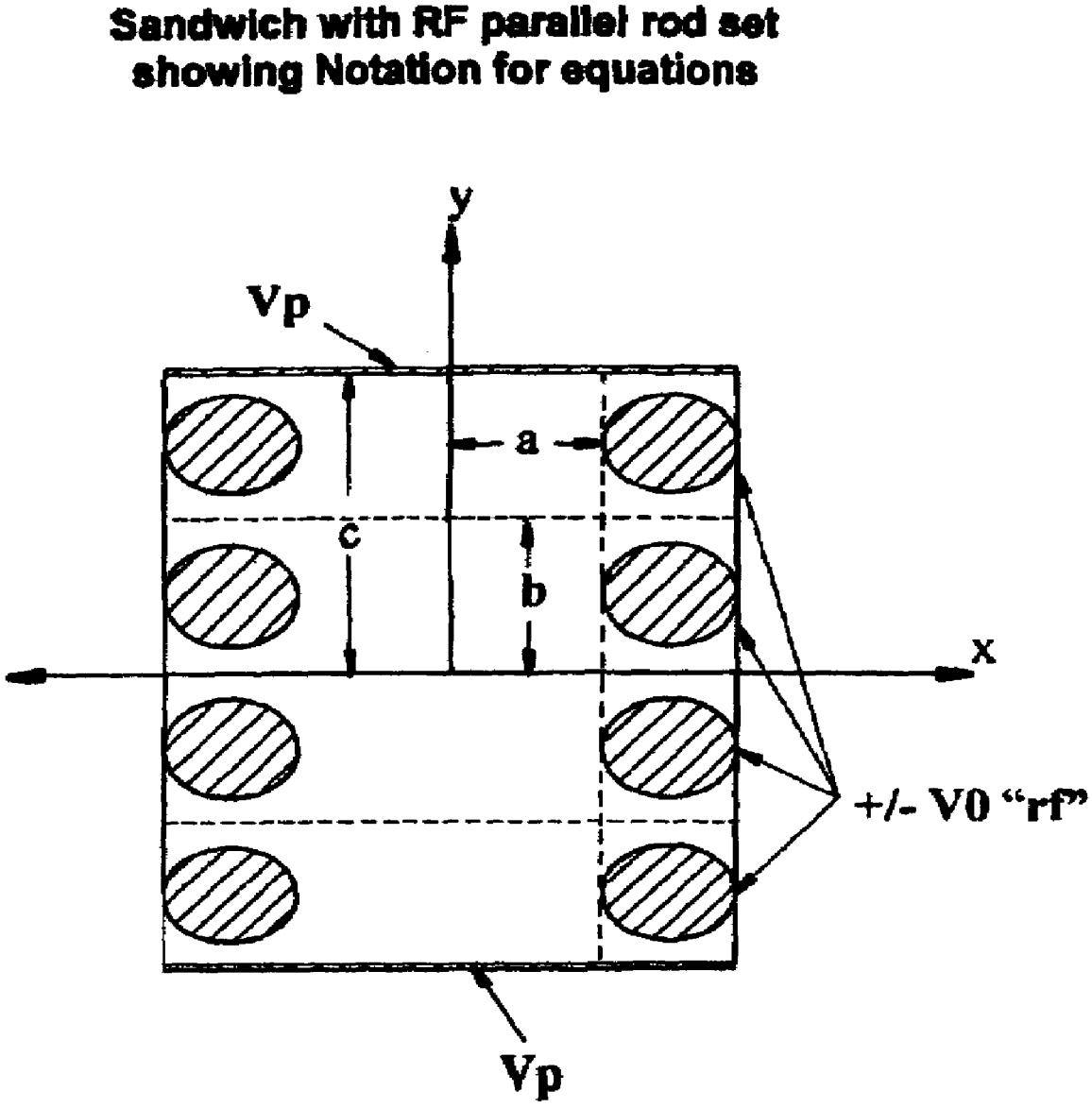
FIG. 1 shows a cross-sectional view of a DC electrode/RF parallel rod set arrangement.

The form of the effective potential from an oscillatory field in quadrupoles, hexapoles, octopoles etc has been calculated by Gerlich and is of the form:

$$V(r) := \frac{n^2 \cdot q^2 \cdot Vo^2}{4 \cdot M \cdot (Ro \cdot \Omega)^2} \cdot r^{(2 \cdot n - 2)} \qquad \text{[Equation 2]}$$

for a ring set we have:

$$V(r, z) := \frac{q^2 \cdot Vo^2}{4 \cdot M \cdot (Zo \cdot \Omega)^2} \cdot \left[ \frac{I1^2 \cdot (r) \cdot \cos^2 \cdot (z) + I0^2(r) \cdot \sin^2(z)}{I0^2(Ro)} \right] \qquad \text{[Equation 3]}$$

these ion guides are all to some degree cylindrically symmetric and all exhibit a radial dependence on effective potential with steeper sided potential wells for higher order multipoles and ring sets. Gerlich also describes a stacked rf plate ion guide with DC top and bottom plates which is employed as a storage ion source. The use of such a source as a mass discriminating device operating in the space charge limit is described by applying a weak dc difference but no analytical treatment of this geometry is presented. In a particular embodiment of the current invention a linear stacked rf plate device is used to select desired combinations of mass and charge state, the use of a long linear geometry allows for operation not compromised (or affected) by space charge due to its large charge capacity. In order to explain the operation of the present invention it is necessary to obtain an analytical solution to the form of the effective potential at any point in the guide i.e. a solution to Equation (1) for the general geometry chosen. Such a solution can be obtained by solving for the rf and electrostatic elements separately and then adding the two solutions, a process known as superposition. A general two dimensional solution has been found for the guide whose form and notation is set out in FIG. 1 and which comprises: an rf parallel rod set (shown generally at 10) which consists of a plurality of RF rods 12 and a pair of DC electrodes 14. The solution is given by:

$$Veff(x, y) := \frac{z^2 \cdot e \cdot \pi^2 \cdot Vo^2 \cdot \left[ \left(\sinh\left(\pi \cdot \frac{x}{b}\right) \cdot \sin\left(\pi \cdot \frac{y}{b}\right)\right)^2 + \left(\cosh\left(\pi \cdot \frac{x}{b}\right) \cdot \cos\left(\pi \cdot \frac{y}{b}\right)\right)^2 \right]}{\left(\cosh\left(\pi \cdot \frac{a}{b}\right)\right)^2 \cdot (4 \cdot M \cdot Km\omega^2 \cdot b^2)} + \left( \sum_N \frac{4 \cdot z \cdot Vp \cosh\left(N \cdot \pi \cdot \frac{y}{2a}\right) \cdot \cos\left(N \cdot \pi \cdot \frac{x}{2a}\right)}{N \cdot \pi \cdot \cosh\left(N \cdot \pi \cdot \frac{c}{2a}\right)} \right)$$

The guide gives electrostatic trapping in the Y direction and ponderomotive effective potential trapping in the X direction. Due to the nature of Laplace's equation the electrostatic potential well which traps in Y is a saddle point causing ions to move away from the centre of the device in the X direction. The ponderomotive effective potential well must be great enough to overcome this negative dispersion if complete X-Y trapping is to be achieved.

Figure 2A:
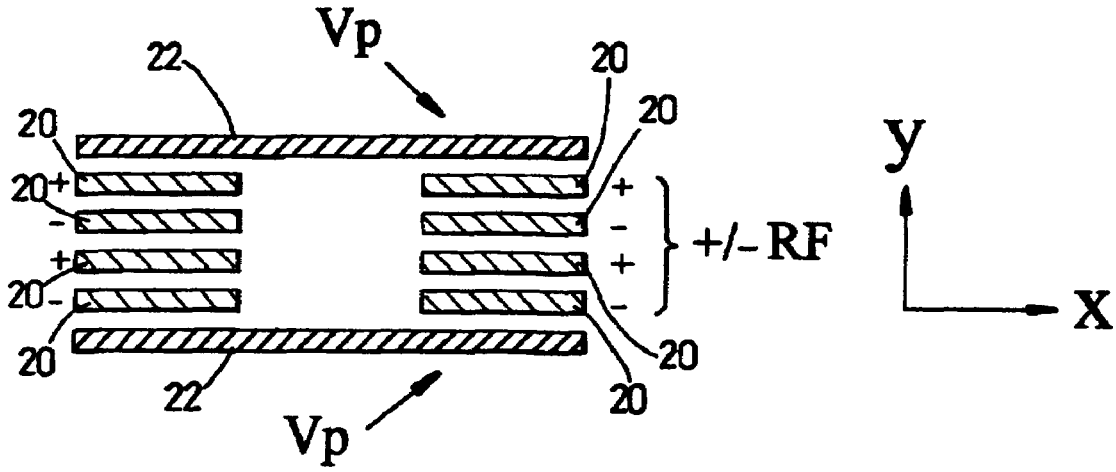
FIG. 2 shows (a) a cross-sectional view in the xy plane of a first embodiment of an ion extraction device and (b) is an end view of an end plate.
Figure 2B:
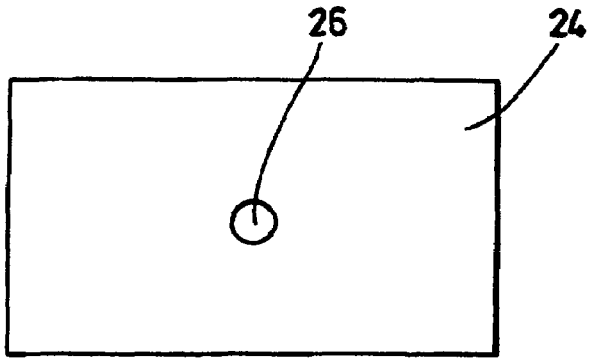
Figure 3:
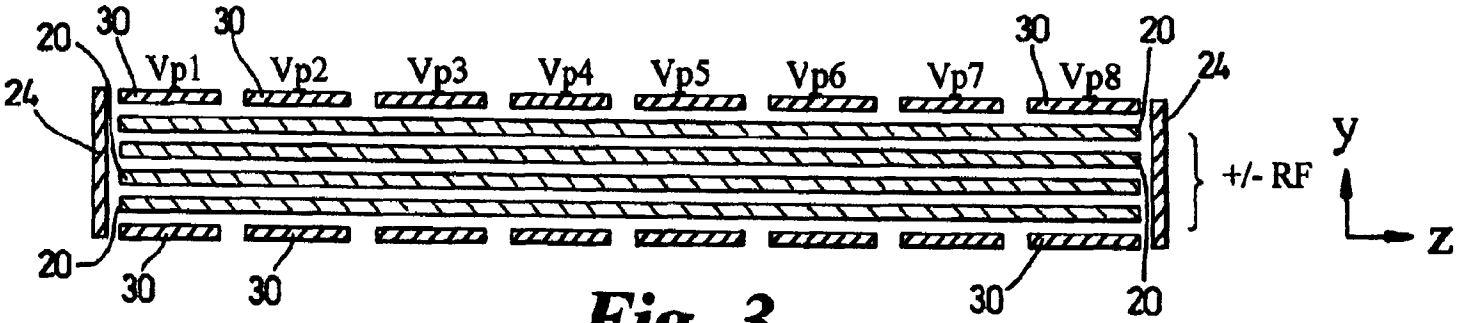
FIG. 3 is a side view of a second embodiment of an ion extraction device.
Figure 4:
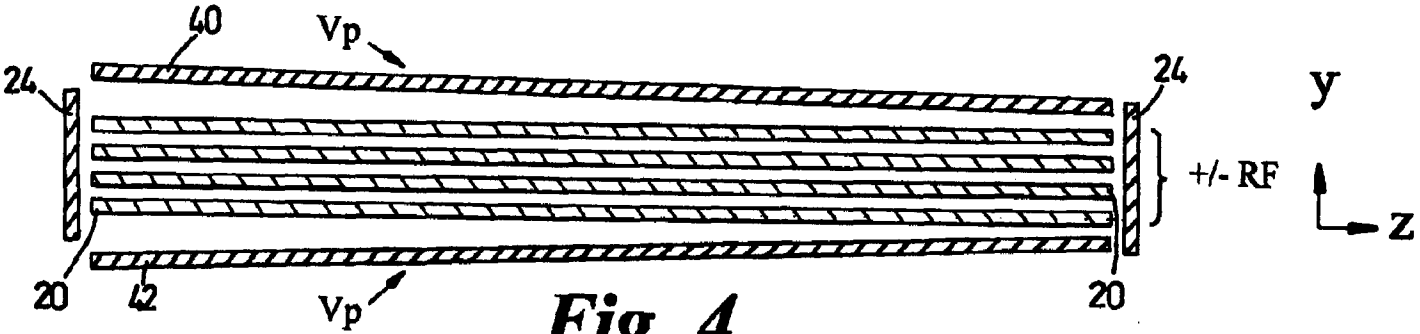
FIG. 4 is a side view of a third embodiment of an ion extraction device.
Figure 5:
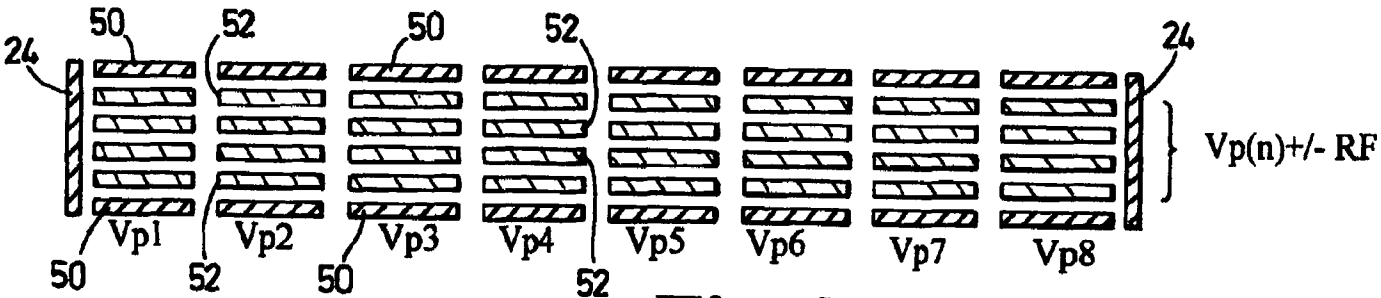
FIG. 5 is a side view of a fourth embodiment of an ion extraction device.
Figure 6:
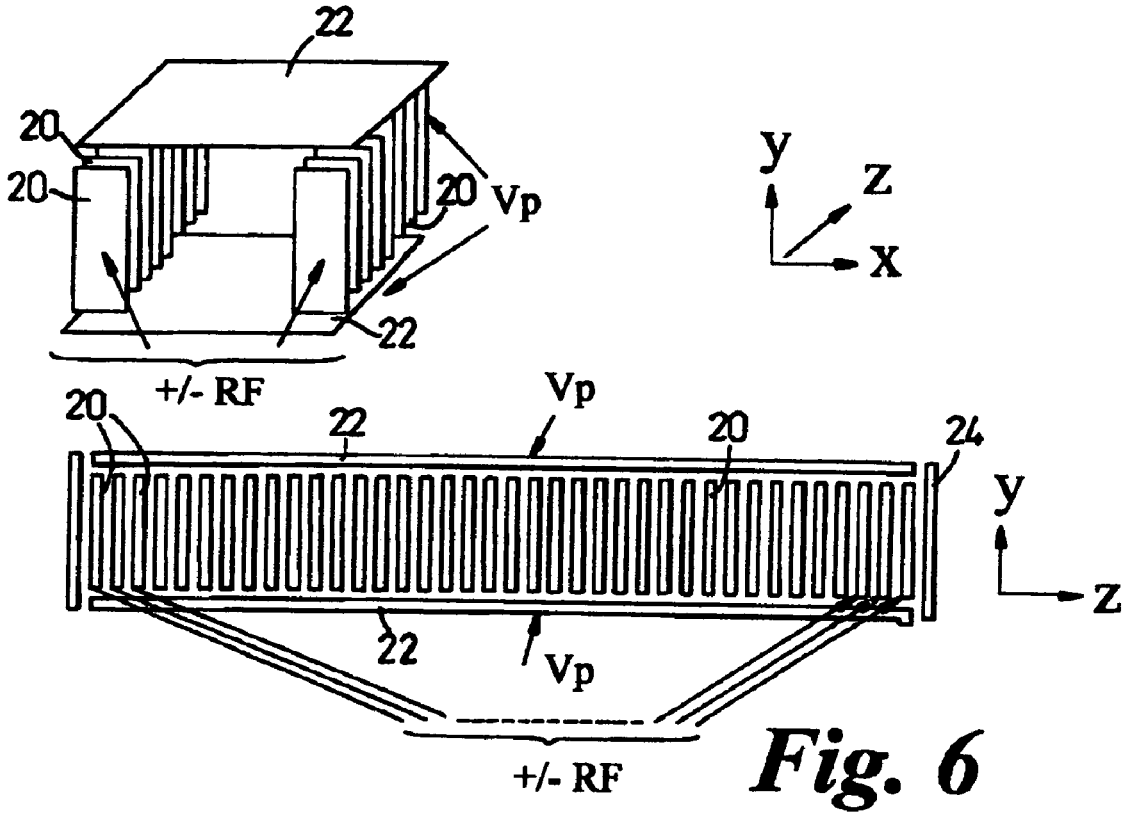
FIG. 6 shows (a) a perspective view and (b) a side view of a fifth embodiment of an ion extraction device.
Figure 7:
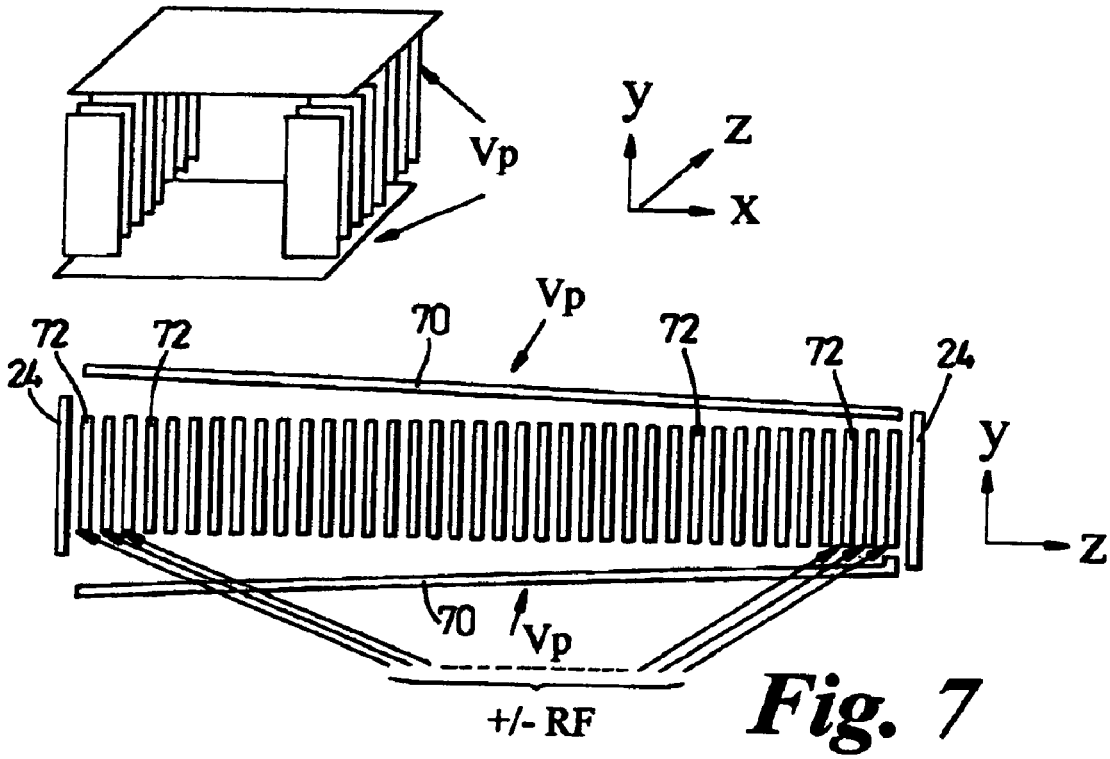
FIG. 7 shows (a) a perspective view and (b) a side view of a sixth embodiment of an ion extraction device.
Figure 8:
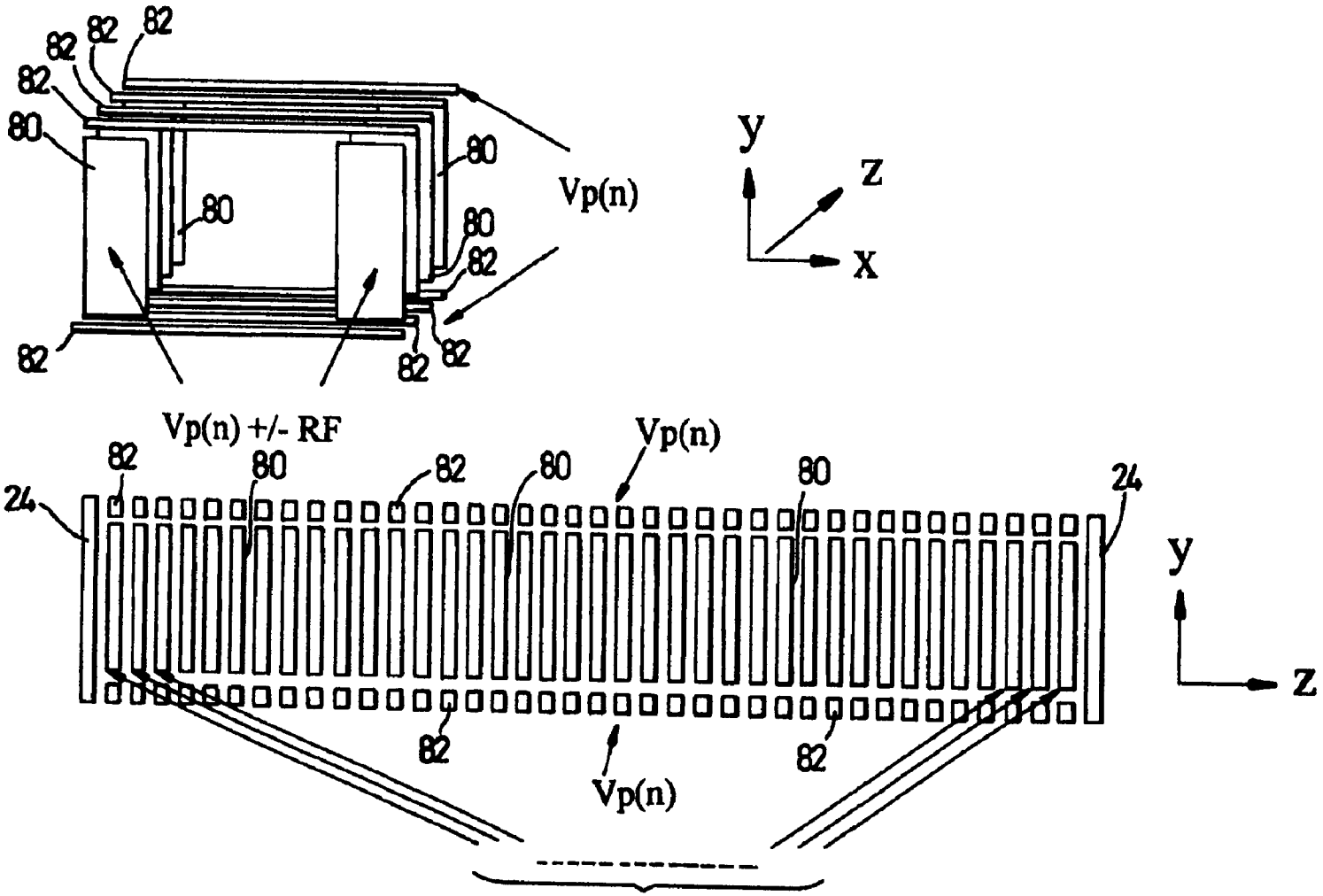
FIG. 8 shows (a) a perspective view and (b) a side view of a seventh embodiment of an ion extraction device.

FIGS. 2 to 8 illustrate embodiments of the present invention, solutions of which are satisfied by the two dimensional solution shown above within the body of the device. Different means are employed to give additional axial fields of varying complexities ranging from simple linear driving fields to polynomials applied to electrode sets for trapping and extraction purposes. Various features are shared between the embodiments depicted in FIGS. 2 to 8, and like numerals are used to depict such common features. FIG. 2(*a*) shows an X-Y slice through the centre of a first embodiment showing DC only trapping electrodes 20 at voltage Vp and RF electrodes 22. Note the how opposite plate pairs are connected to the same phase of the RF, whereas opposite phases are connected to adjacent plate pairs; this is true for all embodiments shown but for purposes of simplification is omitted on subsequent diagrams. FIG. 2(*b*) also shows a typical end plate 24 of the device which has a hole 26 in the centre through which ions of desired characteristic are ejected. The end plate 24 can be used also as an entrance plate for an ion extraction device. FIG. 3 shows how segmented DC electrodes 30 provide an axial field of desired form by applying different voltages Vp1-Vp8 to each electrode. FIG. 4 shows how a simple axial field can be created by inclining top 40 and bottom 42 plates which act as DC electrodes. FIG. 5 shows a fourth embodiment comprising segmented RF plates 50 and segmented DC plates 52, which permits greater flexibility to be had in creating trapping wells for purposes of upstream storage as explained below. FIGS. 6(*a*) and 6(*b*) show a fifth embodiment of the device which is analogous to that shown in FIG. 2(*a*) except that the RF plates 22 have been stacked in the Z direction rather than the Y direction. FIGS. 7(*a*) and 7(*b*) show a sixth embodiment having inclined DC plates 70 (analogous to the third embodiment) and RF plates 72 stacked in the Z direction (analogous to the fifth embodiment). FIGS. 8(*a*) and 8(*b*) show a seventh embodiment comprising segmented RF plates 80 stacked in the Z direction and segmented DC plates 82 also in the Z direction. The seventh embodiment is arranged so as to comprise a plurality of segmented RF/DC electrode units 84, wherein each RF/DC electrode unit 84 comprises a coplanar arrangement of two opposed RF electrodes 86 and two opposed RF electrodes 88. In this way a DC polynomial can be added to both DC only and the RF plates to create any desired function in a manner similar to that described by U.S. Pat. No. 5,206,506.

Typical, but non-limiting, dimensions of the ion extraction device are length 50 to 250 mm, width 5 to 50 mm and extraction aperture diameter 0.5 to 4 mm, preferably about 2 mm.

Figure 10:
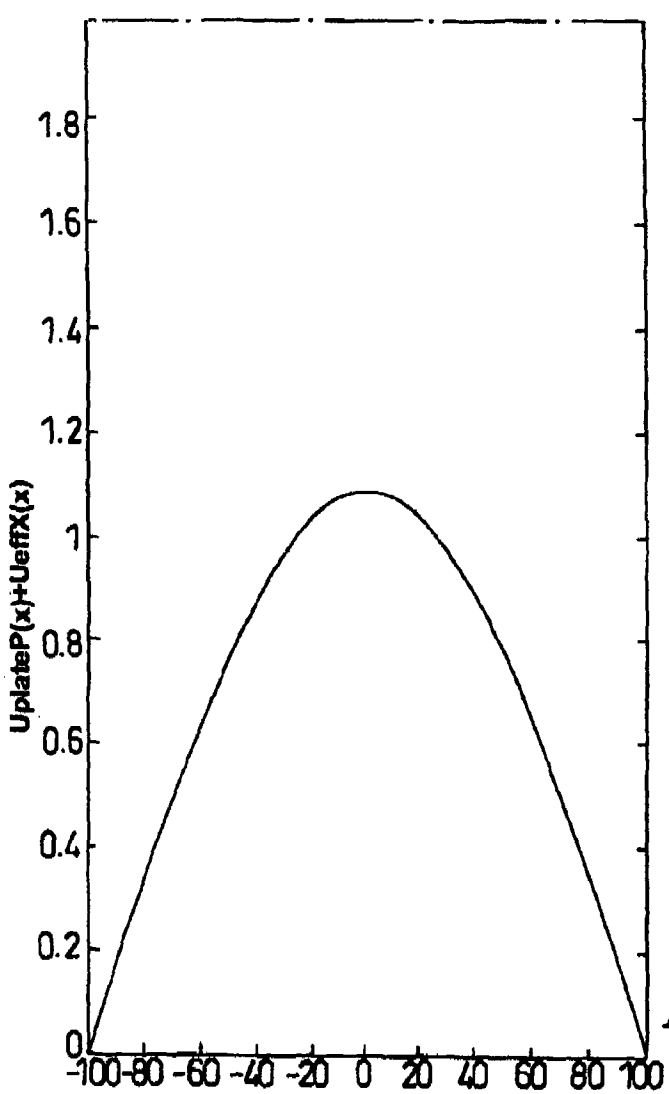
FIG. 10 shows a typical negative dispersion plot along the x axis provided using a device of the type shown in FIG. 2.
Figure 9:
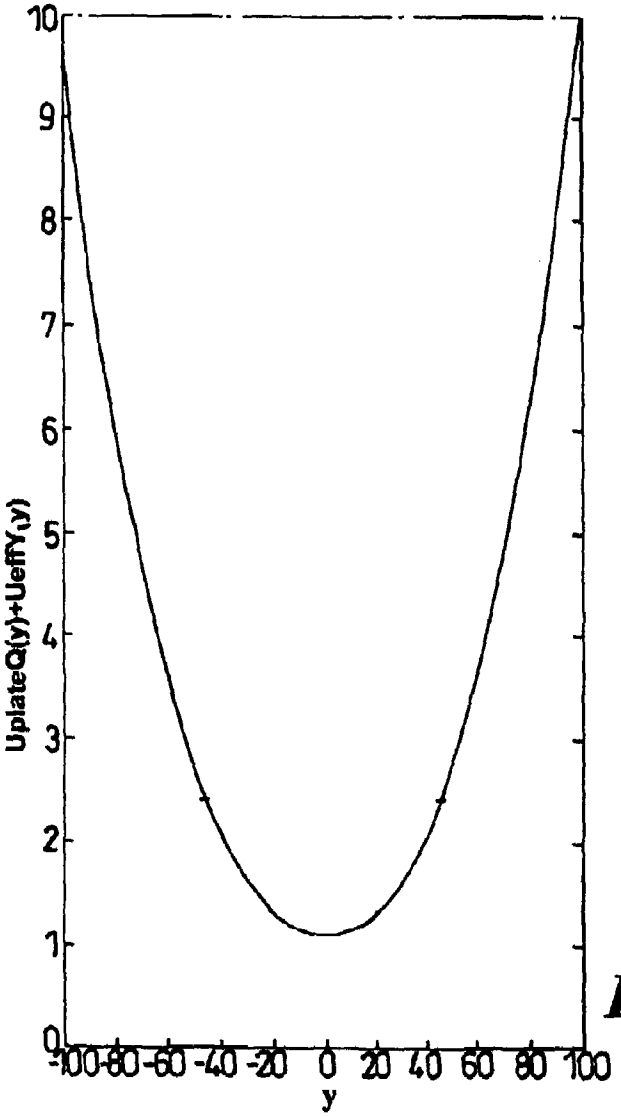
FIG. 9 shows a typical electrostatic potential well along the y axis produced using an ion extraction device of the type shown in FIG. 2.
Figure 11:
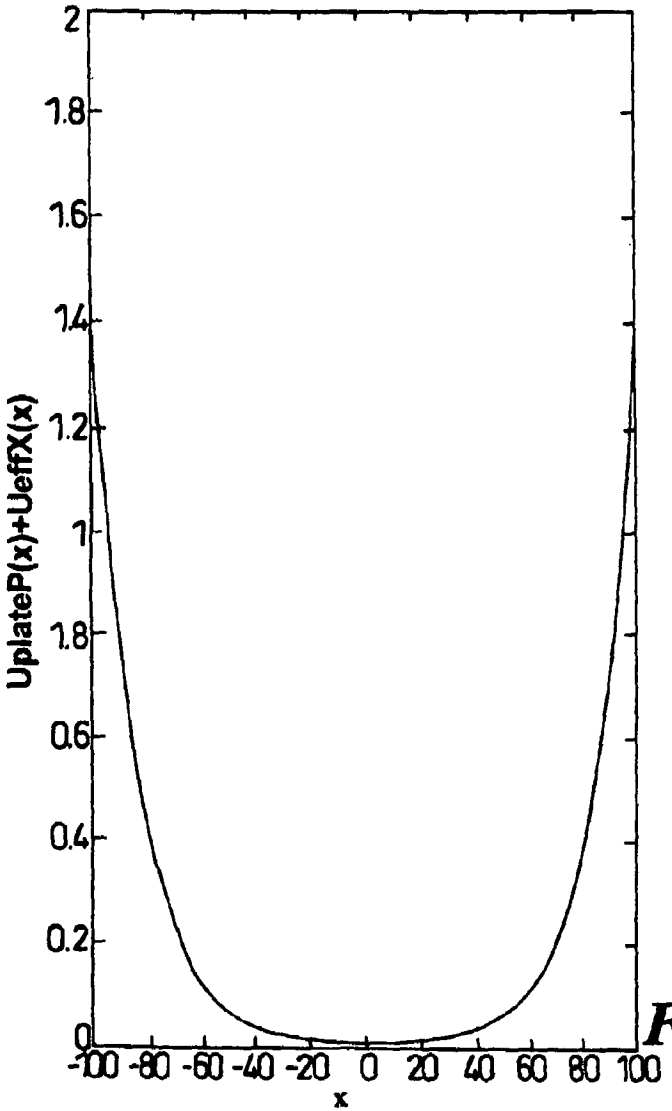
FIG. 11 shows the form of the effective potential well along the x axis produced using a device of the type shown in FIG. 2.
Figure 12:
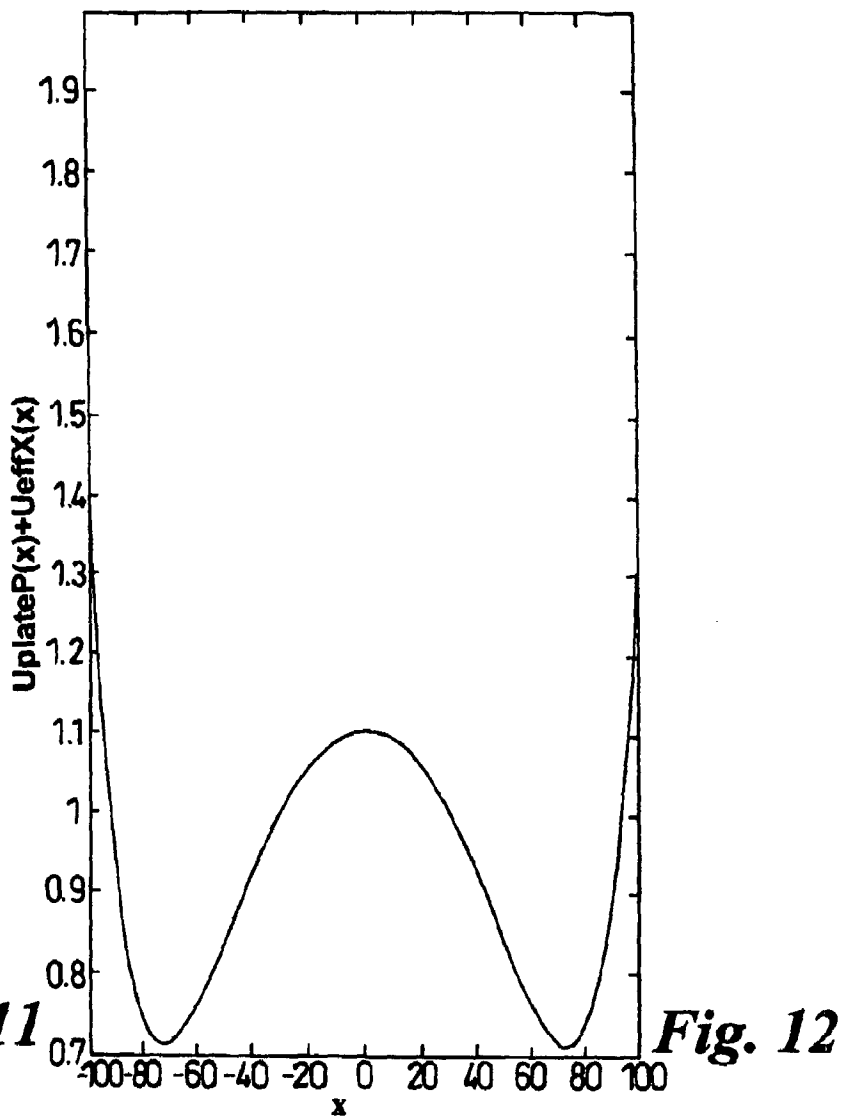
FIG. 12 shows a composite potential (electrostatic plus ponderomotive) along the x axis produced using a device of the type shown in FIG. 2.
Figure 13A:
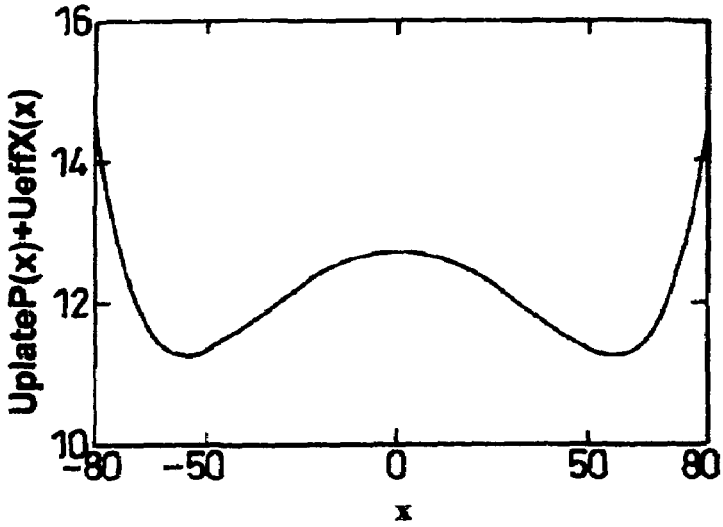
FIG. 13 shows the position of the potential minima for ions having (a) M=1000, z=2, (b) M=500, z=2, (c) M=250, z=2.
Figure 13B:
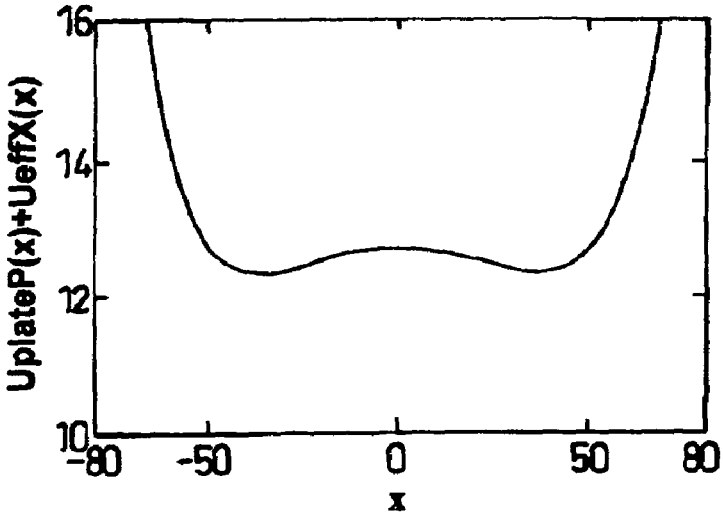
Figure 13C:
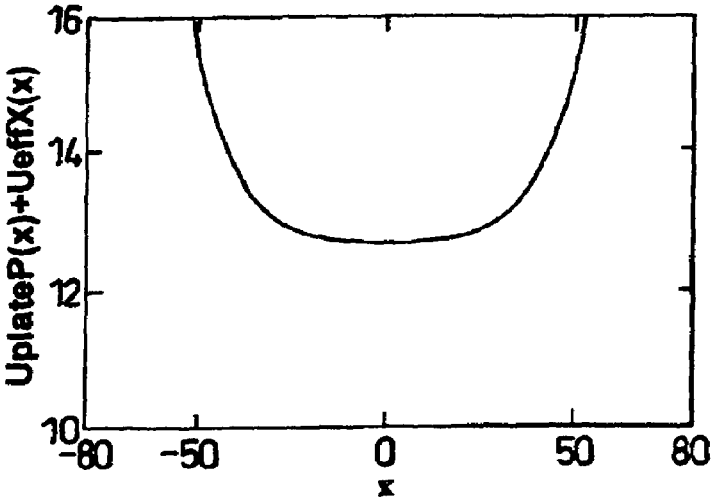
Figure 14:
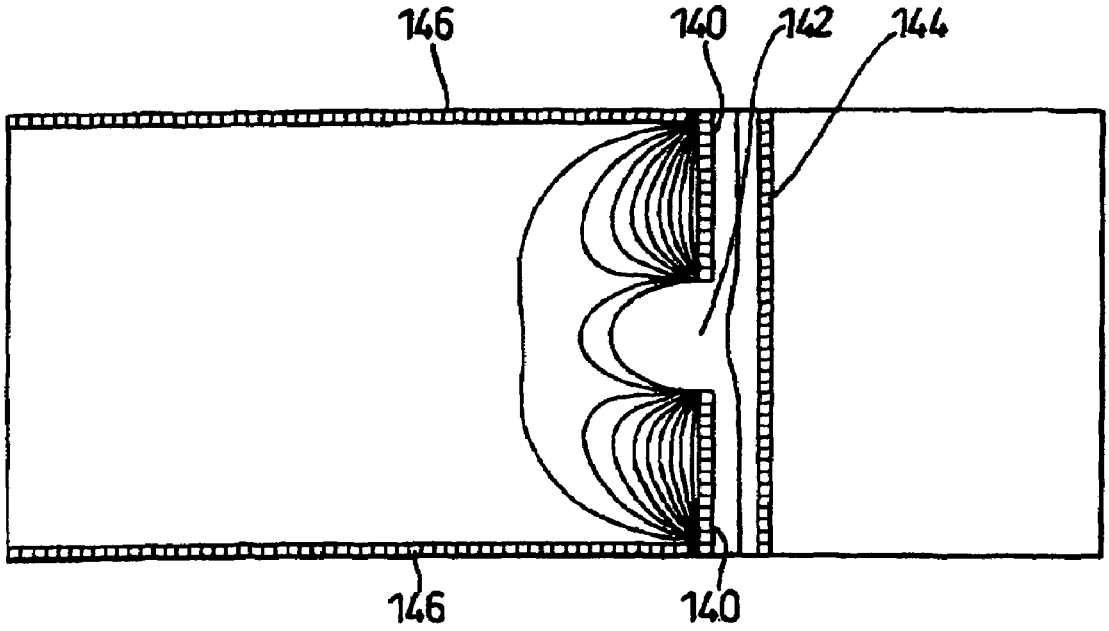
FIG. 14 is a cross-sectional view of an embodiment of the exit region of an ion extraction device.
Figure 15:
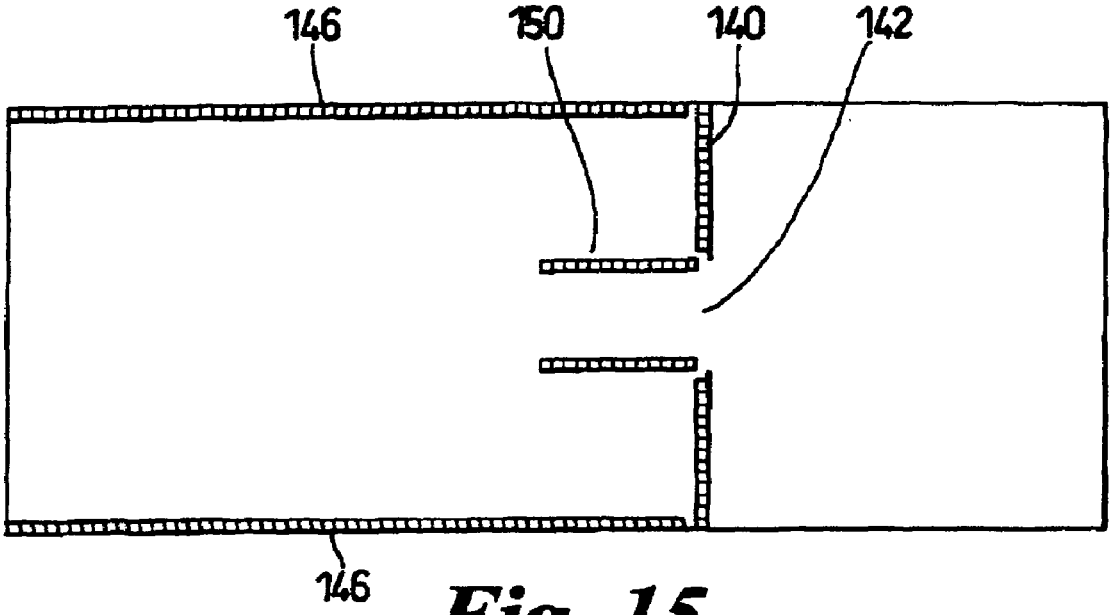
FIG. 15 is a cross-sectional view of another embodiment of the exit region of an ion extraction device.

FIG. 9 shows a typical electrostatic potential well along the Y axis of the device of the embodiment shown in FIG. 2(*a*), and FIG. 10 shows a typical negative dispersion along the X axis. These plots are calculated from the 2nd term in equation (4). FIG. 11 shows the form of the effective potential well along the x axis, and is calculated from the 1st term in equation (4). FIG. 12 shows a composite potential (electrostatic+ponderomotive) along the X axis for chosen device geometry. At the centre of the device near the Y axis it can be seen that the potential is at a local maximum. This is because the dispersive force in X at the centre of the guide from the electrostatic saddle point is greater than that produced by the ponderomotive trapping force from the RF effective potential. As one progresses closer to the edge of the guide the RF effective potential exceeds the electrostatic dispersion and so complete X-Y trapping is achieved in these two wells. In the presence of a collision gas the kinetic energy of the ions is damped and they are confined locally to these potential minima away from the centre of the guide. Inspection of the first term of equation (4) shows that the size of the RF effective potential well depends upon the charge squared and the mass. It is clear that by carefully adjusting the electrostatic voltage and/or RF voltage one can separate ions of similar mass but differing z. FIGS. 13(*a*), 13(*b*) and 13(*c*) show the position of the potential minima for three ions of M=1000, z=2; M=500, z=2; and M=250, z=2. The same voltage settings were used in the guide for these three Figures and they demonstrate how spatial separation of ions having similar mass but different z can be achieved. So far only the 2 dimensional behaviour of the device has been discussed and the extraction of the ions to further spectrometer stages has not been discussed. It is important to note that the device can be constructed of any desired length in order to increase the space charge capacity before degradation of performance. In one embodiment shown in FIG. 14 there is provided an end plate 140 with an aperture 142 through which ions are extracted. In normal operation the end plate 140 is biased such as to trap ions in the body of the device. An auxiliary electrode 144 situated behind the trapping end plate 140 causes a local extraction field in the centre of the device. Also shown in FIG. 14 are the end extremities of DC electrodes 146. FIG. 14 shows the cross section of this arrangement with the lines of equipotential showing the local extraction field. Ions which reside in the potential wells away from the optic axis remain trapped in the device whereas ions residing in the centre are extracted to subsequent stages of the spectrometer. Operation of the device then entails scanning the RF and/or electrostatic potential to sequentially bring those ions of desired M/z and z to its optic axis for subsequent ejection through the endplate hole. It is important that the spatial separation of the different species is maintained during the extraction process of the ions or the performance of the device may be compromised. Another way to extract ions is shown in FIG. 15, which depicts an arrangement in which the end plate 140 has an inwardly extending leaky dielectric tube 150 through which to extract the ions. The leaky dielectric tube 150 is positioned adjacent to aperture 142 and can be as described in U.S. Pat. No. 4,283,626 or International Publication No. WO 2004/109741. In this case the trapping voltage applied to the end plate 140 keeps the ions in the device and the combination of gas flow and electric field in the tube 150 drives ions into the tube 150 and out of the device. The RF fields are maintained through the leaky dielectric to keep ions to the centre of the tube 150 during their exit, eg, to subsequent spectrometer stages. Note that the extraction elements may be pulsed for optimum interfacing to the downstream elements of the instrumental arrangement. In alternative embodiments, it may be possible to extract populations of ions from a number of predetermined locations. A plurality of apertures may be provided for this purpose. In this way, populations of ions can be extracted in situ, ie, without causing a population of ions to move to a fixed extraction point such as the centre of the device.

Figure 19A:
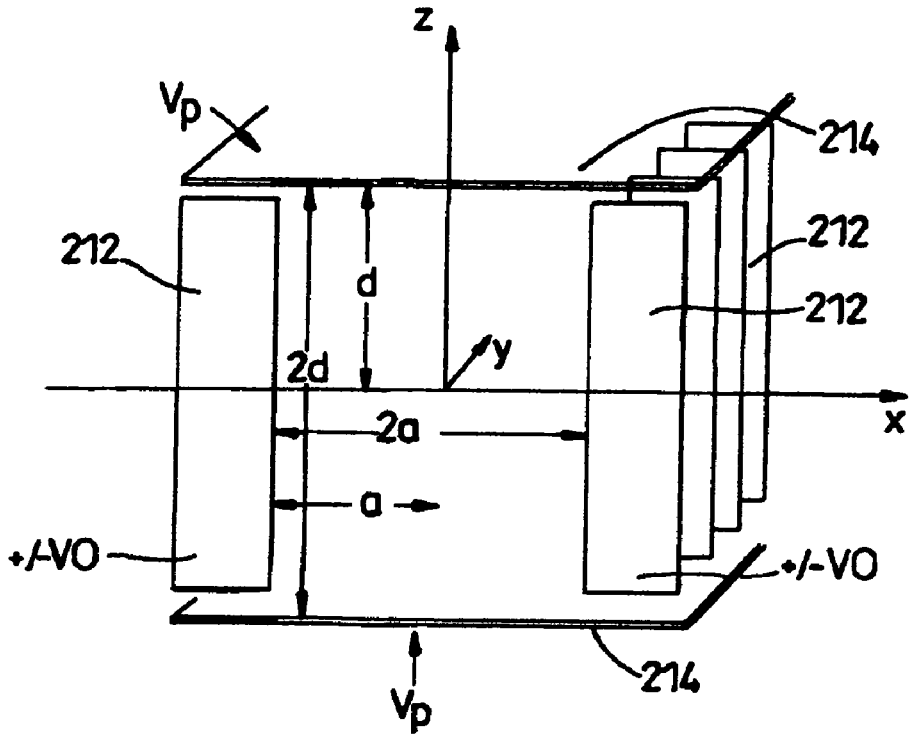
FIG. 19 shows (a) a cross-sectional view of a DC electrode/RF electrode arrangement and (b) a perspective view of a cuboid device of the invention.
Figure 19B:
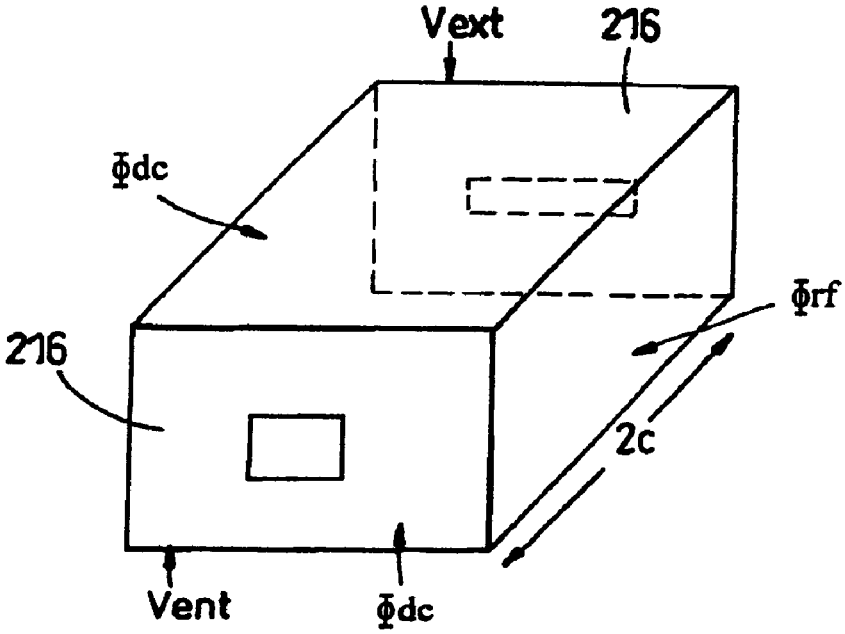

The devices described above exploit phenomena associated with a general two dimensional solution. Further embodiments of the invention exploit phenomena associated with a general three dimensional solution. A general three dimensional solution has been found for the guide whose form and notation is set out in FIG. 19 and which comprises an RF parallel rod set (shown generally at 210) which consists of a plurality of RF plates 212 and a plurality of DC electrodes 214, and a pair of end plates 216. Note that the coordinate system utilised for the guide shown in FIG. 19 differs for the coordinate system utilised for the guide shown in FIG. 1.

The solution for the cuboid geometry has been developed whereby the resultant potential is again the superposition of the individual components which are shown below.

Injection plate Vent at y=−c:

$$\Phi ZX2(x, y, z) := \sum_N \sum_M 16 \cdot \frac{Vent}{N \cdot M \cdot \pi \cdot \pi} \cdot \frac{\sin\left[\frac{M \cdot \pi \cdot (A(x) + a)}{2 \cdot a}\right] \cdot \sin\left[\frac{N \cdot \pi \cdot (C(z) + d)}{2 \cdot d}\right] \cdot \sinh\left[\sqrt{\left(\frac{M \cdot \pi}{2 \cdot a}\right)^2 + \left(\frac{N \cdot \pi}{2 \cdot d}\right)^2} \cdot (c - B(y))\right]}{\sinh\left[\sqrt{\left(\frac{M \cdot \pi}{2 \cdot a}\right)^2 + \left(\frac{N \cdot \pi}{2 \cdot d}\right)^2} \cdot 2c\right]}$$

Extraction plate Vext at y=c:

$$\Phi ZX1(x, y, z) := \sum_N \sum_M 16 \cdot \frac{Vext}{N \cdot M \cdot \pi \cdot \pi} \cdot \frac{\sin\left[\frac{M \cdot \pi \cdot (A(x) + a)}{2 \cdot a}\right] \cdot \sin\left[\frac{N \cdot \pi \cdot (C(z) + d)}{2 \cdot d}\right] \cdot \sinh\left[\sqrt{\left(\frac{M \cdot \pi}{2 \cdot a}\right)^2 + \left(\frac{N \cdot \pi}{2 \cdot d}\right)^2} \cdot (B(y) + c)\right]}{\sinh\left[\sqrt{\left(\frac{M \cdot \pi}{2 \cdot a}\right)^2 + \left(\frac{N \cdot \pi}{2 \cdot d}\right)^2} \cdot 2c\right]}$$

Plates at z=+/−d, both with same voltage VP:

$$\Phi DC(x, y, z) :=$$

-continued $$\sum_N \sum_M 16 \cdot \frac{VP}{N \cdot M \cdot \pi \cdot \pi} \cdot \frac{\sin\left[\frac{M \cdot \pi \cdot (A(x)+a)}{2 \cdot a}\right] \cdot \sin\left[\frac{N \cdot \pi \cdot (B(y)+c)}{2 \cdot c}\right] \cdot \cosh\left[\sqrt{\left(\frac{M \cdot \pi}{2 \cdot a}\right)^2 + \left(\frac{N \cdot \pi}{2 \cdot c}\right)^2} \cdot (C(z))\right]}{\cosh\left[\sqrt{\left(\frac{M \cdot \pi}{2 \cdot a}\right)^2 + \left(\frac{N \cdot \pi}{2 \cdot c}\right)^2} d\right]}$$

ϕ RF is defined such that the electrodes are constant along the z axis, alternate along the y axis, and are positioned at x=+/−a:

$$\Phi RF(x, y, z) := \sum_M \frac{4 \cdot V0}{M \cdot \pi} \cdot \frac{\sin\left[\frac{M \cdot \pi \cdot (C(z)+d)}{2 \cdot d}\right] \cdot \sin\left[\frac{\pi \cdot (B(y))}{b}\right] \cdot \cosh\left[\sqrt{\left(\frac{M \cdot \pi}{2 \cdot d}\right)^2 + \left(\frac{\pi}{b}\right)^2} \cdot (A(x))\right]}{\cosh\left[\sqrt{\left(\frac{M \cdot \pi}{2 \cdot d}\right)^2 + \left(\frac{\pi}{b}\right)^2} a\right]}$$

The effective potential from this RF field is derived from the above expression but the resulting term is too long to include here. A number of examples of effective potentials are shown in the following Figures for the geometry shown in FIG. 19 calculated using the following parameters:

The z axis to RF plate distance is 'a' (6 mm), RF plate width is 'b' (10 mm), half length of device in y direction is 'd' (20 mm), number of plates from x axis to DC plate is 'n' (5), peak voltage is V0, insertion plate is Vent (1V), extraction plate voltage is Vext (−1V unless otherwise stated), and trapping plate voltage is Vp (1V). The examples illustrate the mass dependence of the effective potential and the ability of devices of the invention to trap and extract ions in the chosen direction.

Figure 20:
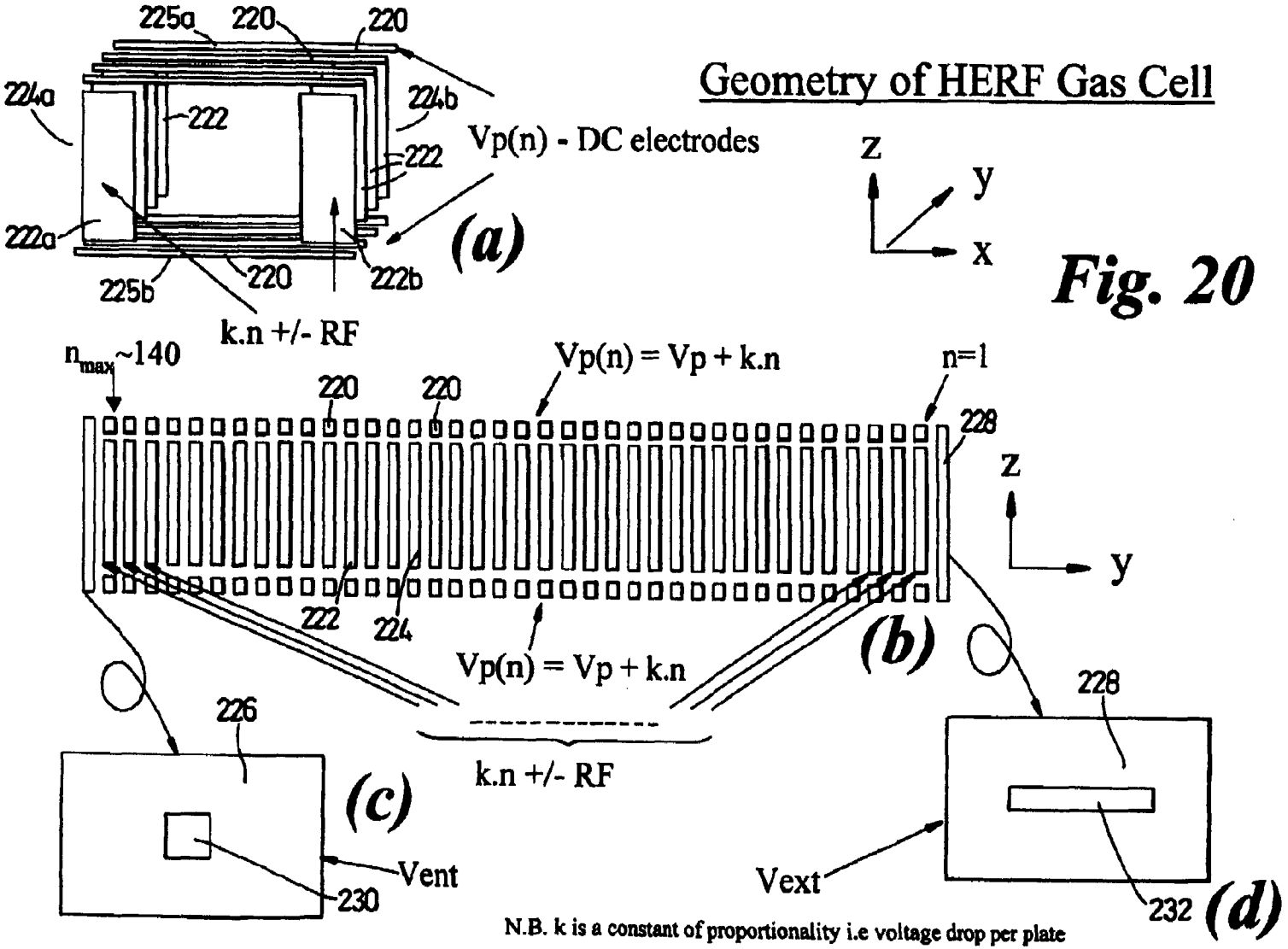
FIG. 20 shows (a) a cross-sectional view in the xz plane, (b) a side view, (c) a rear end view and (d) a front end view of an eighth embodiment of an ion extraction device.

FIG. 20 shows an embodiment of an ion extraction device of the present invention, the operation of which stems from the 3D solution discussed above. FIG. 20(*a*) shows an x-z slice through the centre of the device showing DC electrostatic trapping electrodes 220 and RF electrodes 222. The RF electrodes 222 are plate electrodes. The RF electrodes form a pair of RF electrode stacks, shown generally at 224*a* and 224*b*. Each RF electrode in a stack has a matching electrode in the other stack positioned across the ion extraction device in the x direction. FIG. 20(*a*) shows such a pair of RF electrodes 222*a*, 222*b* spaced apart in the x direction. Note that opposite pairs of RF electrodes spaced apart in the x direction such as electrodes 222*a*, 222*b* are connected to the same phase of the RF applied to the RF electrodes 222. In contrast, opposite phases of the applied RF potential are connected to adjacent electrodes in the same stack. The DC electrodes 220 are segmented, and form a pair of DC electrode stacks extending axially of the device, shown generally at 225*a* and 225*b*. It can be seen that the device comprises a plurality of segmented RF/DC electrode units, wherein each RF/DC electrode unit comprises a co-planar arrangement of two opposed RF electrodes 222 and two opposed DC electrodes 224. In this way a DC polynomial can be added to both DC only and the RF plates to create any desired function in a manner similar to that described by U.S. Pat. No. 5,206,506. The device further comprises a first end plate 226 and a second end plate 228. The first end plate 226 has an aperture 230 formed therein enabling ions to be supplied to the device. The aperture 230 may be of any convenient shape, such as a square, as shown in FIG. 20, or a circle. The second end plate 228 has an aperture 232 through which ions are extracted from the device. The aperture 232 can be any suitable shape, such as a slot. Other suitable configurations for the aperture through which ions exit the device are discussed below.

Figure 21:
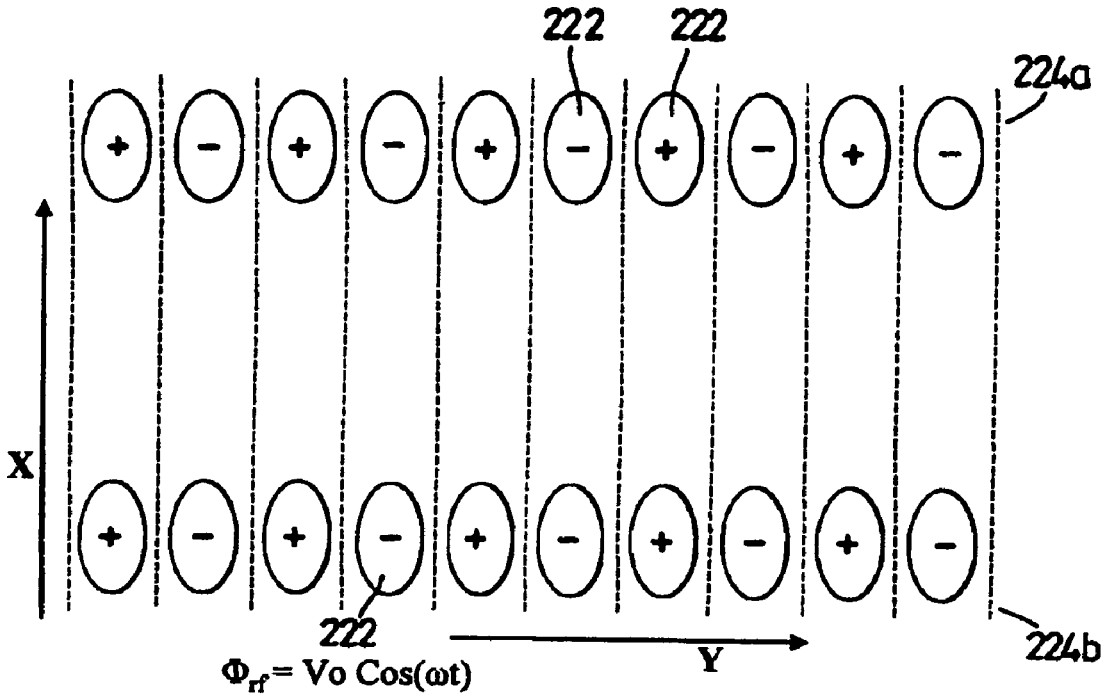
FIG. 21 is a plan view of the RF electrodes of the eighth embodiment of an ion extraction device showing the application of an RF potential.
Figure 22:
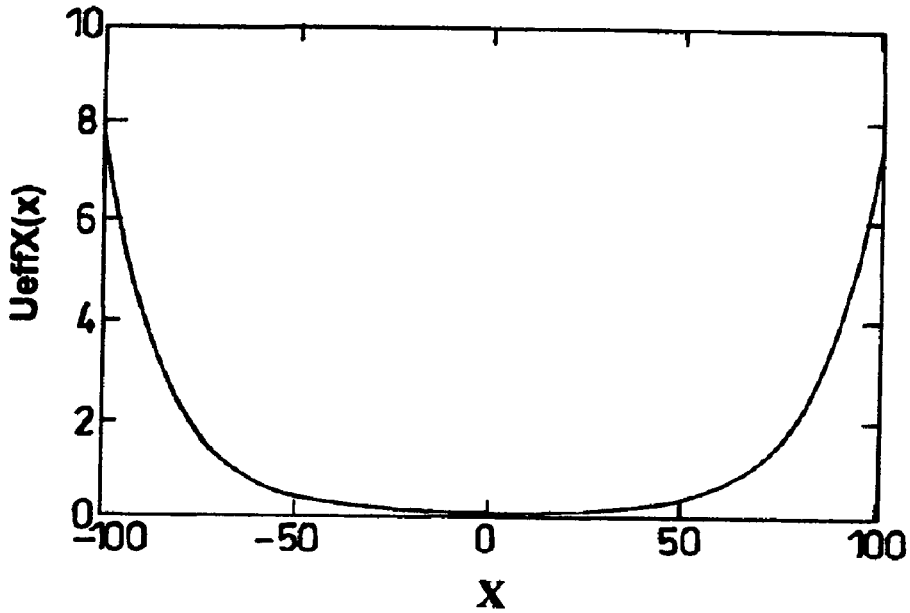
FIG. 22 shows the RF effective potential well in the x direction.
Figure 23:
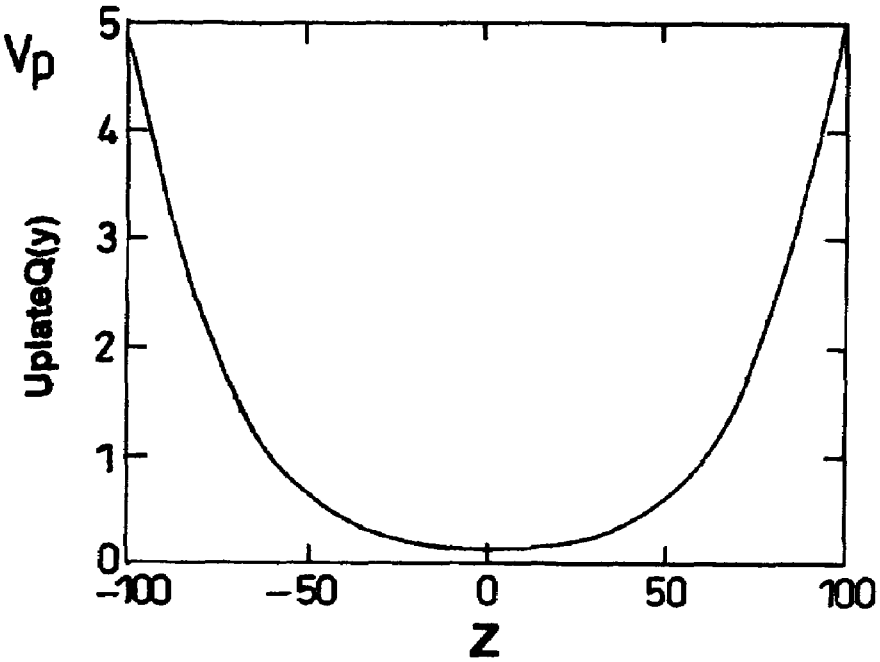
FIG. 23 shows the DC electrostatic potential well in the z direction.
Figure 24:
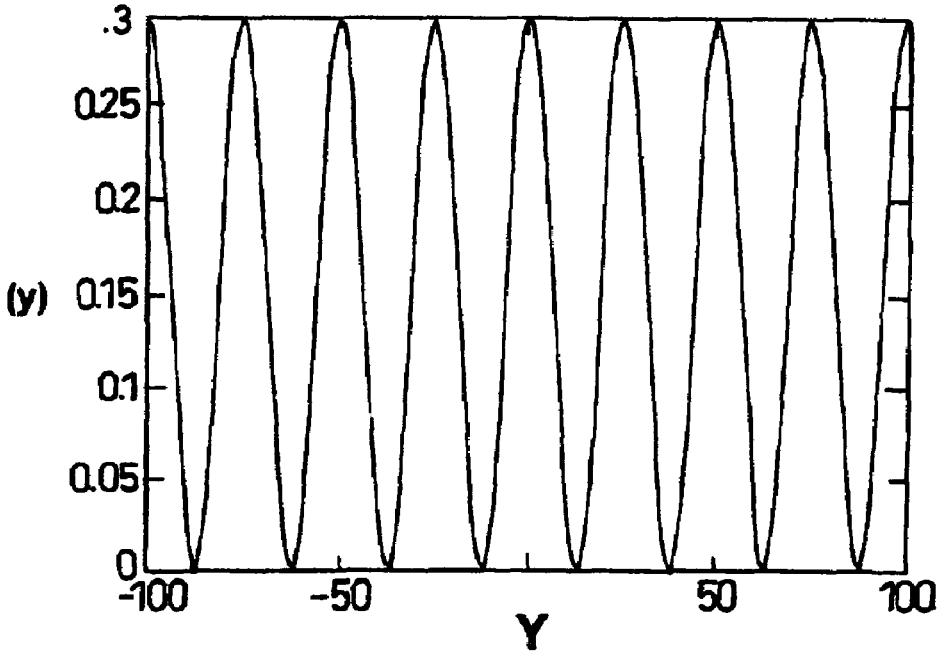
FIG. 24 shows the effective potential in the y direction.
Figure 25A:
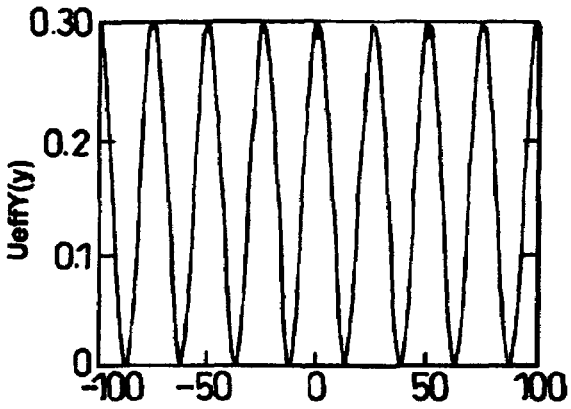
FIG. 25 shows the effective potential in an ion extraction device in the y direction for an ion of m/z=2000 at the centre of the device, (b) for an ion of m/z=2000 at an RF electrode, (c) for an ion of m/z=200 at the centre of the device and (d) for an ion of m/z=200 at an RF electrode.
Figure 25B:
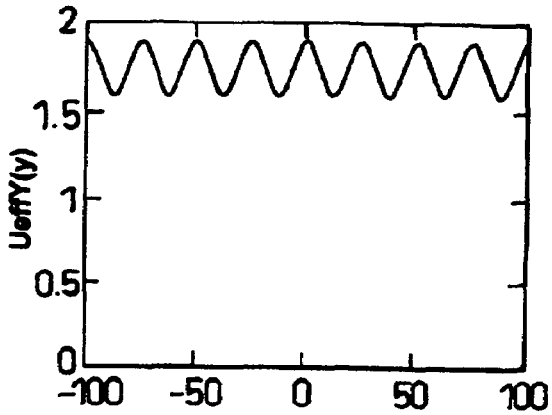
Figure 25C:
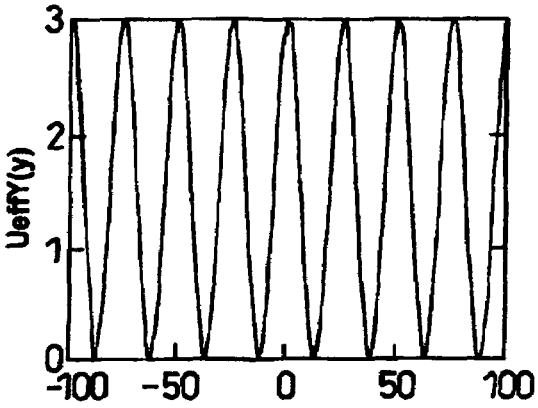
Figure 25D:
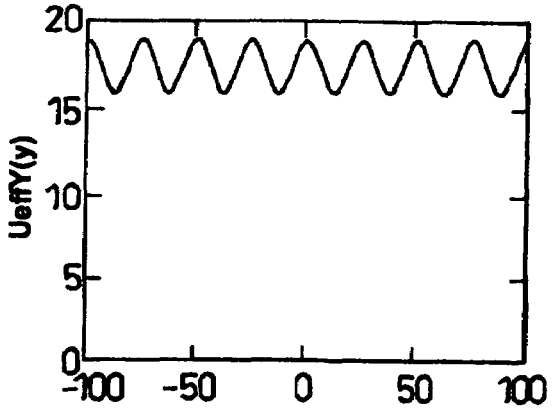
Figure 26:
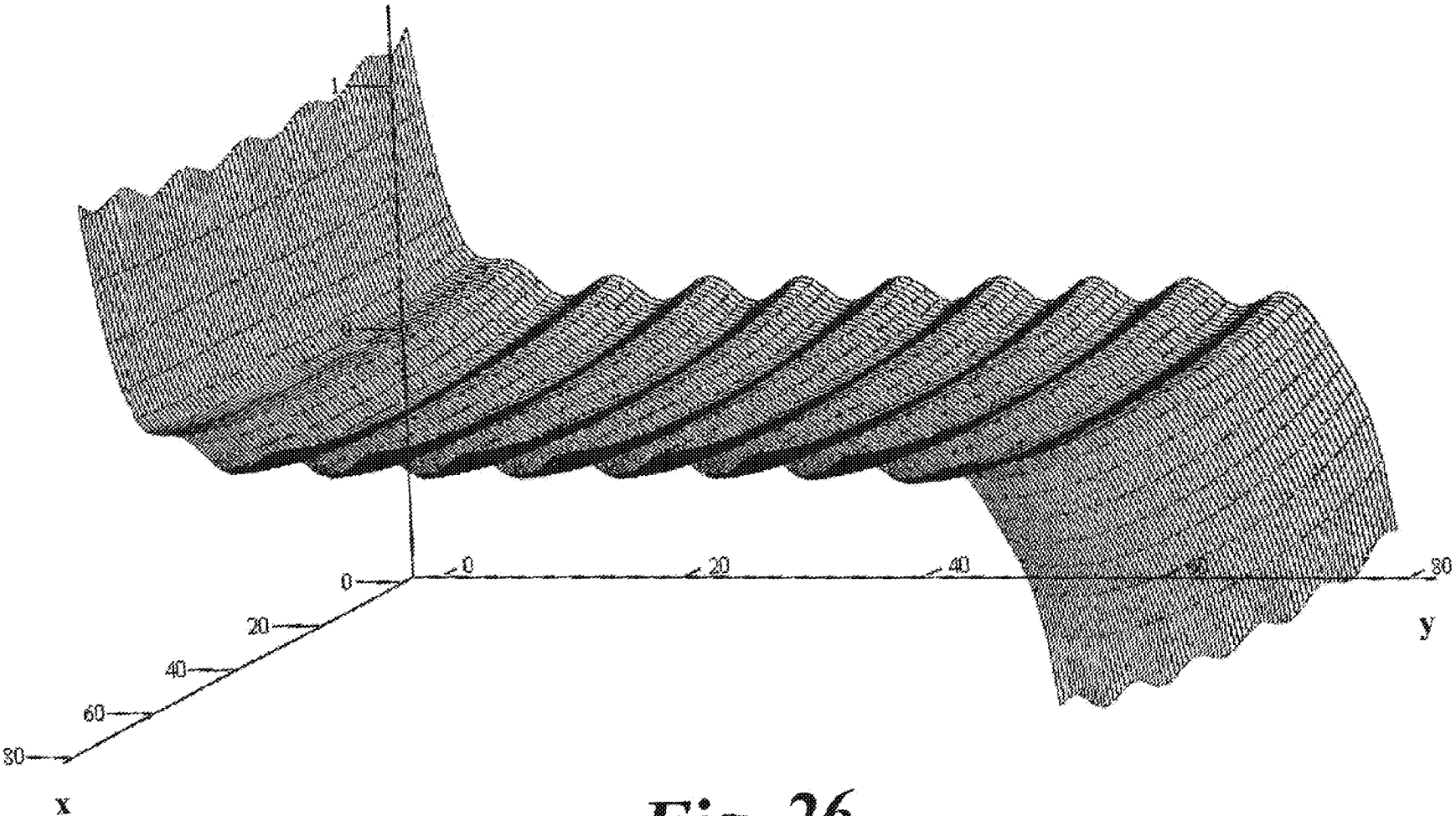
FIG. 26 shows potential in the xy plane (z=0) with V0=200V and m/z=2000.
Figure 27:
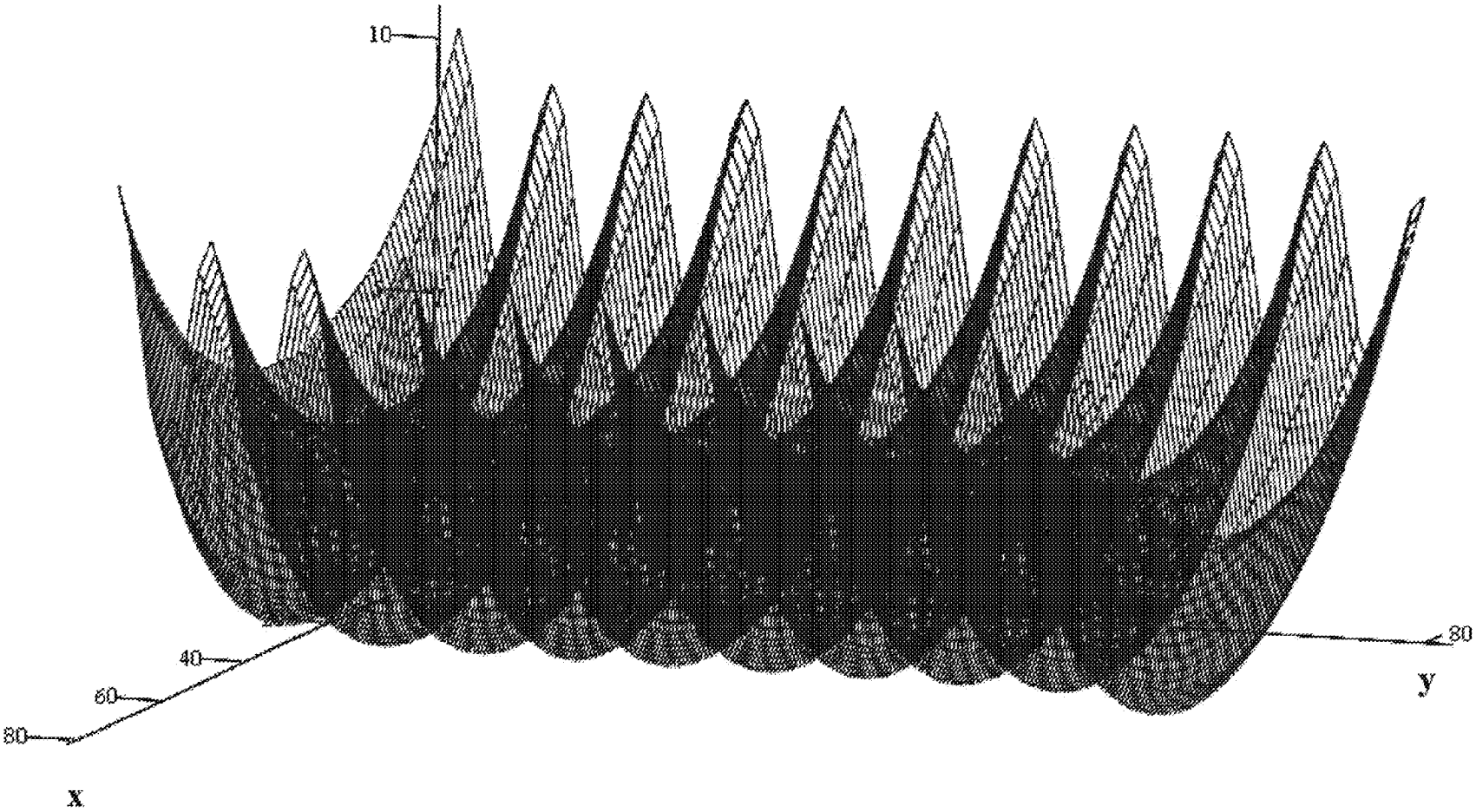
FIG. 27 shows potential in the xy plane (z=0) with V0=200V and m/z=50.
Figure 28:
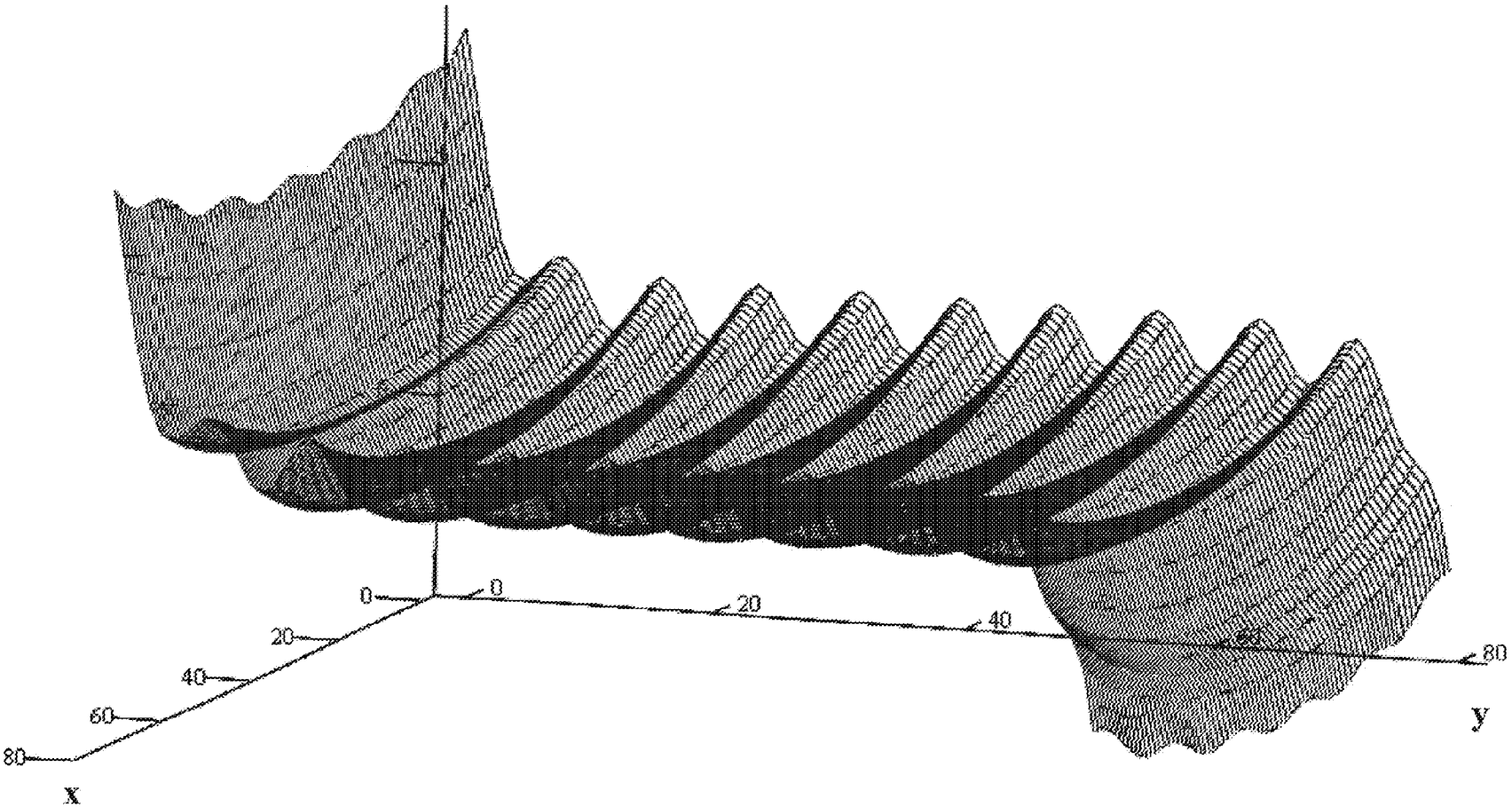
FIG. 28 shows potential in the xy plane (z=0) with V0=50V and m/z=50.
Figure 29:
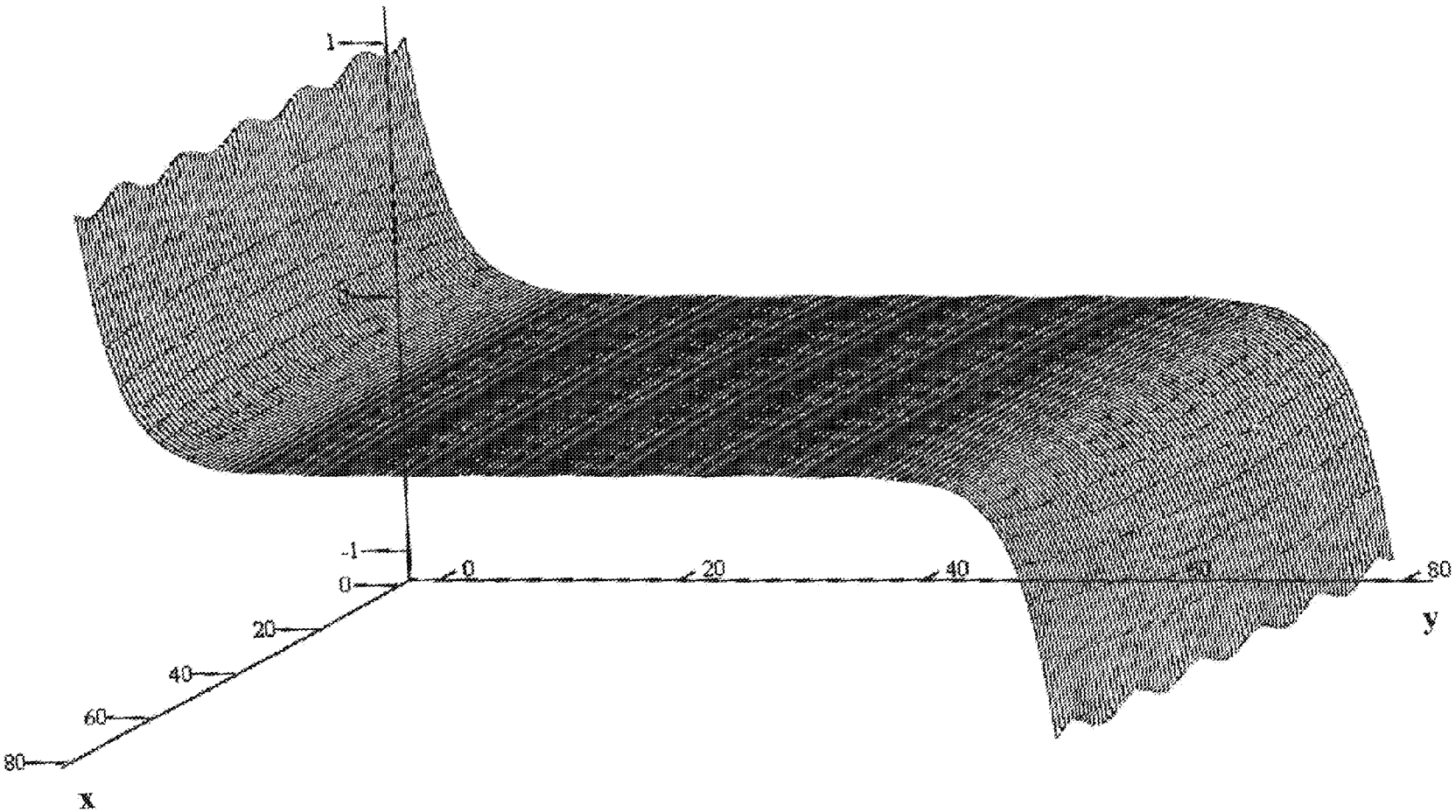
FIG. 29 shows potential in the xy plane (z=0) with V0=50V and m/z=2000.
Figure 30:
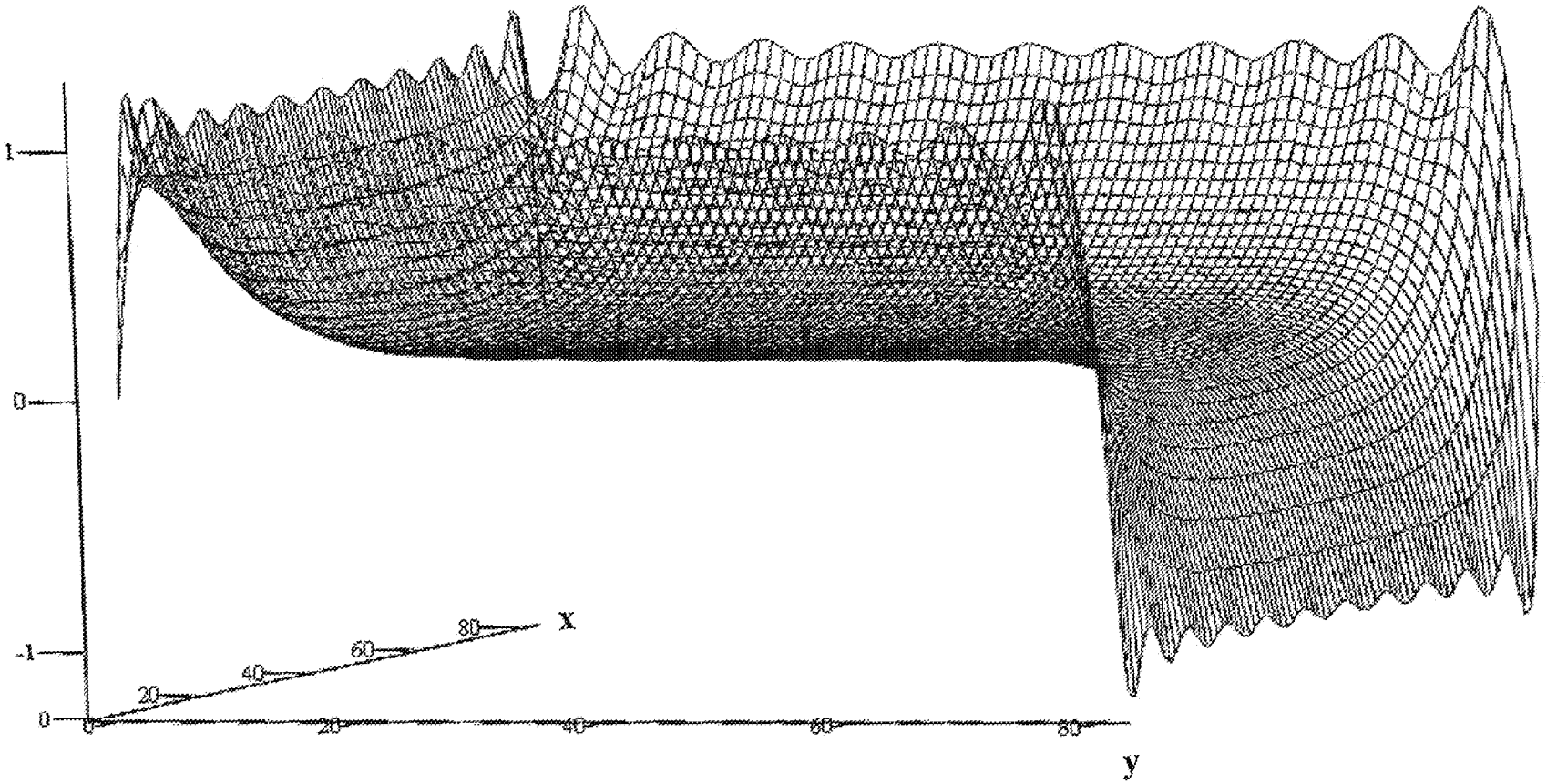
FIG. 30 shows potential in the yz plane (x=0) with V0=50V and m/z=2000.
Figure 31:
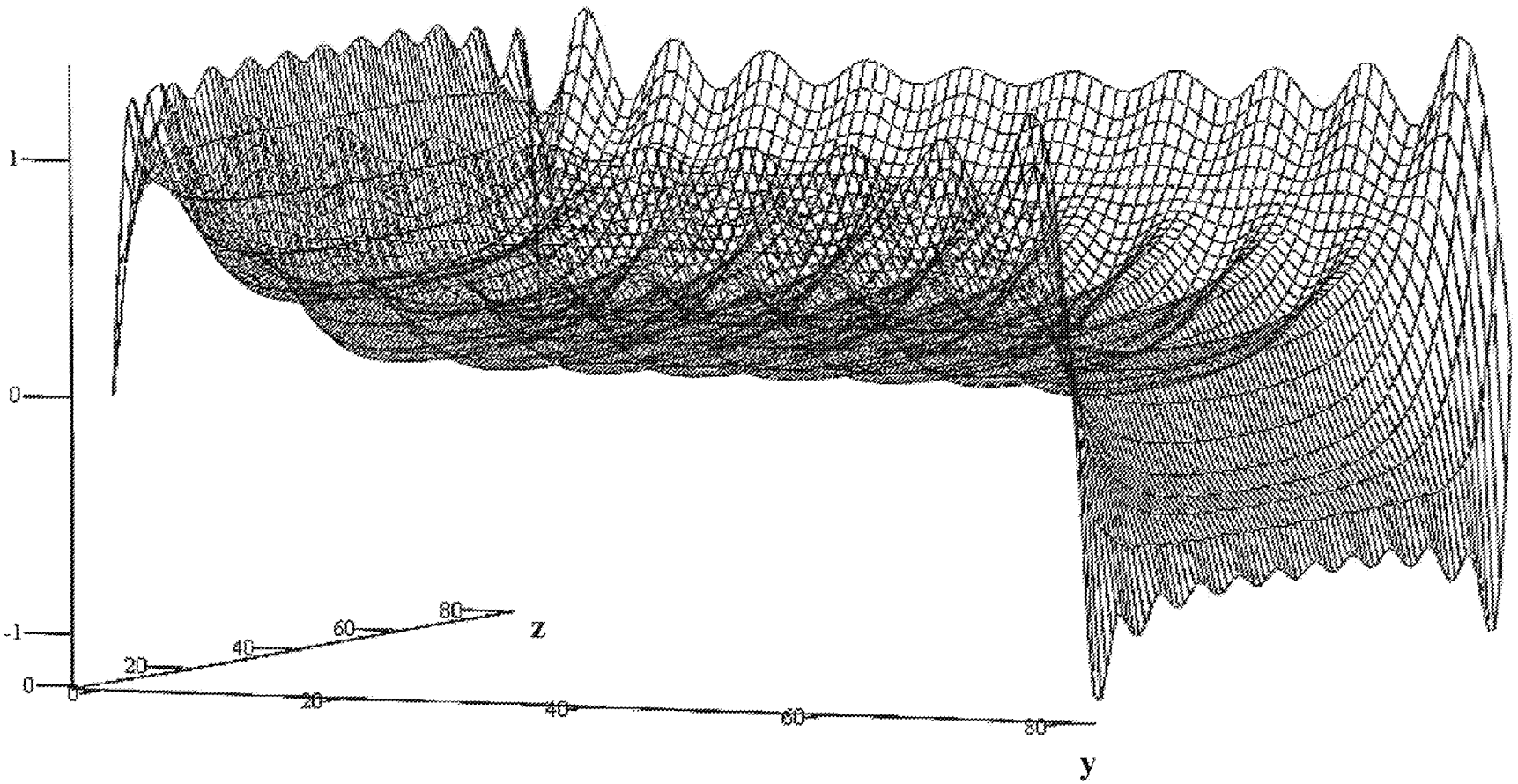
FIG. 31 shows potential in the yz plane (x=0) with V0=50V and m/z=50.
Figure 32:
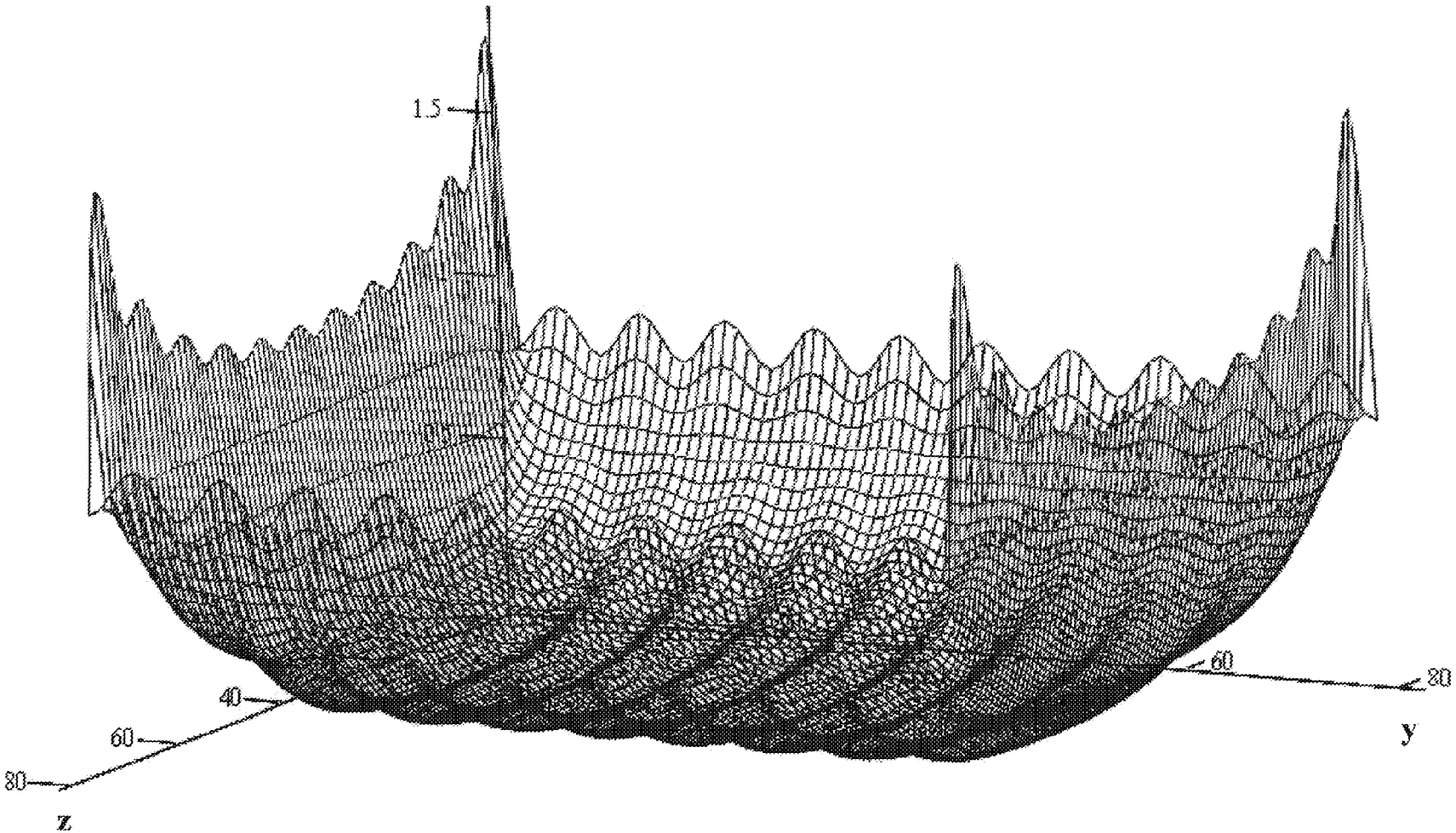
FIG. 32 shows potential in the yz plane (x=0) with V0=50V, m/z=200, Vent=Vext=1V, and illustrates complete 3D trapping.

FIG. 21 is a plan view depicting the RF electrodes 222 in FIG. 20 in the two stacks 224*a*, 224*b*. FIG. 21 depicts the way in which an RF potential (defined by the equation $\Theta_{rf}$=Vo cos (wt)) is applied to the RF electrodes 222. In particular, FIG. 21 shows the phases of the RF potential as applied to each RF electrode 222. As noted above, pairs of RF electrodes 222 spaced apart in the x direction are connected to the same phase of the RF potential. In contrast, adjacent electrodes in a stack of electrodes are connected to opposite phases of the RF potential. It will be understood that the phase of the RF potential applied to any given electrode changes over time, and thus the positive and negative symbols utilised in FIG. 21 to describe the RF potential applied to each electrode 222 represents a snapshot in time. The effect of the way in which the RF potential is applied to the electrodes 222 is to produce a spatial periodicity in the effective potential along the y axis. This periodicity is shown in dotted lines in FIG. 21. FIG. 22 shows a typical shape of the RF potential well in the x direction, ie, between pairs of spaced apart RF electrodes 222 which are spaced across the ion extraction device. FIG. 22 shows that the effective potential increases steeply as an ion approaches either of the RF electrodes in a spaced apart pair. FIG. 23 shows a typical DC electrostatic potential well in the z direction generated by the application of a voltage $V_p$ to the DC electrostatic trapping electrodes 220. Again, the potential increases quite markedly as an ion approaches either of the electrodes 220. FIG. 24 shows the effective potential in the y direction, ie, along the length of the ion extraction device. It can be seen that the effective potential shows ripples along the y axis. The magnitude of the ripple, which is caused by the periodicity in the RF potential along the y axis, is dependent on the m/z ratio of an ion in the ion extraction device. Very surprisingly, it has been found that the magnitude of the ripple in the effective potential along the y axis is independent of the proximity to the RF electrodes 222 and the DC electrodes 220.

FIG. 25 shows the mass dependent effective potential in the y direction in a number of different instances. FIGS. 25(*a*) and (*b*) show the effective potential for a singly charged ion of mass 2000. FIG. 25(*a*) shows the effective potential along the centre of the ion extraction device, ie, at x=0 and z=0 using the coordinate system shown in FIG. 19. FIG. 25(*b*) shows the effective potential at an RF electrode 222. As expected, the potential at an RF electrode 222 is higher than at the centre of the device. However, in both instances the magnitude of the ripple is 0.3 V. Similarly, FIGS. 25(*c*) and 25(*d*) show the effective potential in the y direction for a singly charged ion of mass 200. FIG. 25(*c*) shows the effective potential at the centre of the device and FIG. 25(*d*) shows the effective potential at an RF electrode 222. Again, the potential at RF electrode 222 is higher than in the centre of the device, but the magnitude of the ripple observed is the same in both instances. The magnitude of the ripple is in this case 3V, illustrating that the magnitude of the ripple is dependent on the m/z ratio of the ion in the device. FIGS. 26 to 32 show a variety of two dimensional effective potentials in a number of planes through the ion extraction device of FIG. 20. The ripples in the effective potential described above represent a mass dependent potential barrier. This phenomena can be utilised to trap ions (either fragment or parent). In preferred embodiments of the invention, an axial field is applied to the device (such as, for example, by applying appropriate potentials to the end plates 226, 228 of the device shown in FIG. 20) thereby permitting transport of ions of relatively high mass along the length of the device whereas ions of relatively low mass, which encounter a deeper potential well in the y direction, remain trapped in the body of the device. This approach permits easy interfacing with further spectrometer stages, such as an oa-TOF whereby an enhanced duty cycle can be achieved. By judicious variation of the effective potential, ions of a chosen m/z ratio may be selectively extracted from the device.

Figure 33A:
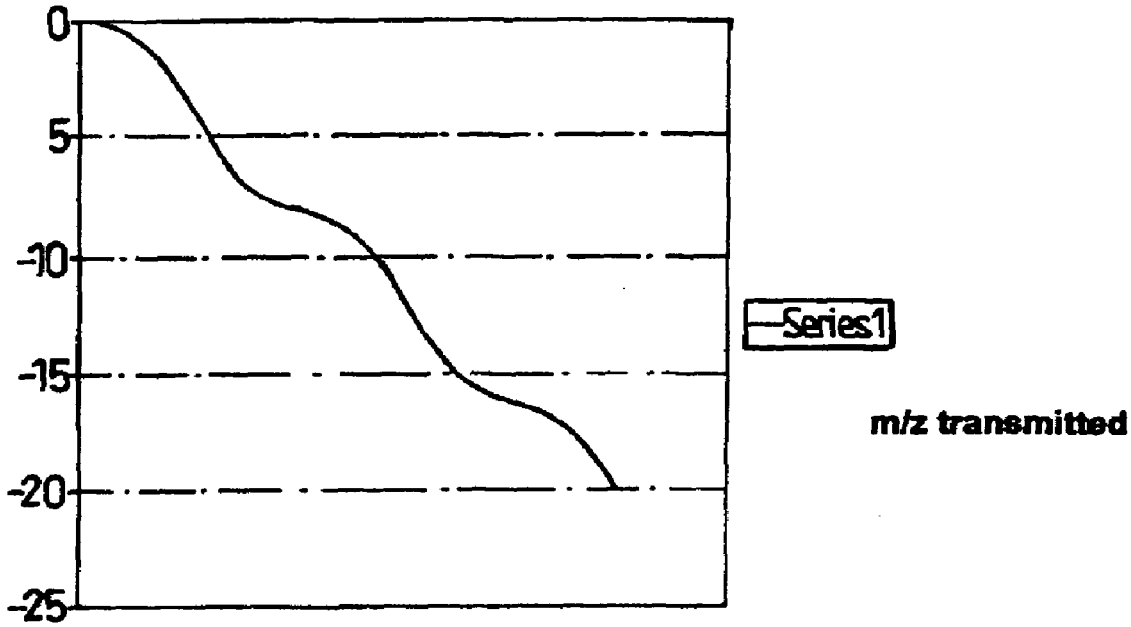
FIG. 33 shows the effective potential in the y direction with an applied drift field for (a) an ion of relatively high m/z ratio and (b) an ion of relatively low m/z ratio.
Figure 33B:
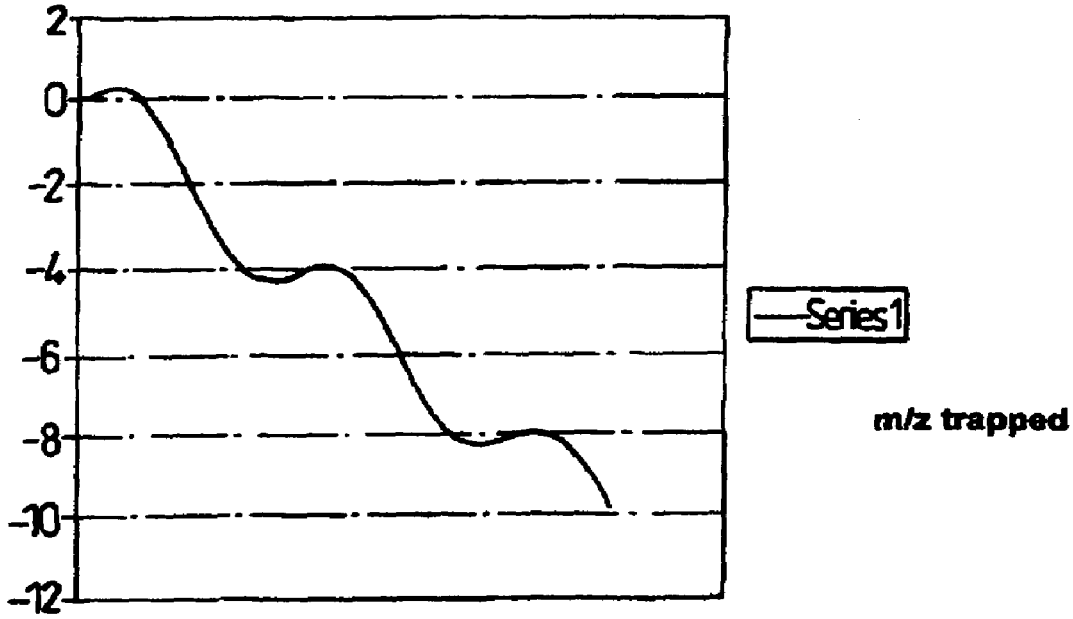

FIG. 33 shows how mass selective extraction of ions may be achieved through the application of a drift field along the device. FIG. 33(*a*) shows the effective potential experienced by ion in the instance in which the drift field is large enough to overcome the potential maxima created by the RF potential. In this instance, there is no axial energy barrier in the effective potential, and the drift field is sufficient to enable the ion to be transmitted along the device. FIG. 33(*b*) depicts the effective potential in the instance in which the applied drift field reduces, but does not eliminate, the potential maxima created by the RF potential. In this instance, the ion is trapped behind the potential maxima in the effective potential. The applied RF potential may be swept in order to selectively transmit ions from high to low mass. In alternative embodiments, the magnitude of the applied drift field may be swept in order to selectively transmit ions.

Figure 34:
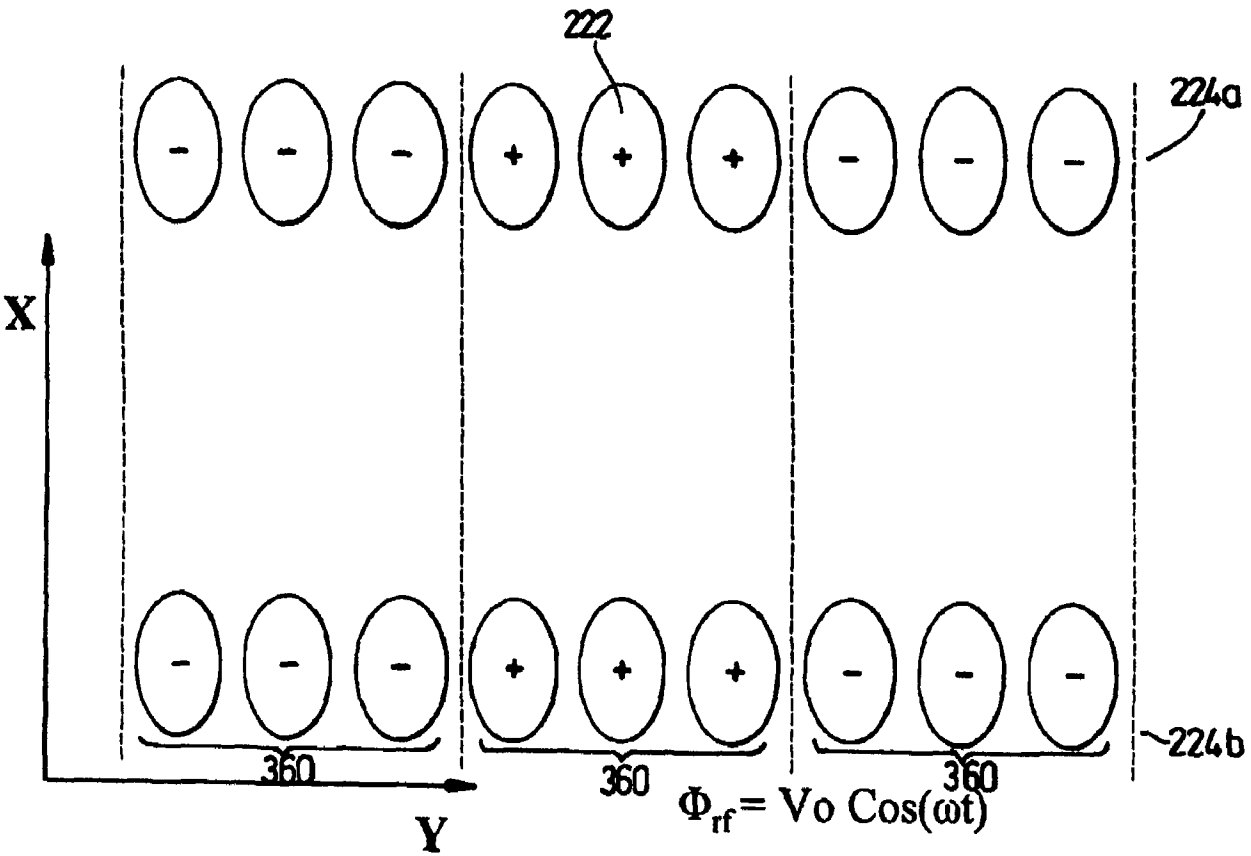
FIG. 34 a plan view of RF electrodes in an ion extraction device of the invention showing the connection of groups of electrodes to common phases of an RF potential.

FIG. 34 shows an alternative way in which the periodicity in the axial effective potential can be generated. In the approach shown in FIG. 34, a plurality of adjacent RF electrodes 222 are connected to a common phase of the applied oscillatory RF potential. In FIG. 34, in each stack 224*a*, 224*b* of RF electrodes 222, groups of three adjacent RF electrodes 360 are connected to a common phase of the applied RF potential. Thus, as one moves axially along a stack of RF electrodes 222, the phase of the applied RF potential changes every third electrode. The effect of this arrangement is that, for a given set of RF electrodes, the spacing of the periodicity in the applied RF potential is increased. In the example shown in FIG. 34, groups of three adjacent RF electrodes are connected to a common phase of the applied RF potential. However, the number of electrodes in a group of adjacent electrodes connected to a common RF potential is not limited to three, but rather can be any number, for example, between two and five adjacent RF electrodes may be connected together in this way. Between five and eight adjacent RF electrodes may be connected together in this way, and it has been found that connecting six adjacent RF electrodes can be optimal. Alternatively, adjacent RF electrodes in a stack may be connected to opposite plates of the applied RF potential, as shown in FIG. 21. In these instances, it is advantageous if relatively thick RF electrodes are employed, since this results in ripples in the axial potential of greater magnitude.

It is possible to utilise a combination of the approaches described in FIGS. 34 and 21. In particular, it is possible to connect pluralities of adjacent RF electrodes to a common phase of the applied oscillatory RF potential, such as described with reference to FIG. 34, in order to provide the periodicity in the applied RF potential. An additional, ion trapping oscillatory RF potential to provide extra confinement in the X direction is applied to adjacent RF electrodes in the manner shown in FIG. 21, i.e., the phases of the ion trapping oscillatory RF potential applied to adjacent RF electrodes are opposed. It should be noted that the ion trapping oscillatory RF potential is intended not to produce the periodicity in the applied RF potential, i.e, the periodic wells have already been created by the connected pluralities of adjacent RF electrodes. Rather, the ion trapping oscillatory RF potential acts to confine high mass ions, which otherwise might have a tendency to strike the electrodes of the device, by providing a strong potential barrier towards the sides of the device, whilst not affecting the effective RF potential along the main, longitudinal device axis significantly. Preferably, the ion trapping oscillatory RF potential is applied 90° out of phase with the RF potential applied to the groups of adjacent RF electrodes. This improves ion trapping, and reduces the peak voltages on the RF electrodes. Representative values are 300V for the RF potential applied to the groups of adjacent RF electrodes, 85V for the ion trapping oscillatory RF potential, with both potentials having a frequency of 1.5 MHz. It is an advantageous feature that, owing to the nature of the Laplace equation, the ion trappings oscillatory RF potential is additive to the effective potential of the device.

Figure 36:
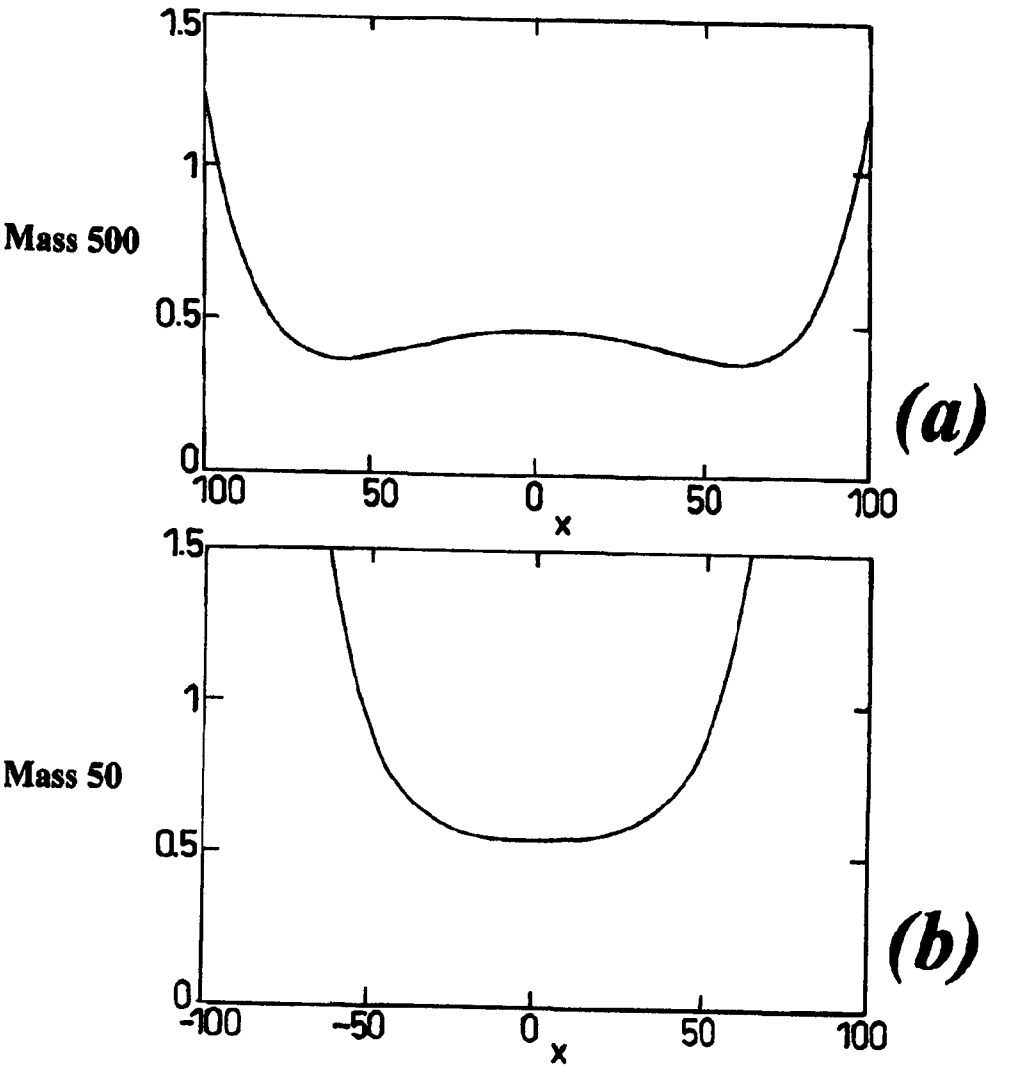
FIG. 36 shows effective potentials in x direction for (a) an ion of m/z=500 and (b) an ion of m/z=50.
Figure 35:
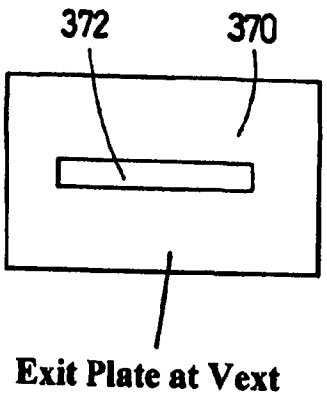
FIG. 35 shows an exit plate.
Figure 37:
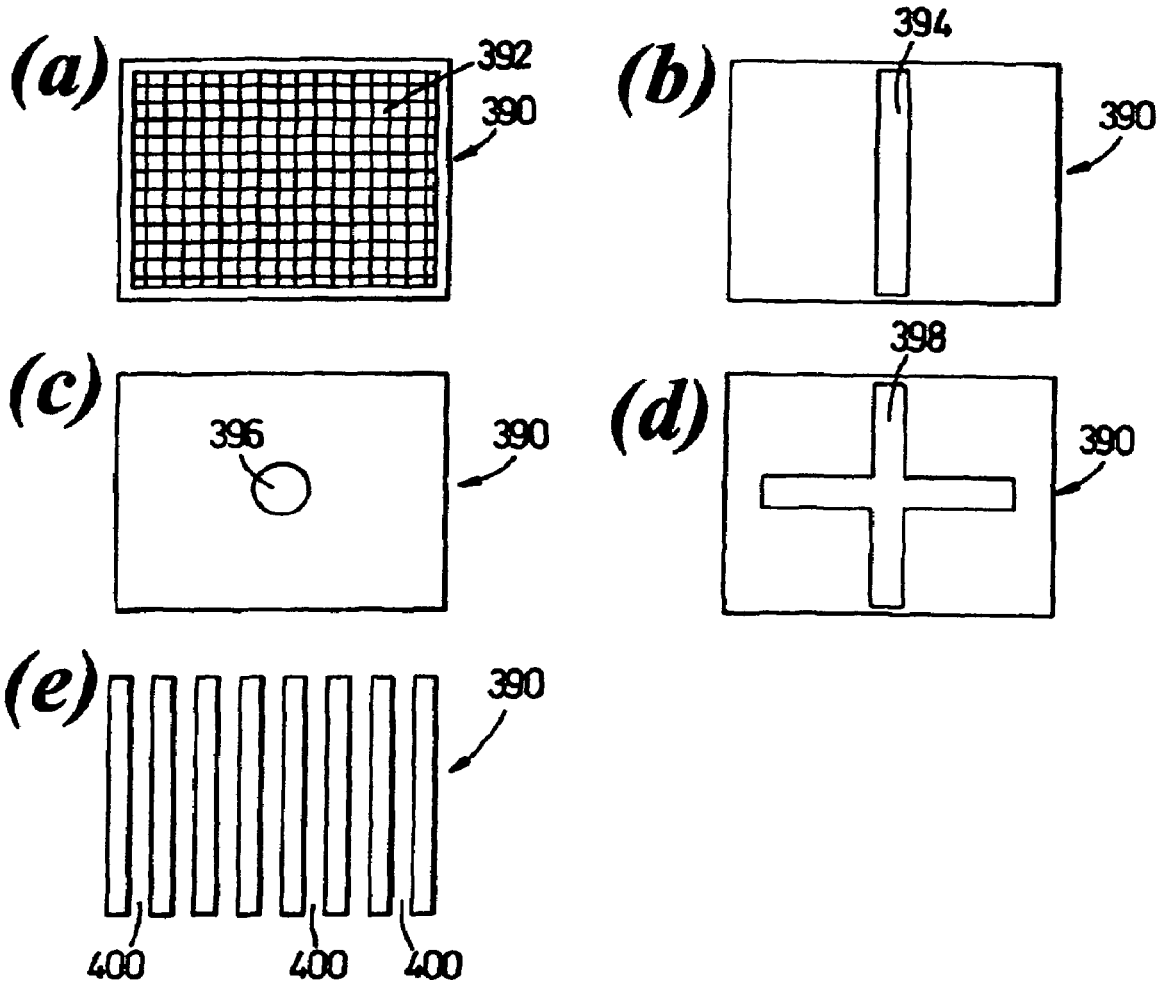
FIG. 37 shows various electrode structures suitable for use as end plates.

FIG. 35 shows a preferred embodiment of an end plate 370 for use at the exit of a device of the present invention. The end plate 370 has a slotted aperture 372 through which ions may be extracted from the device. As noted above it has been found that the, due to the superposition of the electrostatic potential produced by the DC electrodes and the RF effective potential, the effective potential along the x axis (ie, between spaced apart pairs of RF electrodes across the device) can exhibit potential minima which are positioned away from the central axis of the device. The position of the potential minima is dependent on the m/z ratio of the ion in the effective potential. FIG. 36(*a*) shows the effective potential in the x direction for an ion of m/z=500, whereas FIG. 36(*b*) shows the effective potential for an ion of m/z=50. It can be seen that whilst the minimum in the effective potential for the ion of m/z=50 is situated at the centre of the device, for the ion of m/z=500 two potential minima are observed which are axially displaced from the centre of the device. By providing the slotted aperture 372 shown in FIG. 35, it is possible to transmit ions from the device irrespective of their axial distribution along the X axis. FIG. 37 shows other possible types of end plates which may be used in the present invention. FIG. 37(*a*) shows an end plate 390 having a grid or mesh 392 defining a plurality of exit apertures. FIG. 37(*b*) shows an end plate 390 having a vertically slotted aperture 394. FIG. 37(*c*) shows an end plate 390 having circular aperture 396. FIG. 37(*d*) shows an end plate 390 having a cross shaped aperture 398 formed from vertical and horizontal slots. FIG. 37(*e*) shows an end plate 390 having a plurality of vertically slotted apertures 400. The methodologies described in respect of FIGS. 14 and 15 might be used in order to extract ions from devices of the type shown in FIG. 20.

The configurations shown in FIGS. 6 and 7 can also be readily adapted for use according to the methodologies described in respect of the configuration shown in FIG. 20. Thus, a further embodiment has a pair of spaced apart DC plates which act as DC electrodes. The DC plates extend axially along the device. A further embodiment still has a pair of inclined, spaced apart DC plates which act as DC electrodes. In this way a simple axial field along the device can be created.

Typical, but non-limiting, dimensions of an ion extraction device utilising axial potential barriers are length 50 to 250 mm, width 5 to 50 mm with around 140 RF electrodes in each stack.

Figure 38:
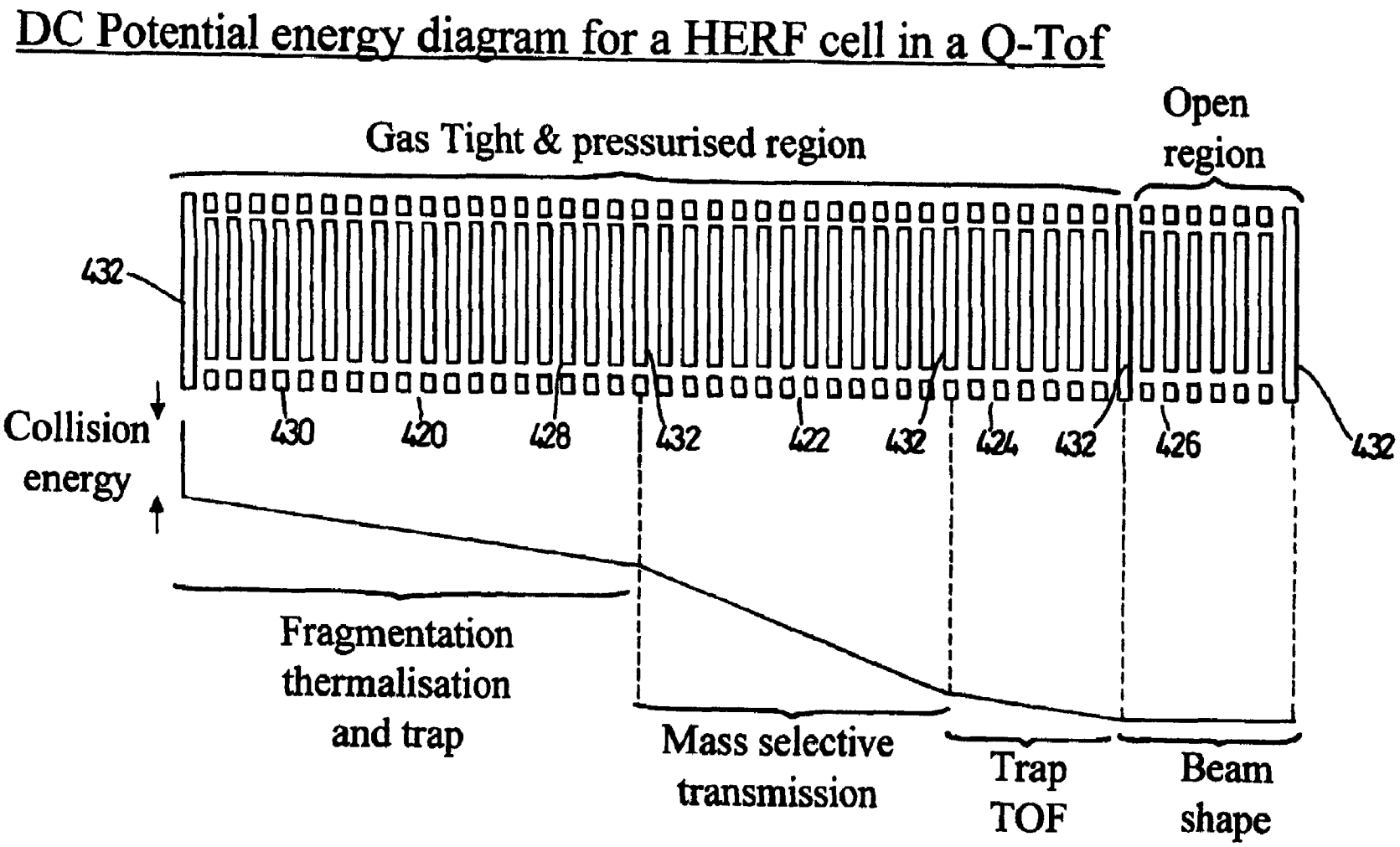
FIG. 38 shows an analytical device and an associated DC potential energy diagram.
Figure 39:
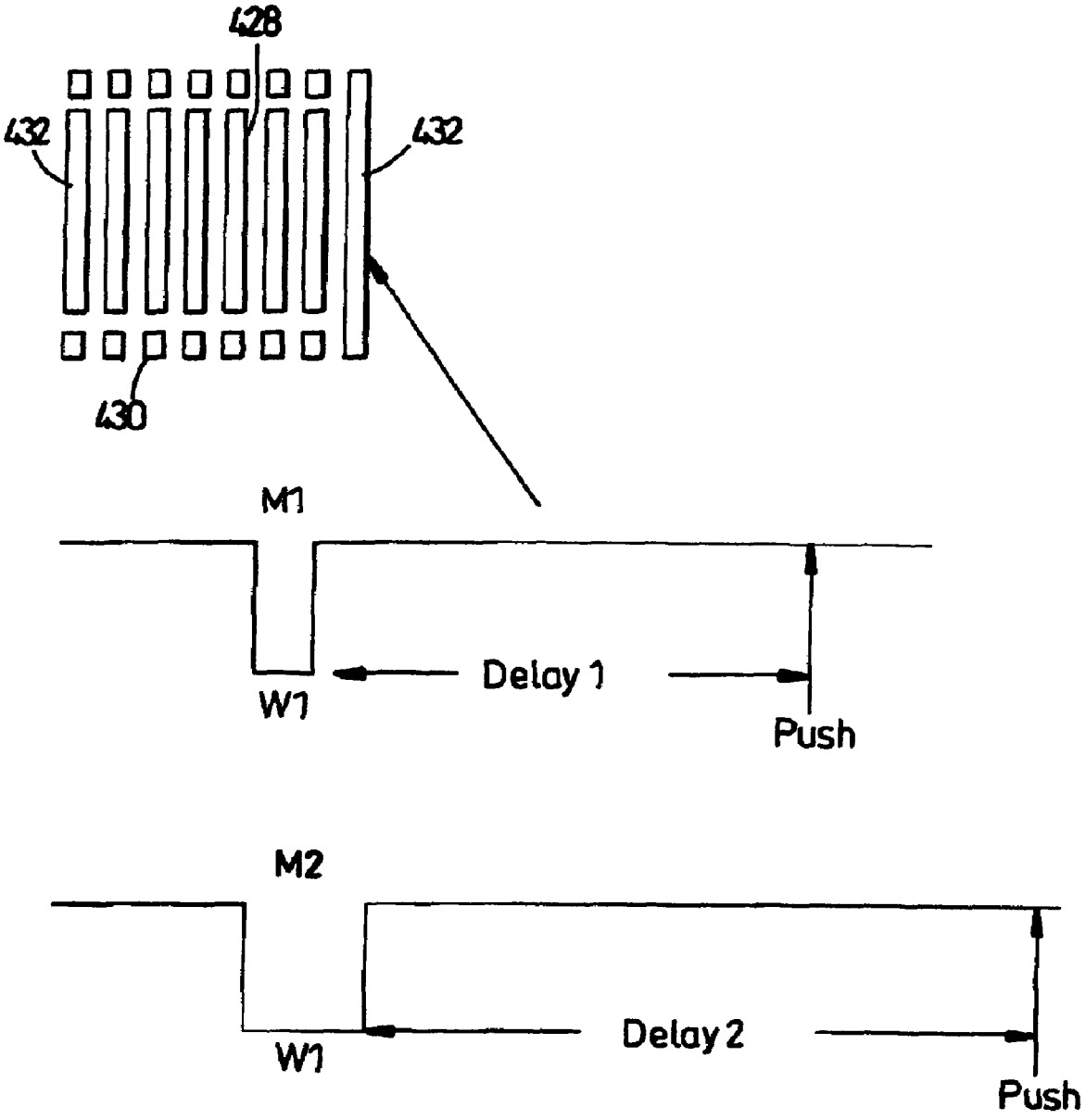
FIG. 39 shows a trap-TOF device and pulsed extraction scheme.
Figure 40:
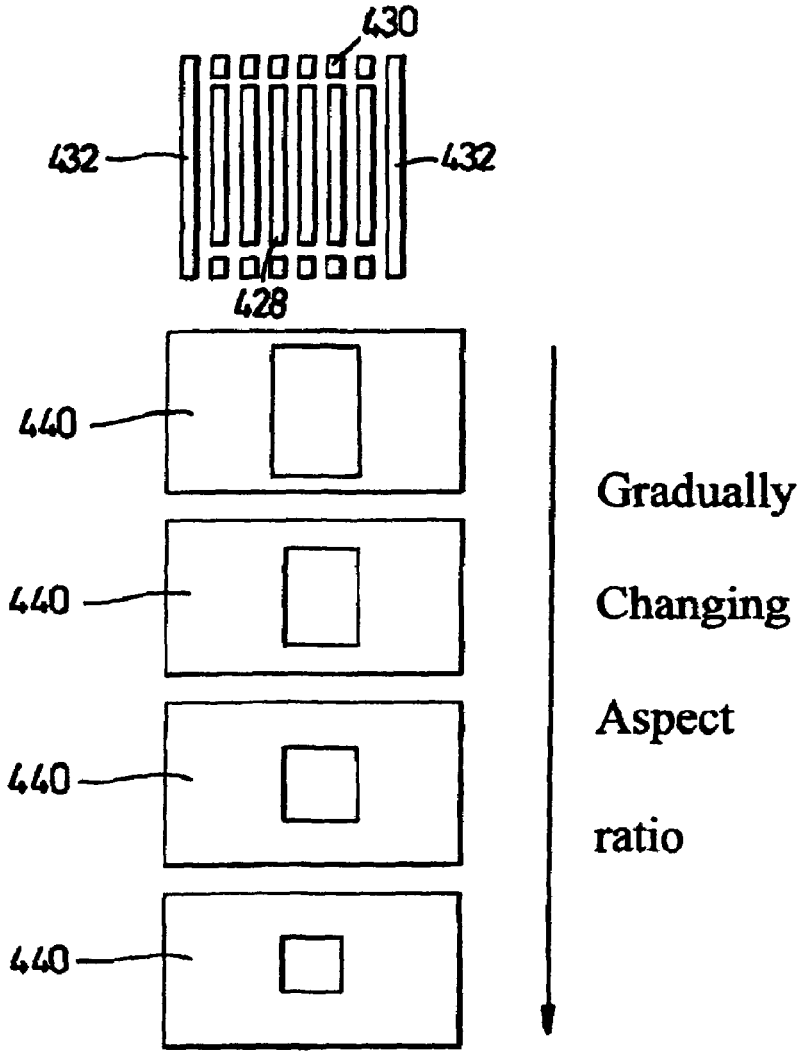
FIG. 40 shows a beam shaper.

FIG. 38 shows an arrangement comprising a fragmentation thermalisation and trap stage 420, a mass selective transmission stage 422, a trap-TOF stage 424 and a beam shaper stage 426. The mass selective transmission stage 422 is an ion extraction device of the type discussed above. Each of the stages 420, 422, 424, 426 comprise spaced apart stacks of RF electrodes 428 and spaced apart stacks of DC electrodes 430. Also provided are end plates 432. The fragmentation thermalisation and trap 420 is operated so as to produce a negligible ripple in the effective axial potential. The device has a relatively gentle drive field, and accumulates and fragments ions, sending populations of fragments to the mass selective transmission stage 422. The fragmentation thermalisation and trap stage 420 accumulates incoming signal whilst mass selective ejection occurs. The mass selective transmission stage 422 operates generally in the manner described above, having a relatively large mass dependent ripple in the effective axial potential. The trap-TOF stage 424 has a negligible ripple in the axial effective potential. The device accumulates ions and sends packets of ions to the beam shaper stage 426. The trap-TOF stage 424 has a relatively gentle drive field. Extraction from the trap may be synchronised with a pusher by a variable mass dependent delay such as shown in FIG. 39. In contrast to the other stages, the beam shaper stage 426 is an RF only device. Thus, potentials are not applied to the DC electrodes in order to establish an electrostatic ion trapping potential well, and therefore it may be possible to dispense with the DC electrodes in the beam shaper stage 426. The beam shaper stage 426 has a negligible ripple in the axial effective potential, and, as shown in FIG. 40, has a plurality of different plates 440 of varying internal aspect ratio which prepares the ion beam for introduction into a subsequent analysis stage. The subsequent analysis stage may be a mass spectrometer stage such as a multipole device or, preferably, a TOF device.

Figure 41:
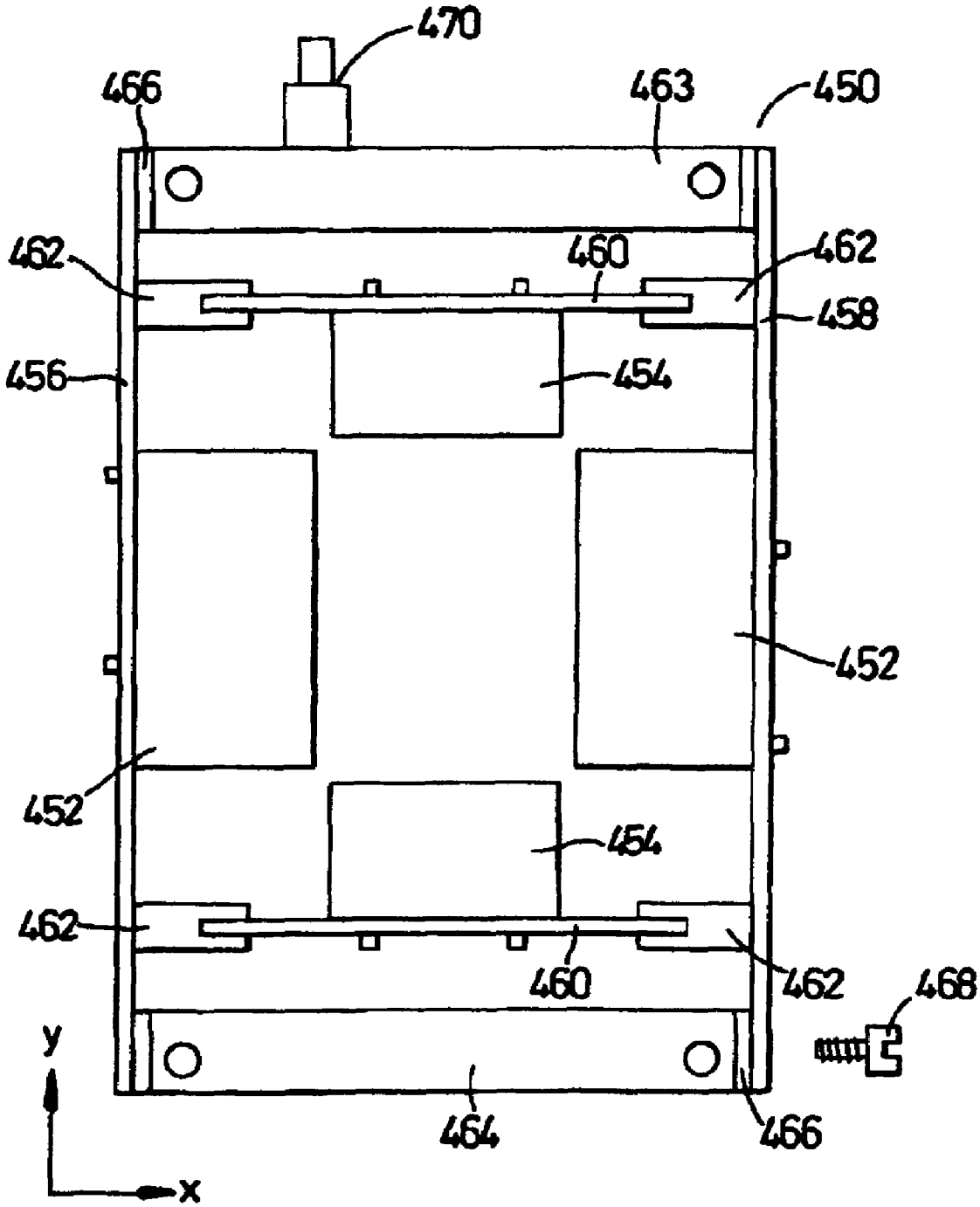
FIG. 41 is an end view of a partly constructed device of the invention.

A non-limiting way in which ion extraction devices of the invention may be constructed will now be described. In the non-limiting method, electrodes are mounted on printed circuit boards (PCBs). The mounting of plates on PCBs provides flexibility in terms of how the device is wired. Advantageously, it has been found that PCB holes are accurate enough to obtain the desired optical performance. FIG. 41 is an end view of a device, shown generally at 450, comprising a plurality of RF electrodes 452 and DC electrodes 454. The RF electrodes 452, which may be RF plates, are directly mounted onto PCBs 456, 458. One stack of RF electrodes is mounted on first PCB 456, and a second stack of RF electrodes is mounted on a second PCB 458. The DC electrodes 454 are mounted on members 460 which themselves are mounted on the PCBs 456, 458 via edge connectors 462. The passageway defined by the spaced apart DC electrodes 454 and RF electrodes 452 represents an ion extraction volume having an ion extraction pathway. In this example, the ion extraction volume is a cuboid having a rectangular face defined by the spacings of the DC electrodes 454 and RF electrodes 452. In the non-limiting example, these spacings are 14 mm and 8 mm respectively, providing an aspect ratio of 1.75. Other dimensions and/or aspect ratios are within the scope of the invention. However, it should be noted that the provision of a cuboid ion extraction volume as opposed to a cubic ion extraction volume (in which the aspect ratio is 1.0) enables the advantageous axial effective potential to be generated. The device shown in FIG. 41 further comprises a top plate 463 and bottom plate 464. The top and bottom plates 463, 464 may be formed from a convenient material such as metal, and may be positioned against the PCBs 456, 458 with gaskets 466, and fixed in place with suitable fixing means such as screws 268. A gas inlet 470 is provided on the top plate 462. The RF electrodes 452 have tabs 452*a* which protrude through the PCBs 456, 458 thereby permitting convenient wiring. Similarly, the DC electrodes 454 have tabs 454*a* which protrude through the members 460 enabling convenient wiring of the DC electrodes too. Each DC electrode 454 may be attached to a separate member 460, with each DC electrode 454/member 460 unit being spaced apart from each other. In this way, apertures are provided between DC electrodes 454/member 460 units permitting the entry of gas into the cell from the gas inlet. Entrance and exit plate assemblies including suitably shaped entrance and exit apertures can be fixed to the edges of the PCBs 456, 458 and top and bottom plates 462, 464 using gaskets.

Figure 42:
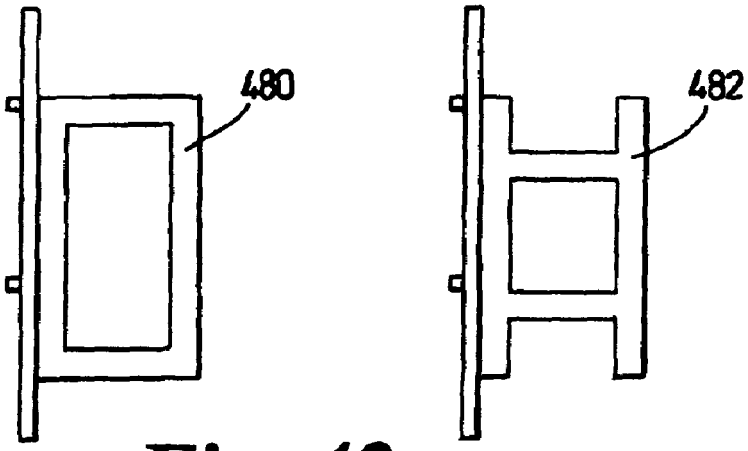
FIG. 42 shows hollowed out RF plates.

FIG. 42 shows possible designs of hollow RF plates 480, 482. Hollow plates result in a reduced capacitance, and thus a reduced loading on the RF power supply. It is possible to provide adjacent plates that have a different shape. The plates can be chemically etched, and might be gold plated. The constructional approach depicted in FIG. 41 is convenient, cost effective and permits easy manufacture of devices of the present invention. The device may be constructed by soldering, which may require use of a construction jig to hold the plates in place.

Figure 16B:
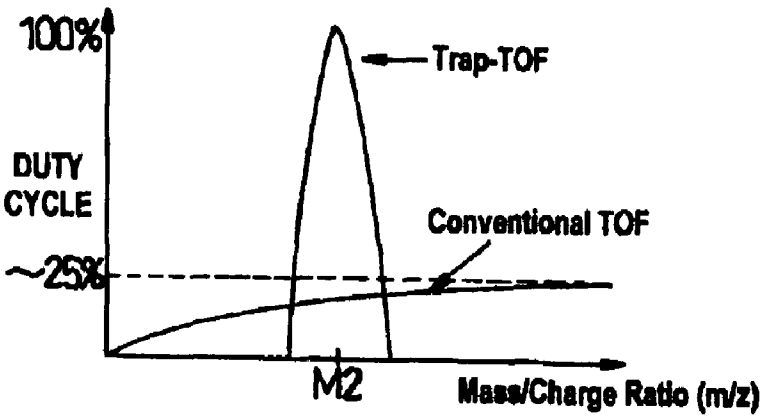
FIG. 16 shows (a) how ions of different mass to charge ratio become temporally and spatially separated in an axial drift region and (b) how the duty cycle of an oa-TOF is increased to up to 100% for the chosen ion species in a prior art arrangement.
Figure 16A:
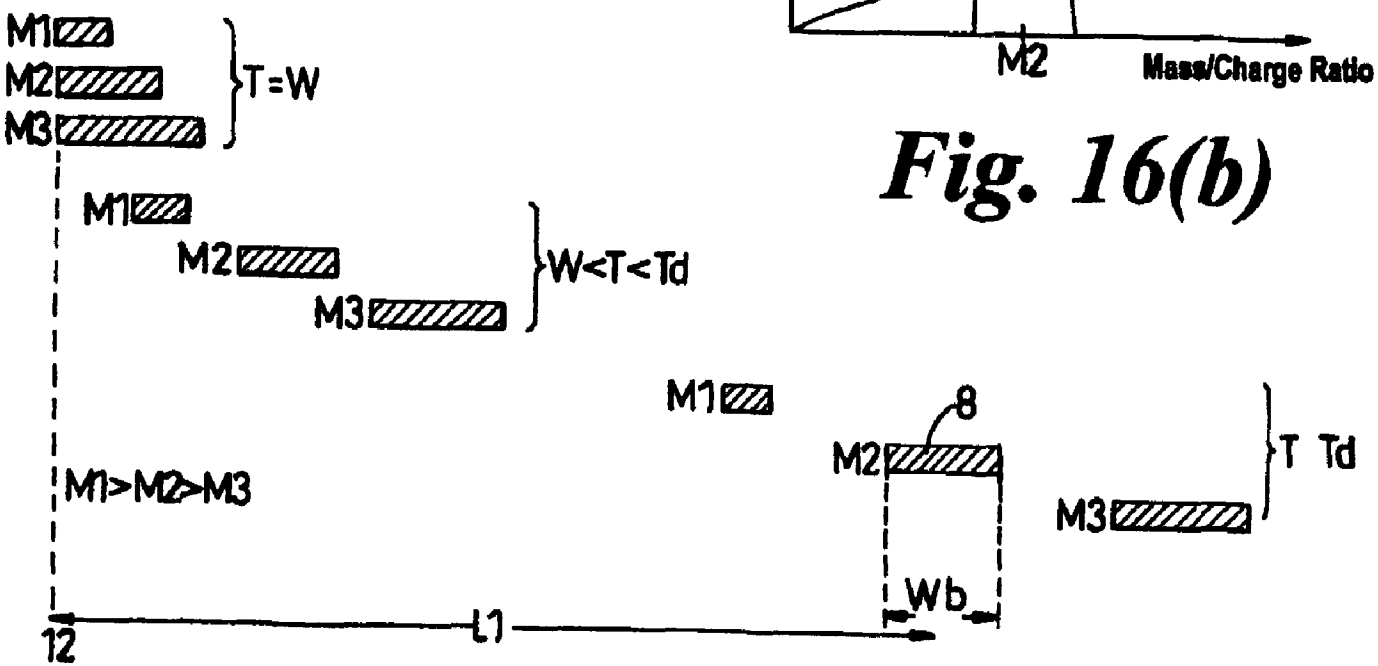
Fig. 16(a) PRIOR ART

Greater analytical utility may be had when devices of the invention are coupled to further spectrometer stages such as quadrupole and time-of-flight (TOF) instruments. In particular it is envisaged that when coupled to an oa-TOF (orthogonal acceleration TOF) improvements in duty cycle may be realised. U.S. Pat. No. 5,689,111 describes a method whereby trapping within a multipole ion guide can give greater sensitivity by increasing the duty cycle of an oa-TOF for a selected M/z value in an MS experiment. Similarly U.S. Pat. Nos. 6,285,027 and 6,507,019 describe the use of such a set up to give greater sensitivity on a chosen fragment ion by increasing the duty cycle in the same manner. FIG. 16(*a*) (reproduced from EP 1,271,138) shows how ions of different mass to charge ratio become temporally and spatially separated in an axial drift region, whilst FIG. 16(*b*) shows how the duty cycle is increased to up to 100% for the chosen ion species but reduced to zero for ions outside a certain range. This is compared to a typical maximum duty cycle of 25% obtained by operating the TOF in a conventional manner. US Application 2003/0132377 describes duty cycle improvements across the entire mass range using either a 3D ion trap, a magnetic Penning trap or a linear quadrupole ion trap. Okumua et al (51st ASMS THPJ2 170) also describes the use of a 3D ion trap coupled to an oa-TOF with improved duty cycle. It is envisaged that the current invention will also provide 100% duty cycle for all ions, ie, both parents and fragments when coupled to a TOF mass spectrometer. In one embodiment desired ions are pulsed out of the device, for example by varying the RF potential, by an auxiliary extraction electrode or by an end plate, and the pulsing of the pusher electrode is timed to coincide with the ejection of the M/z packet from the device. The extract-pulse cycle may be repeated until all the ions have been extracted and then the device adjusted to eject ions of the next desired M/z value. The simplicity of operation and mono-energetic nature of the extracted ions offer a significant advantage over the 3D Quadrupole Ion Trap (QIT) embodiments. Note that 100% duty cycle depends upon the ion extraction device accumulating with 100% efficiency and being isolated by 100% efficient TRAP upstream of the ion extraction device while it is ejecting ions sequentially to the TOF. In one embodiment it is envisaged that the upstream TRAP could be another ion extraction device of the present invention which has been appropriately biased to prevent ions entering the downstream stage.

Figure 17:
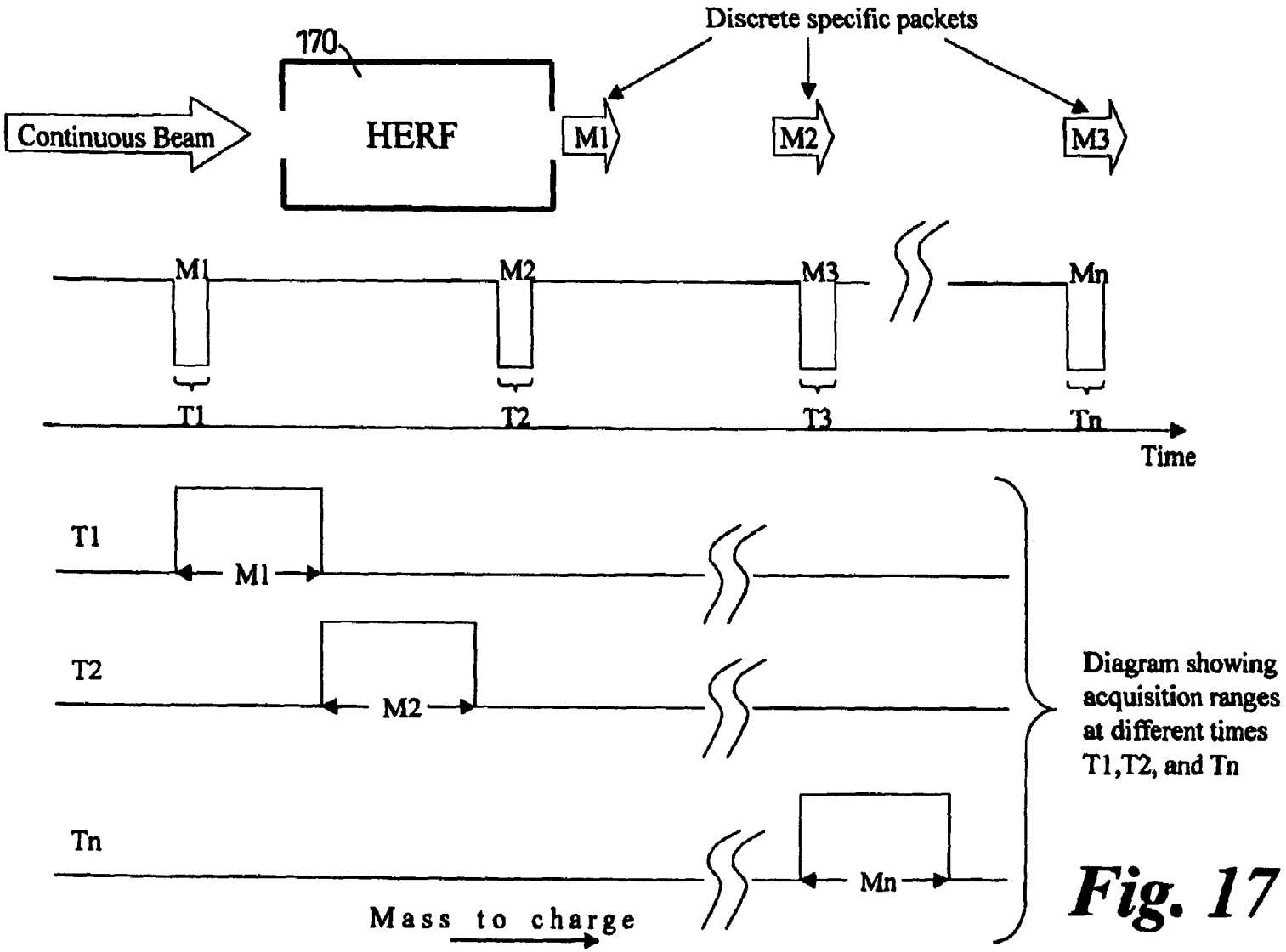
FIG. 17 shows a steady state implementation of an accumulation ion trap.

It has also been recognised that the operation of an ion extraction device of the invention with an oa-TOF can improve signal to noise ratio particularly when coupled to analogue to digital converter acquisition electronic (ADC's). ADC converters offer significant dynamic range advantages over time-to-digital converters (TDC's) for high ion currents, however at low ion currents their poorer noise characteristics may obscure weak signals particularly over long integration periods. The improvement in signal to noise relies on two concepts; concentration of ion signals into shorter timepackets, and concentration into smaller discrete mass ranges. FIG. 17 shows the steady implementation (ie, constant ion signal into the device) of an accumulating ion trap 170 with extract pulse wide "W" and trapping time "T" split into n discrete and equal mass ranges. If the trap is 100% efficient and emits ions of all mass equally then the intensity of the ion packet is n(W+T)/W times more intense during its extraction phase (and emitted in a factor of W/n(W+T) shorter time) than the equivalent continuous experiment for any particular mass. Signal to noise is dramatically improved as the ADC need not be acquiring data while there is no signal, the mass range of acquisition set on the ADC being correlated to that being emitted by the trap of the present invention at that point in time. Typically the trap of the present invention may be set to emit over ten separate discrete mass ranges to cover the whole mass range of interest with data only being recorded into those mass channels corresponding to that being emitted by the trap. The trap to extract ratio is limited only by the space charge capacity of the device as the overall charge contained within the device increases by the ratio (W+T)/W.

The usefulness of selecting a chosen charge state or charge states has been previously recognised and is important for improving signal to noise ratio in Proteomics type applications. For example a tandem ion mobility spectrometer may be scanned in tandem with a quadrupole mass filter to select a chosen charge state (see, for example, European Patent Application EP 1 271 137 A2). The output of the ion extraction device of the present invention when operating as a mobility separator may also be filtered by mass spectrometry means such as a quadrupole mass filter or axial time-of-flight (or other MS) to give complete selection of desired charge state so improving the signal to noise ratio in, for example, Proteomics experiments. The principle of operation of the ion extraction device of the present invention as a mobility separation device should be considered in the light of the added consideration that the magnitude of effective potential will vary with gas pressure and ion cross section. Tolmachev (A. V. Tolmachev et al: Nuclear Instruments and Methods in Physics Research B 124 (1997) 112-119) utilises the hard sphere model to predict how the magnitude of the effective potential varies with gas pressure and ion cross section. A multiplicative attenuation factor γ should be incorporated in the effective potential and is given by:

$$\gamma = \frac{\omega^2\tau^2}{1+\omega^2\tau^2}$$

where $$\tau = \frac{3(m+M)}{4mn\sigma v}$$

where ω is the angular frequency of the RF driving field, m the mass of the background gas molecules, M the mass of the ion, n the number density of the buffer gas, v the average Maxwellian gas velocity and σ the collision cross section of the ion. The model predicts attenuation of the effective potential field as gas pressure increases, in particular it is stated that if an ion undergoes a large number of collisions with residual gas molecules during the period of one RF cycle then the effective potential is reduced. The mobility of an ion is related to its collision cross section by the following relationship (Anal. Chem. 1998, 70, 2236-2242):

$$K := \frac{\sqrt{18\cdot\pi}}{16}\cdot\frac{q}{\sqrt{k\cdot T}}\cdot\sqrt{\frac{1}{M}+\frac{1}{m}}\cdot\frac{1000}{P}\cdot\frac{T}{273.2}\cdot\frac{1}{n\cdot\sigma}$$

where T is the absolute temperature, P the pressure in mbar, and k is Boltzman's constant. The gas pressure within the ion extraction device is then adjusted to the 60 regime where the term γ becomes significantly less than 1 (at low pressures γ equals 1 for all ions and there is no attenuation of effective potential) so that ions of different cross section or ion mobility can be made to occupy different positions as the location of the potential well(s) moves due to the variation in effective potential described above. Mobility selective extraction of ions from the device can therefore be achieved by variation of either the gas pressure, or more preferably the applied RF voltage or dc trapping voltage in the same way as for mass selective ejection described above. Typical, but non-limiting, gas pressures for use of the device as an ion mobility separator are between 0.1 and 10 mbar.

Devices of the present invention may be operated as a collision cell. To do so the whole device should be held at a potential such that ions are accelerated into the device as a desired ion energy. Ions collide with the gas present in the device with sufficient energy to fragment, but are generally thermalised as the ions traverse the length of the device. Thus, by the time the ions reach the exit of the device they can be separated according to their mass to charge ratios in the same way that a mixture of unfragmented ions, injected at low energy, can be separated.

Figure 18:
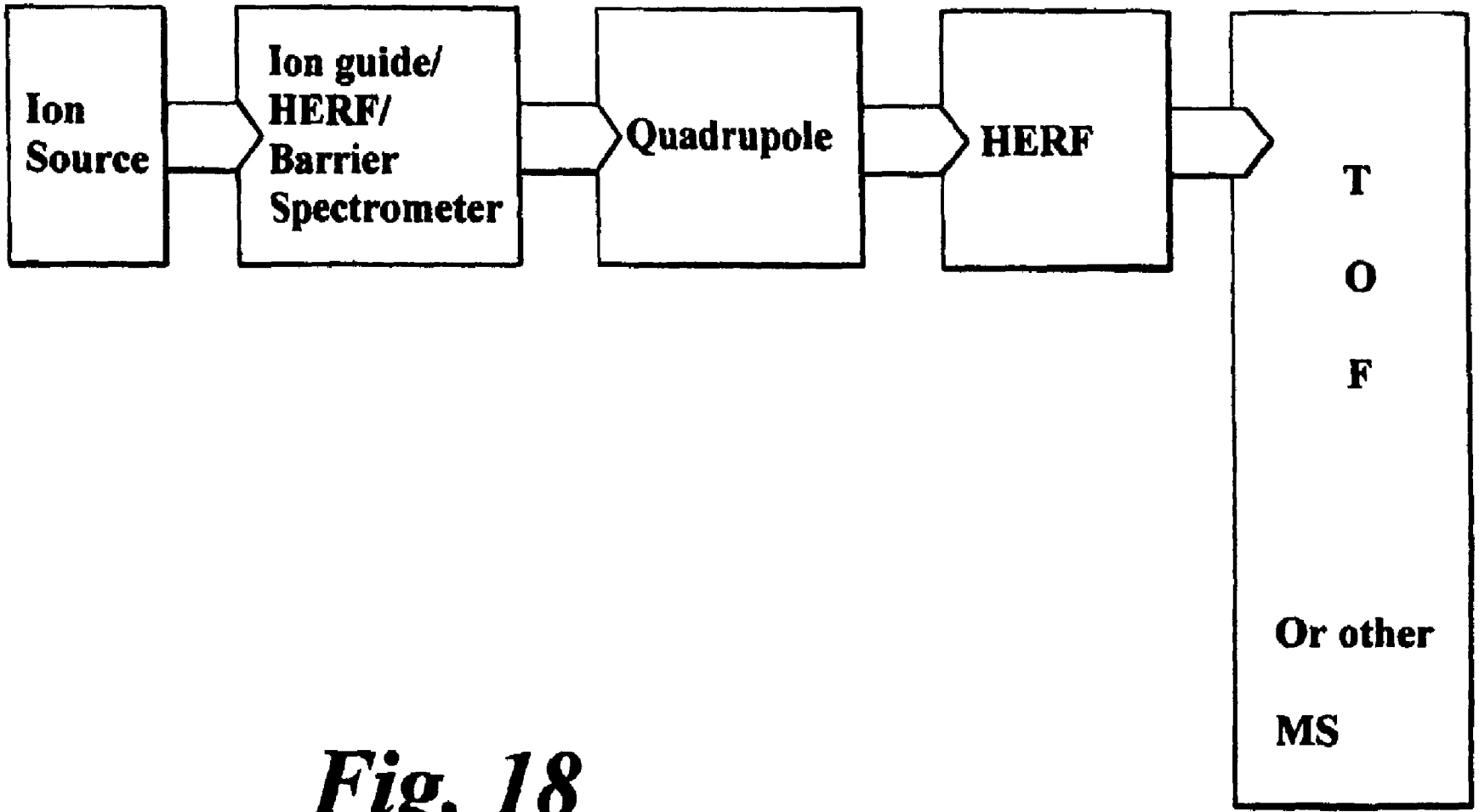
FIG. 18 shows an analytical device of the present invention.

An example of an instrument configuration utilising the ion extraction device of the present invention is shown in FIG. 18. Ions are generated in an ion source 180, typically an electrospray or MALDI source, and are passed through an ion guide 182 to a conventional quadrupole mass spectrometer 184, thence into an ion extraction device 186 of the present invention and on to a further MS stage 188 which may comprise a quadrupole, TOF, FTMS, magnetic sector, ion-trap or any other mass spectrometer. As is the case with most types of trap devices it is necessary to operate on a fill-isolate-extract cycle. Ions are allowed to enter the device 186 for a period of time preferably such that the space charge capacity of said device 186 is not exceeded, the device 186 is then isolated to prevent any more ions entering and, finally ions are extracted sequentially into further downstream stages of the spectrometer. It is necessary to isolate the ion extraction device 186 to prevent artefacts, ie, if the device starts by ejecting an ion of low M/z (denoted $M_L$) and progressively moves to eject ions of higher M/z (denoted $M_H$) then any ions of $M_L$ that arrive in the device 186 at that time will also be transmitted. Similar effects can occur if, for example, the device starts by ejecting ions of high mobility and is scanned to eject ions of lower mobility. Such artefacts will not be optimally detected if the ion extraction device 186 is interfaced to a TOF or other mass spectrometer stage or can cause confusion if interfaced straightforwardly to a simple ion detector. FIG. 18 also shows an upstream ion guide 182 which may also be an ion extraction device of the present invention. In the case of electrospray ionisation, a consequence of interfacing upstream chambers may necessarily be at higher pressures than those required for optimum operation of quadrupole spectrometers. It is in this high pressure regime that it is anticipated that the ion extraction device will operate as an efficient mobility separator. Therefore in one embodiment ion mobility separation in accordance with the invention occurs upstream of the quadrupole 184 to improve signal to noise on, for example, multiply charged peptides and mass selective ejection downstream occurs to give up to 100% duty cycle to the TOF or other MS stage 188.

An example of an experiment which would separate cluster ions of the form $[nM_c]^{n+}$ which all have the same M/z ratio ($M_c$) would be to select the ions at M/z ratio $M_c$ using the first quadrupole and pass them into the device which can then sequentially eject ions according to their ion mobility, ions with the highest mobility (and higher charge state) will be confined to the centre of the ion extraction device before those of lower charge stages and will be extracted first. Such experiments could prove useful in non-covalent protein aggregation studies where conventional mass spectrometry cannot distinguish between these species.

Figure 43:
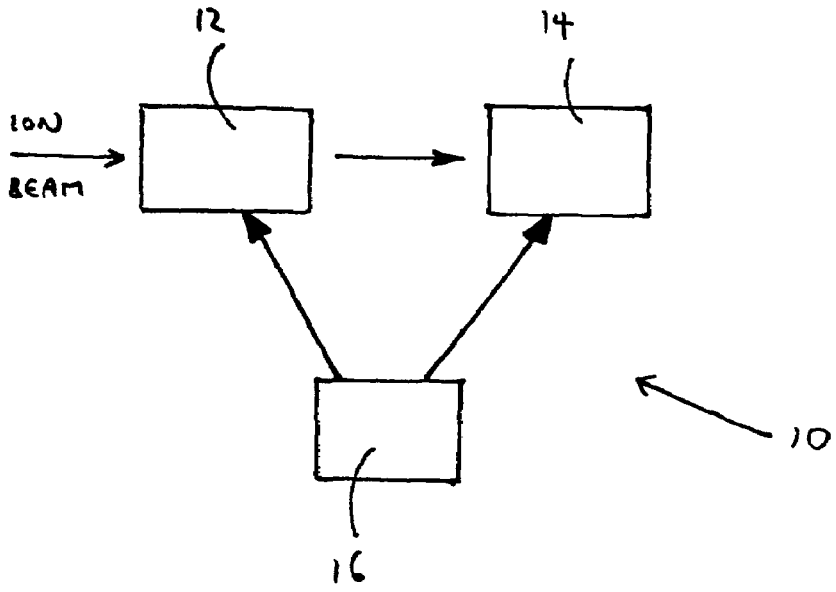
FIG. 43 is a schematic diagram showing a first embodiment of a scanning mass spectrometer of the invention.

FIG. 43 shows a mass spectrometer device of the present invention, shown generally at 10, which includes an ion trap 12 interfaced to a mass scanning mass spectrometer 14 located downstream of the ion trap 12. The ion trap 12 and mass scanning mass spectrometer 14 operate under the control of control means 16. The control means 16 controls the ejection of the ions from the ion trap 12 and the scanning of the mass scanning mass spectrometer 14. In particular, the control means 16 synchronises the ejection of ions from the ion trap 12 so that ions of a given mass are only made available to the mass scanning mass spectrometer 14 when the mass scanning mass spectrometer 14 is at a point in its scan when ions of the given mass are being detected, and not at other times, although the skilled reader will appreciate that owning to the constraints of the mass resolution of the ion trap 12, it is likely that some ions of the given mass will be ejected for a period of time before and/or after ions of the given mass are transmitted and detected by the mass selective mass spectrometer 14. However, for significant periods of the scan cycle of the mass selective mass spectrometer 14, ions which are not actually being detected by the mass selective mass spectrometer 14 are accumulated and held in the ion trap. Typically, the control means 16 comprises one or more computers and associated electronics. The control means 16 might be custom built to perform its functions. Alternatively, the mass spectrometer device 10 may utilise a commercially available mass scanning mass spectrometer, in which instance the control means may comprise the commercially available control system for controlling the scanning of the mass scanning mass spectrometer 14 together with a suitable interface for controlling the ejection of ions from the ion trap 14 and synchronising this with the scanning of the mass scanning mass spectrometer 14.

As an example of the benefits provided by the invention, it is instructive to consider the case of a quadrupole mass spectrometer scanning over 1000 Da once every second starting from mass 0 and ending at mass 1000. If an accumulating ion trap is now fitted upstream of the quadrupole and set to repeatedly accumulate ions over the first 0.9 seconds of the quadrupole scan and to release them for the last 0.1 seconds then the resulting acquired mass spectrum will be empty of ions except for the last 10% (900-1000 Da) of the mass scale. This last 10% however, will have ions that are ~10 times more intense than the continuous case. This is because the trap stores all the ions and releases them in an intense burst, i.e. the ion currents of all the species are ten times more intense during the release period than they are in the continuous case (as no ions are lost in the trap). If, in accordance with the present invention, the accumulating trap is configured to release the ions in a mass dependent manner during the course of the one second scan with a mass resolution of ten then synchronising the output of this device with the setting of the quadrupole in a linked scan will increase the sensitivity of the quadrupole by that same factor. The higher the resolution of the mass dependent ion trap the greater the enhancement over the continuous (no trap) case. In the limit of the trap being capable of emitting masses with a constant width of 1 Da then the quad would be 1000 times more sensitive. However the quadrupole would not then be needed as the trap would be providing the required resolution and sensitivity. It can therefore be seen that a relatively crude accumulating trap that emits in a controllable mass dependent manner can enhance the sensitivity of scanning spectrometers with greater finesse (resolution).

Figure 44:
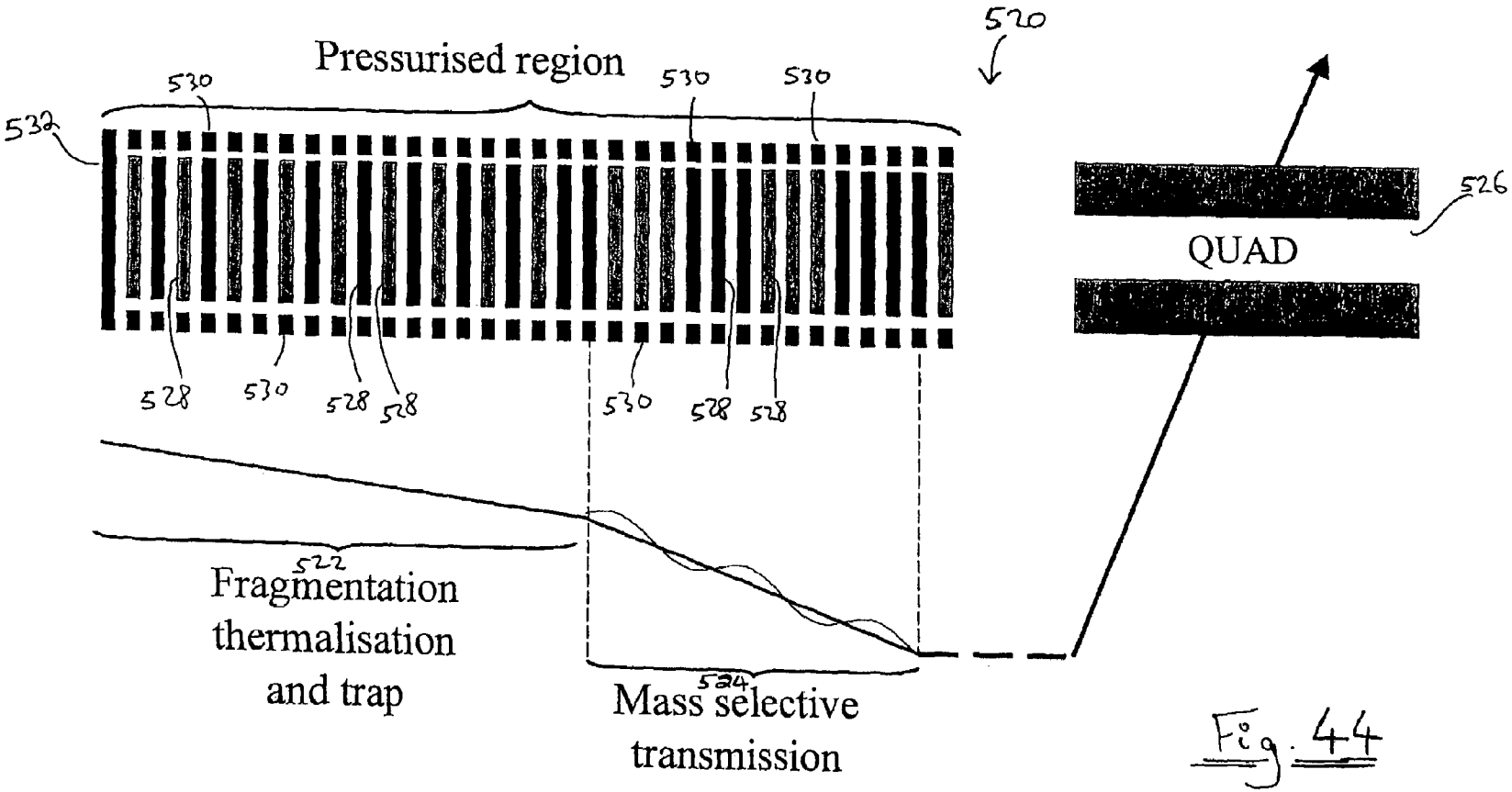
FIG. 44 shows a second embodiment of a scanning mass spectrometer.
Figure 45:
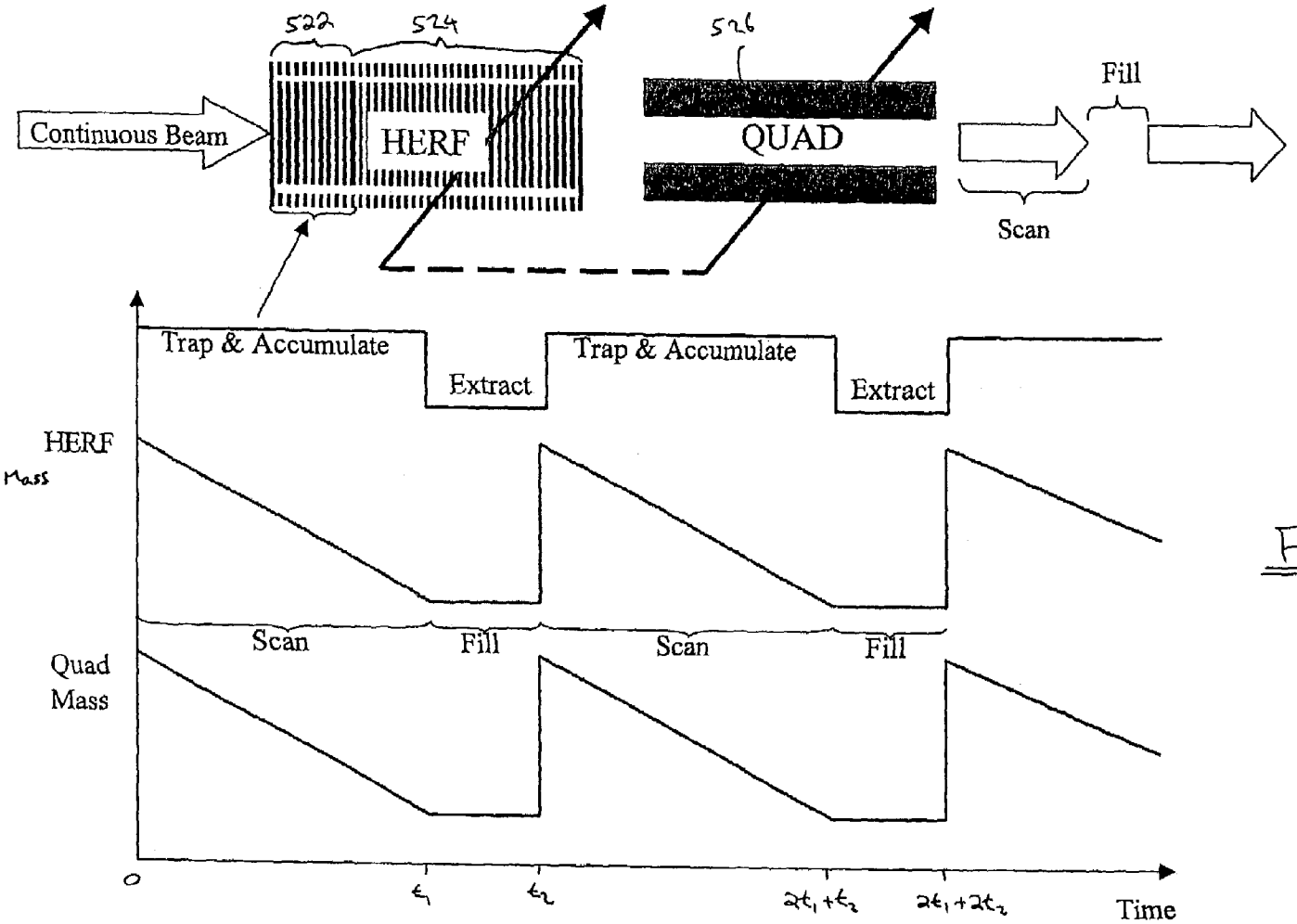
FIG. 45 shows the operation of the second embodiment of a scanning mass spectrometer.

FIG. 44 depicts a second embodiment of the invention, shown generally at 520, comprising a fragmentation, thermalisation and trap stage 522, a mass selective ion transmission stage 524, and a quadrupole mass spectrometer 526. The fragmentation, thermalisation and trap stage 522 and the mass selective ion transmission stage 524 are of the type disclosed in earlier, for example in FIG. 38, each comprising spaced apart stacks of RF electrodes 528 and spaced apart stacks of DC electrodes 530. Thus both the fragmentation, thermalisation and trap stage 522 and the mass selective ion transmission stage 524 comprise a plurality of segmented RF/DC electrode units, wherein each RF/DC electrode unit comprises a co-planar arrangement of two opposed RF electrodes 528 and two opposed DC electrodes 530. Also provided is an end plate 532. The fragmentation, thermalisation and trap stage 522 accumulates incoming signal from a suitable ion supply stage (not shown) whilst mass selective ejection occurs in the mass selective ion transmission stage 524. The mass selective transmission stage 524 is operated according to the principles disclosed herein. FIG. 44 also comprises a DC potential energy diagram for the system, which shows the relatively large mass dependent ripple in the effective axial potential which can be created using ion traps of this type. The mass selective output of the ion transmission stage 524 is synchronised with the scanning of the quadrupole mass spectrometer 526, and this process is shown in more detail in FIG. 45, which utilises numerals utilised in FIG. 44 to denote features shared between these Figures. As shown in FIG. 45, the trap stage 522 traps and accumulates ions from a suitable continuous beam source for a period of time $t_1$, which time corresponds to the scan time of the quadrupole mass spectrometer 526. During this period of time the mass of the ion selectively extracted from the trap stage 524 is varied so that the mass of the ions extracted corresponds to the mass of the ions being sampled at that time by the quadrupole mass spectrometer 526. After the scan cycle of the quadrupole mass spectrometer 526 is complete, an extraction/fill phase between time $t_1$ and time $t_2$ occurs in which ions are extracted from the trap stage 522 so as to fill the ion transmission stage 524. After the process is complete, another scan cycle of the quadrupole mass spectrometer 526 is commenced in synchrony with the mass selective extraction of ions from the ion transmission stage 524.

Figure 46:
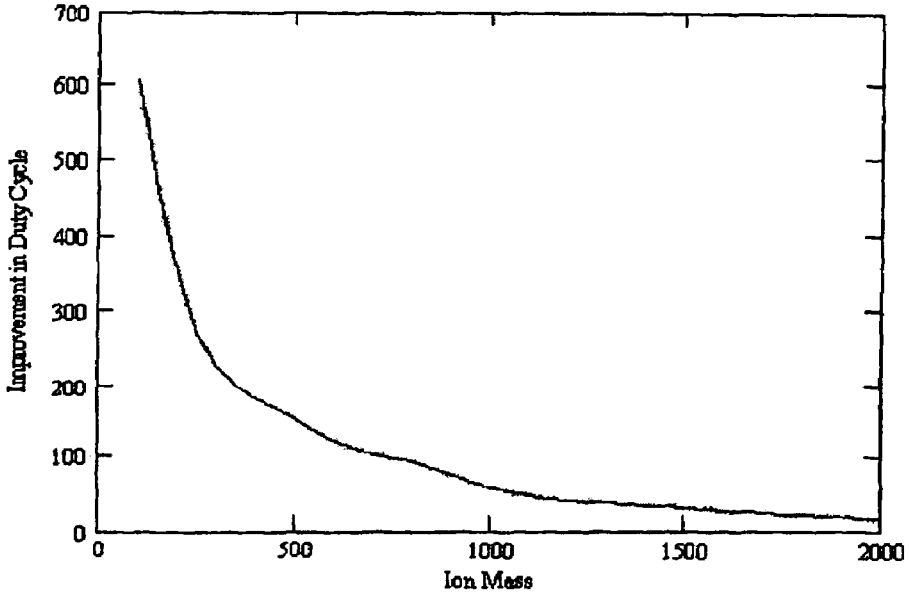
FIG. 46 shows the improvement in duty cycle as a function of ion mass for a scanning mass spectrometer coupled to an ion trap according to the invention in comparison to the same mass spectrometer without the ion trap.

Calculations have been performed to determine the improvement in duty cycle for a quadrupole mass spectrometer that is coupled to a mass selective ion transmission stage in the manner depicted in FIGS. 44 and 45. The improvements in duty cycle are shown in FIG. 46, and are in relation to the quadrupole mass spectrometer without the mass selective ion transmission stage coupled to it. The improvements are presented as a ratio of the duty cycle of the quadrupole mass spectrometer with mass selective ion transmission stage to the duty cycle of the quadrupole mass spectrometer without the mass selective ion transmission stage. It can be seen that very large improvements in duty cycle are apparent across a wide ion mass range. The improvements are even more significant at relatively low ion mass. Physically, this is due to the nature of the mass selective ion transmission stage, which has a more or less constant mass resolution (as previously defined) across the ion mass range. From this it follows that at relatively low mass M, the minimum number of mass units (ΔM) that an ion can differ from mass M and still be resolved from ions of mass M will be smaller than at high M. Therefore, a greater proportion of the ions being introduced into the quadrupole mass spectrometer at any given moment will correspond to the ion mass being transmitted by quadrupole mass spectrometer. Put another way, more effective synchronisation of the ion ejection from the mass selective ion transmission stage and the mass scanning of the quadrupole mass spectrometer is achieved.

The ion transmission stage is configured so that the mass selective ejection of ions runs from high mass ions to low mass ions. However, there is no reason in principle why a mass selective ion trap which initially ejects ions of relatively low mass and sweeps upwards towards the ejection of ions of relatively high mass should not be utilised.

The invention claimed is:

1. A method of selectively extracting ions comprising the steps of:

providing a supply of ions in a body of gas;

generating a ponderomotive ion trapping potential generally along an axis;

generating further potentials to provide an effective potential which prevents ions from being extracted from an extraction region;

trapping ions in said effective potential; and selectively extracting ions of a predetermined m/z ratio or ion mobility from the extraction region;

in which the characteristics of the effective potential which prevent ions from being extracted from the extraction region are caused, at least in part, by the generation of the ponderomotive ion trapping potential.

2. A method according to claim 1 comprising the steps of:

i) providing a supply of ions in a body of gas in an ion extraction volume, the ion extraction volume defining an ion extraction pathway;

ii) generating a ponderomotive ion trapping potential generally along a single axis;

iii) generating an electrostatic ion trapping potential well generally along a single axis which is orthogonal to the single axis along which the ponderomotive ion trapping potential is generated;

steps i), ii), and iii) being performed so as to provide an effective potential which causes spatial separation of ions having differing mass to charge ratios and/or ions having different ion mobilities; thereby producing a plurality of spatially separate populations of ions having different mass to charge ratios and/or a plurality of spatially separate populations of ions of different ion mobilities; and selectively extracting a population of ions.

3. A method according to claim 2 in which the ions are entrained in a flow of gas.

4. A method according to claim 3 in which both the ponderomotive ion trapping potential and the electrostatic ion trapping potential are generated generally along single axes which are orthogonal to the direction of the flow of gas.

5. A method according to claim 2 in which the electrostatic ion trapping potential well is generated by applying potentials to at least one pair of electrodes, the at least one pair of electrodes being spaced apart across the body of gas.

6. A method according to claim 2 in which the ponderomotive ion trapping potential is generated by an RF electrode set.

7. A method according to claim 2 in which a population of ions is extracted from a predetermined spatial location.

8. A method according to claim 7 in which selective extraction of a population of ions is achieved by causing a selected population of ions to move to the predetermined spatial location, and thereafter extracting said population of ions from said predetermined spatial location.

9. A method according to claim 8 in which a selected population of ions is caused to move to the predetermined spatial location by varying the effective potential.

10. A method according to claim 9 in which the effective potential is varied by varying the pondermotive ion trapping potential and/or the electrostatic ion trapping potential well.

11. A method according to claim 7 in which the population of ions is extracted from a predetermined spatial location by way of providing an ion barrier across the body of gas, the ion barrier having an aperture located therein, and extracting ions through the aperture.

12. A method according to claim 1 comprising the steps of:

i) providing a supply of ions in a body of gas in an ion extraction volume; the ion extraction volume defining an extraction pathway;

ii) providing an RF electrode set;

iii) applying an oscillatory RF potential to the RF electrode set to a) generate a ponderomotive ion trapping potential generally along at least one axis which is transverse to the ion extraction pathway; and b) generate an effective potential along the ion extraction pathway, the effective potential containing at least one potential barrier the magnitude of which is dependent on the m/z ratio of an ion in the supply of ions and substantially independent of the position of the ion along said transverse axis, the effective potential along the ion extraction pathway being generated, at least in part, by the oscillatory RF potential applied to the RF electrode set, the at least one potential barrier being caused by a periodicity in the oscillatory RF potential applied to the RF electrode set; and iv) varying the effective potential so as to allow ions of a predetermined m/z ratio or ion mobility to be selectively extracted.

13. A method according to claim 12 in which the RF electrode set comprises subsets of RF electrodes disposed along the ion extraction pathway, and the at least one potential barrier is caused by a periodicity in the oscillatory RF potential applied to subsets of RF electrodes disposed along the ion extraction pathway.

14. A method according to claim 12 in which ions are selectively extracted by varying the magnitude of the oscillatory RF potential.

15. A method according to claim 12 in which the ions are entrained in a flow of gas.

16. A method according to claim 15 in which the ponderomotive ion trapping potential is generated generally along at least one axis which is orthogonal to the direction of the flow of gas.

17. A method according to claim 12 further comprising the step of generating an electrostatic ion trapping potential well generally along an axis which is orthogonal to an axis along which the ponderomotive ion trapping potential is generated, and orthogonal to the ion extraction pathway.

18. A method according to claim 17 in which the electrostatic ion trapping potential well is generated by applying potentials to at least one pair of electrodes, the at least one pair of electrodes being spaced apart across the body of gas.

19. A method according to claim 6, claim 17 or claim 18 in which DC electrostatic potentials are applied to the RF electrode set to assist in the generation of the electrostatic ion trapping potential well.

20. A method according to claim 1 in which the effective potential comprises a drift potential applied along the ion extraction pathway.

21. A method according to claim 20 in which ions are selectively extracted by varying the magnitude of the drift potential.

22. A method according to claim 1 in which the effective potential is varied by varying the pressure of the body of gas.

23. A method of analysing ions or phenomena associated with ions comprising the steps of:

providing analysis means for analysing ions or phenomena associated with ions;

introducing ions into the analysis means by selectively extracting said ions using a method according to claim 1; and analysing the extracted ions or phenomena associated with the extracted ions.

24. A method according to claim 23 in which the analysis means comprises mass spectrometry means.

25. A method according to claim 24 in which the mass spectrometry means comprises a time of flight (TOF) mass spectrometer.

26. A method according to claim 24 in which the mass spectrometry means comprises a multipole mass spectrometer, preferably a quadrupole mass spectrometer.

27. A method according to claim 23 in which:

first and second analysis means for analysing ions or phenomena associated with ions are provided; and ions emanating from the first analysis means are introduced into the second analysis means by selective ion extraction using a method according to claim 1.

28. A method according to claim 27, in which:

ions are introduced into the first analysis means by selective ion extraction using a first method according to claims 1 and ions are introduced into the second analysis means by selective ion extraction using a second method according to claim 1.

29. A method according to claim 23 in which:

the analysis means operates by way of pulsed acquisition of ions; and the timing of the selective extraction of ions is synchronised with the pulsed acquisition of ions by the analysis means so as to improve the efficiency with which extracted ions are analysed.

30. A method according to claim 29 in which the analysis means comprises a detector and data acquisition means to acquire data relating to events detected by the detector.

31. A method according to claim 30 in which the data acquisition means acquires data over a selected time period which is correlated with the period of time during which events which are associated with the selectively extracted ions are detected by the detector.

32. A method according to claim 30 in which the data acquisition means comprises analogue to digital converter acquisition means.

33. A method according to claim 29 in which the analysis means comprises mass spectrometry means, preferably a TOF mass spectrometer, most preferably an oa-TOF mass spectrometer.

34. A method according to claim 29 in which an ion trap is utilised to control the supply of ions for use in the method according to claims 1.

35. An ion extraction device comprising:

a gas cell in which a supply of ions in a body of gas can be located;

means for generating a ponderomotive ion trapping potential generally along an axis;

means for generating further potentials to provide an effective potential which prevents ions from being extracted from an extraction region; the device being configured so that the characteristics of the effective potential which prevent ions from being extracted from the extraction region are caused, at least in part, by the generation of the ponderomotive ion trapping potential; and ion extraction means for selectively extracting ions of a predetermined m/z ratio or ion mobility from the extraction region.

36. An ion extraction according to claim 35 comprising:

a gas cell in which a supply of ions in a body of gas can be located, the gas cell having an ion extraction volume defining an ion extraction pathway;

means for generating a ponderomotive ion trapping potential, the potential being generated across the gas cell;

means for generating an electrostatic ion trapping potential well, the potential well being generated across the gas cell generally along a single axis which is orthogonal to the single axis along which the ponderomotive potential is generated; and ion extraction means for spatially selective extraction of populations of ions located at a predetermined spatial location.

37. An ion extraction device according to claim 36 in which:

at least a portion of the gas cell comprises a gas flow conduit through which ions entrained in a flow of gas can be transported, the conduit having a direction of gas flow; and the device further comprises gas flow means for providing said flow of gas.

38. An ion extraction device according to claim 37 in which the means for generating a ponderomotive ion trapping potential generates said potential across the direction of flow, and the means for generating an electrostatic ion trapping potential well generates said potential well across the direction of flow.

39. An ion extraction device according to claim 36 in which the means for generating a ponderomotive ion trapping potential comprises an RF electrode set.

40. An ion extraction device according to claim 36 in which the means for generating an electrostatic ion trapping potential well comprises at least one pair of electrodes, the electrodes in the at least one pair of electrodes being spaced apart across the gas cell.

41. An ion extraction device according to claim 40 in which the means for generating an electrostatic ion trapping potential well comprises a series of pairs of electrodes disposed along the gas cell.

42. An ion extraction device according to claim 36 in which at least one of the means for generating a ponderomotive ion trapping potential, the means for generating an electrostatic ion trapping potential well, and the pressure of the body of gas are variable so as to cause a selected population of ions to move to a predetermined spatial location.

43. An ion extraction device according to claim 35 comprising:

a gas cell in which a supply of ions in a body of gas can be located, the gas cell having an ion extraction volume defining an ion extraction pathway;

ion guiding means comprising an RF electrode set;

means for applying an oscillatory RF potential to the RF electrode set so as to a) generate a ponderomotive ion trapping potential generally along at least one axis which is transverse to the ion extraction pathway, and b) generate, at least in part, an effective potential along the ion extraction pathway, the effective potential containing at least one potential barrier the magnitude of which is dependent on the m/z ratio of an ion in the supply of ions and substantially independent of the position of the ion along said transverse axis; in which the at least one potential barrier is caused by a periodicity in the oscillatory RF potential to the RF electrode set; and means for varying the effective potential so as to allow ions of a predetermined m/s ratio or ion mobility to be selectively extracted from the device.

44. A device according to claim 43 in which the RF electrode set comprises subsets of RF electrodes disposed along the ion extraction pathway, in which the at least one potential barrier is cased by a periodicity in the oscillatory RF potential applied to subsets of RF electrodes disposed along the ion extraction pathway.

45. A device according to claim 43 in which the ion guiding means further comprises means for applying a drift potential along the ion extraction pathway.

46. A device according to claim 45 in which the means for varying the effective potential varies the magnitude of the drift potential applied by the means for applying a drift potential so as to selectively extract ions.

47. A device according to claim 43 in which the means for varying the effective potential varies the oscillatory RF potential so as to selectively extract ions.

48. An ion extraction according to claim 43 in which:

at least one portion of the gas cell comprises a gas flow conduit through which ions entrained in a flow of gas can be transported, the conduit having a direction of gas flow; and the device further comprises gas flow means for providing said flow of gas.

49. An ion extraction device according to claim 48 in which the RF electrode set generates the ponderomotive ion trapping potential across the direction of flow.

50. An ion extraction device according to claim 43 in which the ion guiding means further comprises means for generating an electrostatic ion trapping potential well generally along an axis which is orthogonal to an axis along which the ponderomotive ion trapping potential is generated and orthogonal to the ion extraction pathway.

51. An ion extraction device according to claim 50 in which the means for generating an electrostatic ion trapping potential well comprises at least one pair of electrodes, the electrodes in the at least one pair of electrodes being spaced apart across the gas cell.

52. An ion extraction device according to claim 51 in which the means for generating an electrostatic ion trapping potential well comprises a series of pairs of electrodes disposed along the gas cell.

53. An ion extraction device according to claim 43 in which the ion extraction volume is a cuboid having a width, height and length.

54. An ion extraction device according to claim 53 in which the ratio of the width to the height of the cuboid is at least 1:1.5, preferably greater than 1:1.7.

55. An ion extraction device according to claim 43 in which the RF electrode set comprises at least one pair of RF electrode stacks; wherein the stacks in each pair of RF electrode stacks are spaced apart across the gas cell and the RF electrodes in each stack are stacked along the ion extraction pathway.

56. An ion extraction device according to claim 44 in which the means for applying an oscillatory RF potential applies oscillatory RF potential of a common phase to a plurality of adjacent RF electrodes in a subset of RF electrodes, so that the periodicity in the oscillatory RF potential is established between groups of RF electrodes in the subsets.

57. An ion extraction device according to claim 35 in which the ion extraction means comprises an ion barrier disposed across the gas cell and having an aperture formed therein.

58. An ion extraction device according to claim 57 further comprising means for applying an extraction field to extract ions through the aperture.

59. An ion extraction device according to claim 57 in which the ion extraction means comprises an inwardly extending tube formed of a leaky dielectric material which is in communication with the aperture.

60. An ion extraction device according to claim 35 further comprising ion supply means for generating a supply of ions to the gas cell.

61. An analytical device comprising:

at least one ion extraction device according to claim 35; and at least one analysis means for analysing ions or phenomena associated with ions;

in which the analysis means is coupled to the ion extraction device so that ions extracted from the ion extraction device are introduced to the analysis means.

62. An analytical device according to claim 61 in which the analysis means comprises mass spectrometry means.

63. An analytical device according to claim 61 comprising at least two analysis means.

64. An analytical device according to claim 61 comprising at least two ion extraction devices according to claim 35.

65. An analytical device according to claim 64 comprising:

a first ion extraction device according to claim 35;

a first analysis means for analysing ions or phenomena associated with ions, the first analysis means being coupled to the first ion extraction device so that ions extracted from the ion extraction device are introduced to the analysis means;

a second ion extraction device according to claim 35 into which ions emanating from the first analysis means are introduced;

a second analysis means for analysing ions or phenomena associated with ions, the second analysis means being coupled to the ion extraction device so that ions extracted from the second ion extraction device are introduced to the second analysis means.

66. A tandem ion separation device comprising a first ion extraction device according to claim 35 coupled to an ion separation stage.

67. A tandem ion separation device according to claim 66 in which the ion separation stage is a second ion extraction device according to claim 35.

68. A tandem ion separation device according to claim 66 in which the ion separation stage comprises mass spectrometry means.

69. A tandem ion separation device according to claim 68 in which the mass spectrometry means is a multipole mass spectrometer, preferably a quadrupole mass spectrometer.

70. A tandem ion separation device according to claim 66 in which the ion separation stage supplies ions to the first ion extraction device.

71. A mass spectrometer device including:

a mass selective or ion mobility selective ion trap;

a mass scanning mass spectrometer located downstream of the ion trap so that ions ejected from the ion trap are directed into the mass scanning mass spectrometer; means for generating a ponderomotive ion trapping potential generally along an axis; means for generating further potentials to provide an effective potential which prevents ions from being extracted from an extraction region; the device being configured so that the characteristics of the effective potential which prevent ions from being extracted from the extraction region are caused, at least in part, by the generation of the ponderomotive ion trapping potential; and control means for: i) sequentially and selectively ejecting ions from the ion trap according to the mass to charge ratio or the ion mobility of the ions; (ii) scanning the mass of the ions transmitted by the mass scanning mass spectrometer; and (iii) synchronising (i) and (ii) so that the mass of at least some of the ions directed into the mass scanning mass spectrometer corresponds to the mass of the ions transmitted by the mass scanning mass spectrometer thereby enhancing the sensitivity of the mass scanning mass spectrometer.

72. A mass spectrometer device according to claim 71 in which the mass scanning mass spectrometer is a multipole device.

73. A mass spectrometer device according to claim 71 in which the multipole device is a quadrupole mass spectrometer.

74. A mass spectrometer device according to claim 71 in which the ion trap includes:

gas cell in which a supply of ions in a body of gas can be located;

means for generating a ponderomotive ion trapping potential generally along an axis;

means for generating further potentials to provide an effective potential which prevents ions from being extracted from an extraction region; the device being configured so that the characteristics of the effective potential which prevent ions from being extracted from the extraction region are caused, at least in part, by the generation of the ponderomotive ion trapping potential; and ion extraction means for selectively extracting ions of a predetermined m/z ratio or ion mobility from the extraction region.

75. A mass spectrometer device according to claim 74 including:

a gas cell in which a supply of ions in a body of gas can be located, the gas cell having an ion extraction volume defining an ion extraction pathway;

means for generating a ponderomotive ion trapping potential, the potential being generated across the gas cell;

means for generating an electrostatic ion trapping potential well, the potential well being generated across the gas cell generally along a single axis which is orthogonal to the single axis along which the ponderomotive potential is generated; and ion extraction means for spatially selective extraction of populations of ions located at a predetermined spatial location.

76. A mass spectrometer device according to claim 75 in which:

at least a portion of the gas cell includes a gas flow conduit through which ions entrained in a flow of gas can be transported, the conduit having a direction of gas flow; and the device further comprises gas flow means for providing said flow of gas.

77. A mass spectrometer device according to claim 76 in which the means for generating a ponderomotive ion trapping potential generates said potential across the direction of flow, and the means for generating an electrostatic ion trapping potential well generates said potential well across the direction of flow.

78. A mass spectrometer device according to claim 74 in which the means for generating a ponderomotive ion trapping potential includes an RF electrode set.

79. A mass spectrometer device according to claim 75 in which the means for generating an electrostatic ion trapping potential well includes at least one pair of electrodes, the electrodes in the at least one pair of electrodes being spaced apart across the gas cell.

80. A mass spectrometer device according to claim 79 in which the means for generating an electrostatic ion trapping potential well includes a series of pairs of electrodes disposed along the gas cell.

81. A mass spectrometer device according to claim 75 in which at least one of the means for generating a ponderomotive ion trapping potential, the means for generating an electrostatic ion trapping potential well, and the pressure of the body of gas are variable so as to cause a selected population of ions to move to a predetermined spatial location.

82. A mass spectrometer device according to claim 74 including:

a gas cell in which a supply of ions in a body of gas can be located, the gas cell having an ion extraction volume defining an ion extraction pathway;

ion guiding means comprising an RF electrode set;

means for applying an oscillatory RF potential to the RF electrode set so as to a) generate a ponderomotive ion trapping potential generally along at least one axis which is transverse to the ion extraction pathway, and b) generate, at least in part, an effective potential along the ion extraction pathway, the effective potential containing at least one potential barrier the magnitude of which is dependent on the m/z ratio of an ion in the supply of ions and substantially independent of the position of the ion along said transverse axis; in which the at least one potential barrier is caused by a periodicity in the oscillatory RF potential to the RF electrode set; and means for varying the effective potential so as to allow ions of a predetermined m/z ratio or ion mobility to be selectively extracted from the device.

83. A mass spectrometer device according to claim 82 in which the RF electrode set includes subsets of RF electrodes disposed along the ion extraction pathway, in which the at least one potential barrier is caused by a periodicity in the oscillatory RF potential applied to subsets of RF electrodes disposed along the ion extraction pathway.

84. A mass spectrometer device according to claim 82 in which the ion guiding means further includes means for applying a drift potential along the ion extraction pathway.

85. A mass spectrometer device according to claim 84 in which the means for varying the effective potential varies the magnitude of the drift potential applied by the means for applying a drift potential so as to selectively extract ions.

86. A mass spectrometer device according to claim 82 in which the means for varying the effective potential varies the oscillatory RF potential so as to selectively extract ions.

87. A mass spectrometer device according to claim 82 in which:

at least one portion of the gas cell comprises a gas flow conduit through which ions entrained in a flow of gas can be transported, the conduit having a direction of gas flow; and the device further includes gas flow means for providing said flow of gas.

88. A mass spectrometer device according to claim 87 in which the RF electrode set generates the ponderomotive ion trapping potential across the direction of flow.

89. A mass spectrometer device according to claim 82 in which the ion guiding means further comprises means for generating an electrostatic ion trapping potential well generally along an axis which is orthogonal to an axis along which the ponderomotive ion trapping potential is generated and orthogonal to the ion extraction pathway.

90. A mass spectrometer device according to claim 89 in which the means for generating an electrostatic ion trapping potential well comprises at least one pair of electrodes, the electrodes in the at least one pair of electrodes being spaced apart across the gas cell.

91. A mass spectrometer device according to claim 90 in which the means for generating an electrostatic ion trapping potential well comprises a series of pairs of electrodes disposed along the gas cell.

92. A mass spectrometer device according to claim 82 in which the ion extraction volume is a cuboid having a width, height and length.

93. A mass spectrometer device according to claim 92 in which the ratio of the width to the height of the cuboid is at least 1:1.5, preferably greater than 1:1.7.

94. A mass spectrometer device according to claim 82 in which the RF electrode set includes at least one pair of RF electrode stacks; wherein the stacks in each pair of RF electrode stacks are spaced apart across the gas cell and the RF electrodes in each stack are stacked along the ion extraction pathway.

95. A mass spectrometer device according to claim 83 in which the means for applying an oscillatory RF potential applies oscillatory RF potential of a common phase to a plurality of adjacent RF electrodes in a subset of RF electrodes, so that the periodicity in the oscillatory RF potential is established between groups of RF electrodes in the subsets.

96. A mass spectrometer device according to claim 74 in which the ion extraction means comprises an ion barrier disposed across the gas cell and having an aperture formed therein.

97. A mass spectrometer device according to claim 96 further comprising means for applying an extraction field to extract ions through the aperture.

98. A mass spectrometer device according to claim 96 in which the ion extraction means comprises an inwardly extending tube formed of a leaky dielectric material which is in communication with the aperture.

99. A mass spectrometer device according to claim 71 in which the ion trap is a device in which ions are entrained in a laminar flow of a carrier gas and are trapped in a barrier region in which an electrical field is applied across the laminar flow.

100. A mass spectrometer device according to claim 71 in which the ion trap is a Paul trap, a 3D quadrupole field ion trap, a magnetic ion trap or a linear quadrupole ion trap.

101. A mass spectrometer device according to claim 71 in which the mass resolution of the mass scanning mass spectrometer is greater than the mass resolution of the ions ejected from the ion trap by a multiplicative factor in the range 2 to 250, preferably 5 to 15, most preferably about 10.

102. A dual mass spectrometer device including two mass spectrometer devices according to claim 71.

103. A dual mass spectrometer device according to claim 102 further including a collision cell.

104. A method of performing mass spectrometry including:

sequentially and selectively ejecting ions from a mass selective or ion mobility selective ion trap according to the mass to charge ratio or the ion mobility of the ions generating a ponderomotive ion trapping potential generally along an axis; generating further potentials to provide an effective potential which prevents ions from being extracted from an extraction region, in which the characteristics of the effective potential which prevent ions from being extracted from the extraction region are caused, at least in part, by the generation of the ponderomotive ion trapping potential;

directing the ejected ions to a mass scanning mass spectrometer; and scanning the mass of the ions transmitted by the mass scanning mass spectrometer;

in which the ejection of the ions from the ion trap and the scanning of the mass scanning mass spectrometer are synchronised so that the mass of at least some of the ions directed into the mass scanning mass spectrometer corresponds to the mass of the ions transmitted by the mass scanning mass spectrometer thereby enhancing the sensitivity of the mass scanning mass spectrometer.

* * * * *